US011621532B2

(12) United States Patent
Wright

(10) Patent No.: US 11,621,532 B2
(45) Date of Patent: Apr. 4, 2023

(54) APPARATUSES AND METHODS FOR MANIPULATING A WIRE

(71) Applicant: The Boeing Company, Chicago, IL (US)

(72) Inventor: David S. Wright, Snohomish, WA (US)

(73) Assignee: The Boeing Company, Arlington, VA (US)

( * ) Notice: Subject to any disclaimer, the term of this patent is extended or adjusted under 35 U.S.C. 154(b) by 46 days.

(21) Appl. No.: 17/188,317

(22) Filed: Mar. 1, 2021

(65) Prior Publication Data

US 2021/0184413 A1 Jun. 17, 2021

Related U.S. Application Data

(62) Division of application No. 15/368,031, filed on Dec. 2, 2016, now Pat. No. 10,965,081.

(51) Int. Cl.
*H01R 43/22* (2006.01)
*H01R 43/20* (2006.01)
(Continued)

(52) U.S. Cl.
CPC ..... *H01R 43/22* (2013.01); *B25B 7/04* (2013.01); *B25B 7/08* (2013.01); *B25B 7/12* (2013.01); *H01R 43/20* (2013.01)

(58) Field of Classification Search
CPC ..... H01R 43/20; H01R 43/22
(Continued)

(56) References Cited

U.S. PATENT DOCUMENTS 3,676,912 A 7/1972 Anhalt
3,779,108 A 12/1973 Reiter
(Continued)

FOREIGN PATENT DOCUMENTS

CN 103050866 4/2013
CN 203839690 9/2014
(Continued)

OTHER PUBLICATIONS

EPO, European Search Report, Appl. No. 17204967.8, dated Mar. 15, 2018.
(Continued)

*Primary Examiner* — Livius R. Cazan

(57) ABSTRACT

A method of manipulating a wire, having an electrical contact, comprises clamping the wire with a predetermined force between a first gripping portion, installed in a first channel of a first tip half, and a second gripping portion, installed in a second channel of a second tip half. The method also includes pushing the electrical contact into a receptacle of a terminal block using a first internal shoulder of the first channel and a second internal shoulder of the second channel to interlock the electrical contact and the terminal block. With the wire clamped between the first gripping portion and the second gripping portion, the method includes verifying that the electrical contact and the terminal block are interlocked by pulling the first tip half and the second tip half away from the terminal block until the wire slips along the first gripping portion and the second gripping portion.

20 Claims, 30 Drawing Sheets

(51) Int. Cl.
*B25B 7/08* (2006.01)
*B25B 7/12* (2006.01)
*B25B 7/04* (2006.01)

(58) Field of Classification Search
USPC ..... 29/762, 764
See application file for complete search history.

(56) References Cited

U.S. PATENT DOCUMENTS

| | | | | |
|---|---|---|---|---|
| 4,539,873 | A | 9/1985 | Freed | |
| 5,680,697 | A | 10/1997 | Bever | |
| 8,454,070 | B2 | 6/2013 | Bierfreund | |
| 9,263,840 | B1 | 2/2016 | Lazaro | |
| 9,300,104 | B1 | 3/2016 | Lazaro | |
| 2008/0276457 | A1* | 11/2008 | Furuya ..... | H01R 43/20 29/748 |
| 2012/0292935 | A1 | 11/2012 | Bierfreund | |

FOREIGN PATENT DOCUMENTS

| | | |
|---|---|---|
| GB | 395278 | 7/1933 |
| WO | WO7900555 | 8/1979 |

OTHER PUBLICATIONS

Chinese Patent Office, Chinese Office Action, Appl. No. 2017108858781, dated Jun. 30, 2020.

* cited by examiner

APPARATUSES AND METHODS FOR MANIPULATING A WIRE

CROSS-REFERENCE TO RELATED APPLICATIONS

The present application is a divisional application of, and claims priority to, pending application Ser. No. 15/368,031, filed Dec. 2, 2016, and entitled APPARATUSES FOR MANIPULATING A WIRE, the entire contents of which is incorporated herein by reference.

TECHNICAL FIELD

The present disclosure relates to methods for manipulating a wire.

BACKGROUND

Electrical connectors installed in terminal blocks are typically required to be tested to ensure locked seating of the electrical connector to the terminal block. Conventional methods of testing for locked seating of an electrical connector, including manually performing a pull-check on the wire to which the electrical connector is attached, are time-consuming and may be subject to operator error.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter according to the invention relates to an apparatus for manipulating a wire relative to a terminal block. The wire has an electrical contact. The apparatus comprises a first lever and a second lever. The first lever comprises a first tip-support portion, a first handle portion, and a first hinge portion between the first tip-support portion and the first handle portion. The second lever comprises a second tip-support portion, a second handle portion, and a second hinge portion between the second tip-support portion and the second handle portion. The first hinge portion of the first lever and the second hinge portion of the second lever are pivotally interconnected about a lever-pivot axis. The apparatus also comprises means for biasing the first tip-support portion of the first lever and the second tip-support portion of the second lever toward each other. The apparatus additionally comprises a first tip half and a second tip half. The first tip half is pivotally coupled to the first tip-support portion of the first lever about a first tip-pivot axis. The first tip half comprises a first channel. The second tip half is pivotally coupled to the second tip-support portion of the second lever about a second tip-pivot axis. The second tip half comprises a second channel.

Another example of the subject matter according to the invention relates to a method of manipulating a wire relative to a terminal block. The wire has an electrical contact. The method comprises clamping the wire with a predetermined force between a first gripping portion, installed in a first interior cavity of a first channel of a first tip half, and a second gripping portion, installed in a second interior cavity of a second channel of a second tip half. The method also comprises pushing the electrical contact into a receptacle of the terminal block using a first internal shoulder of the first channel and a second internal shoulder of the second channel to interlock the electrical contact and the terminal block. With the wire clamped with the predetermined force between the first gripping portion and the second gripping portion, the method additionally comprises verifying that the electrical contact and the terminal block are interlocked by pulling the first tip half and the second tip half away from the terminal block until the wire slips along the first gripping portion of the first tip half and the second gripping portion of the second tip half.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

FIG. 1A is a block diagram of an apparatus for manipulating a wire relative to a terminal block, according to one or more examples of the present disclosure;

FIG. 1B is a block diagram of a wire having an electrical contact and of a terminal block into which the electrical contact may be inserted using the apparatus of FIG. 1A, according to one or more examples of the present disclosure;

FIG. 2 is a schematic top perspective view of the apparatus of FIG. 1A, according to one or more examples of the present disclosure;

FIG. 3 is a schematic bottom perspective view of the apparatus of FIG. 1A, according to one or more examples of the present disclosure;

FIG. 4 is a schematic exploded top perspective view of the apparatus of FIG. 1A, according to one or more examples of the present disclosure;

FIG. 5 is a schematic side view of the apparatus of FIG. 1A, according to one or more examples of the present disclosure;

FIG. 6 is a schematic bottom plan view of the apparatus of FIG. 1A when a first tip half and a second tip half of the apparatus are in contact with each other, according to one or more examples of the present disclosure;

FIG. 7 is a schematic bottom plan view of the apparatus of FIG. 1A when the first tip half and the second tip half are not in contact with each other, according to one or more examples of the present disclosure;

FIG. 8 is a schematic bottom perspective view of the first tip half and the second tip half of the apparatus of FIG. 1A when the first tip half and the second tip half are in contact with each other, according to one or more examples of the present disclosure;

FIG. 8A is a schematic detail of FIG. 8, according to one or more examples of the present disclosure;

FIG. 9 is a schematic top perspective view of the first tip half and the second tip half of the apparatus of FIG. 1A when the first tip half and the second tip half are in contact with each other, according to one or more examples of the present disclosure;

Figure 1A:
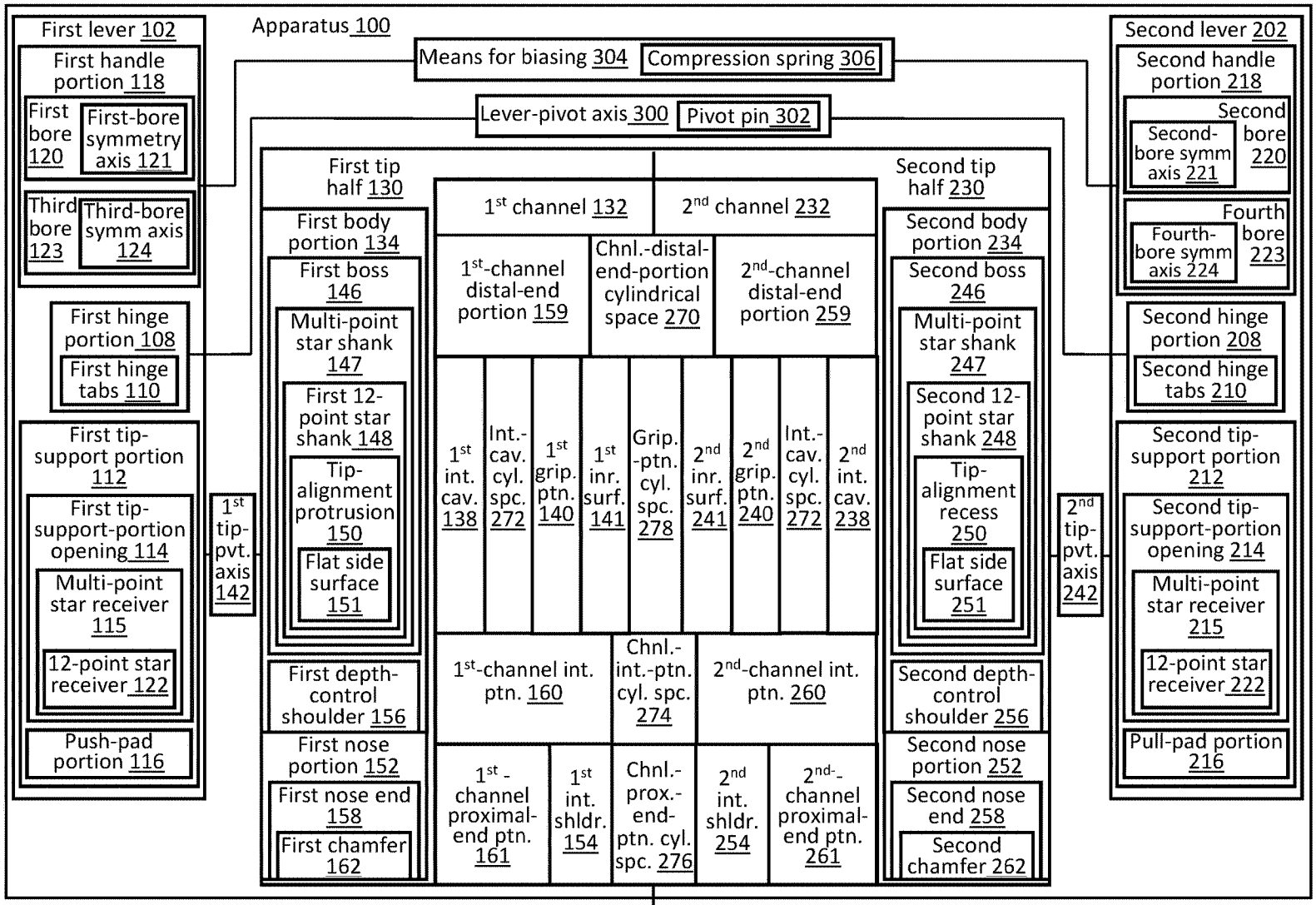
Figure 8A:
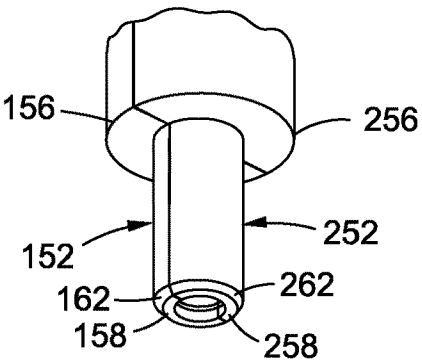
Figure 8:
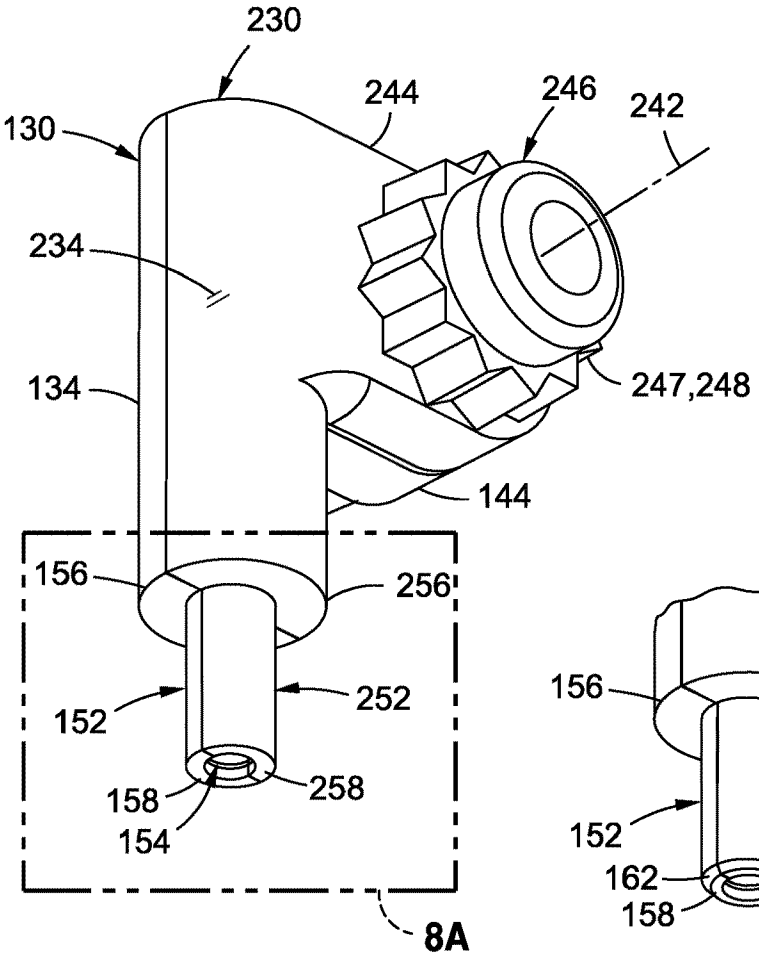
Figure 11:
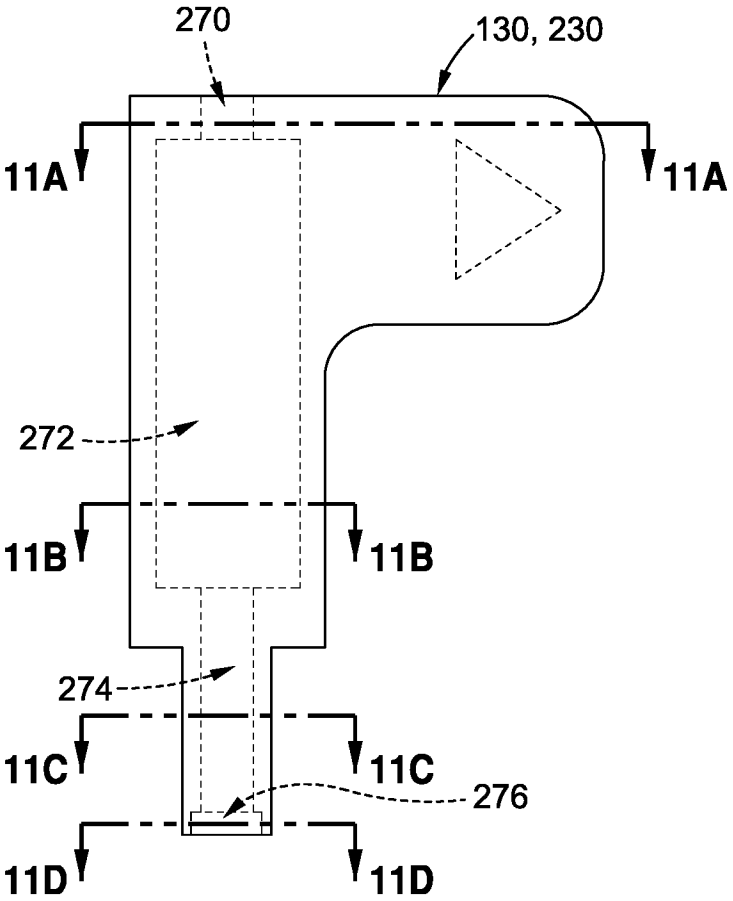
Figure 10:
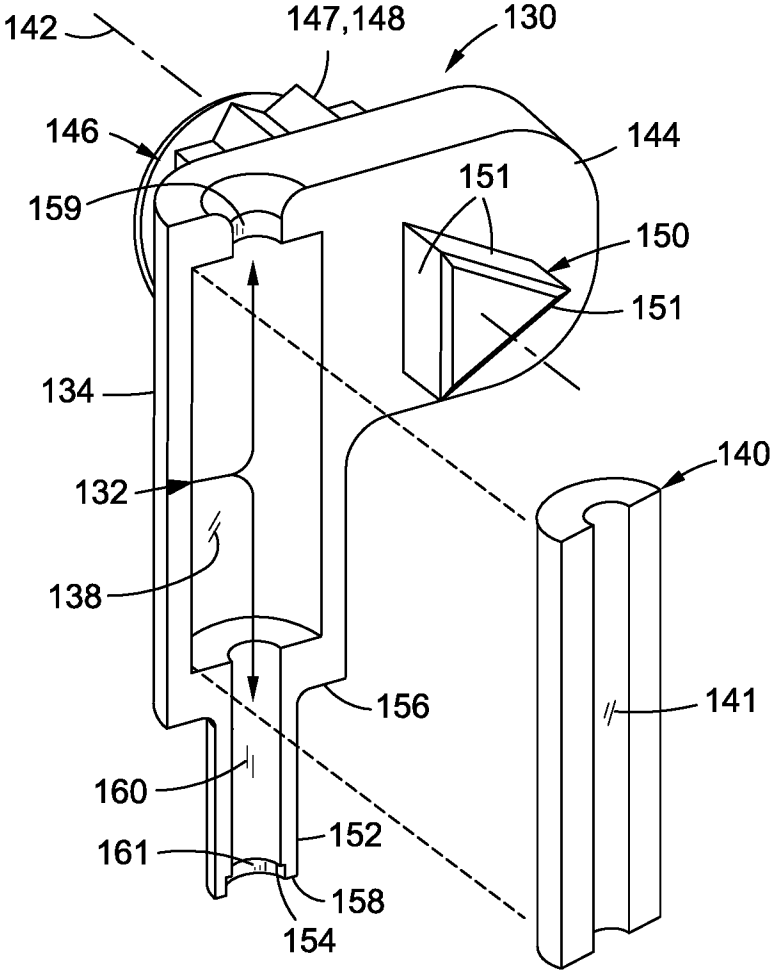
Figure 11A:
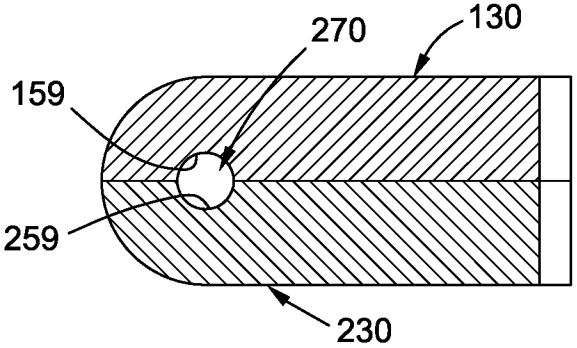
Figure 11B:
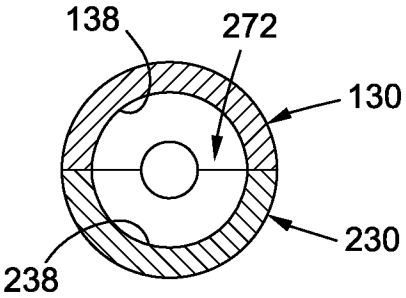
Figure 11C:
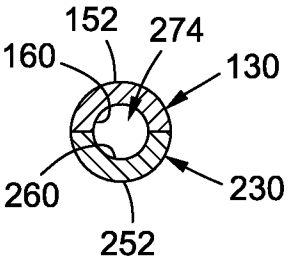
Figure 11D:
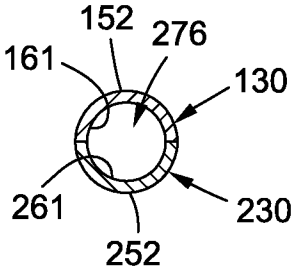
Figure 12:
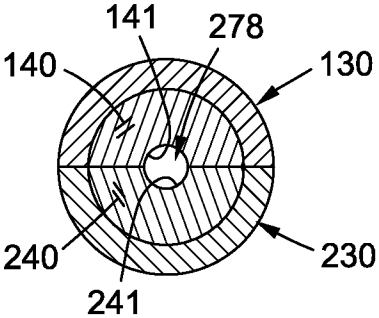
Figure 13:
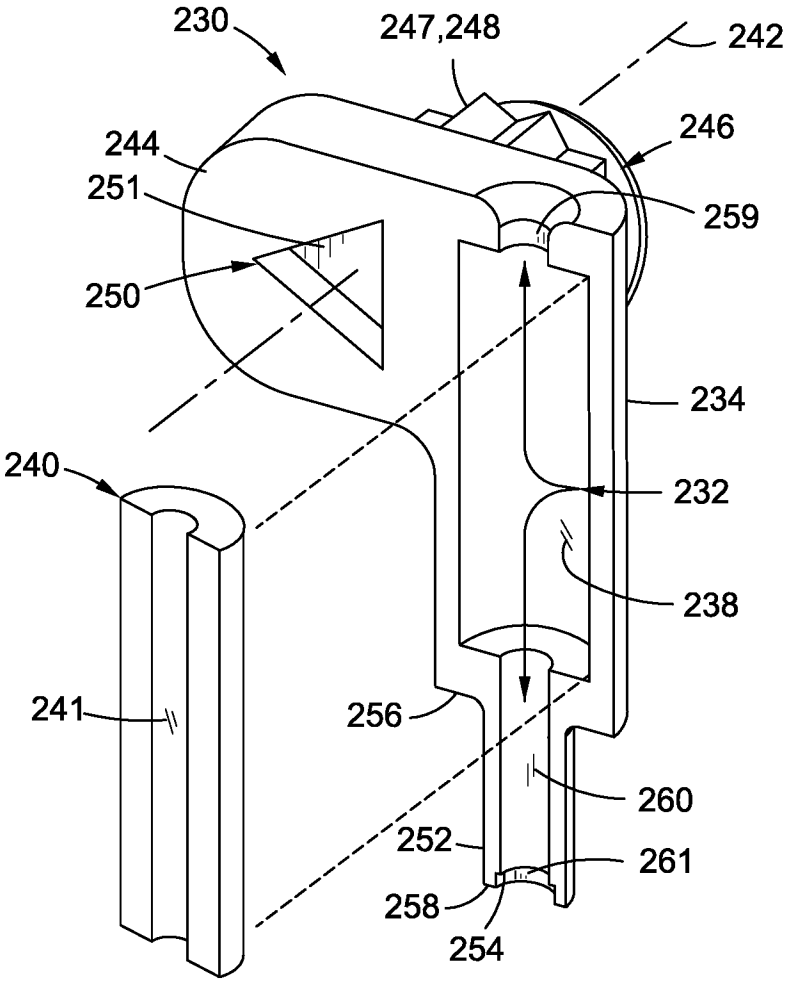
Figure 14A:
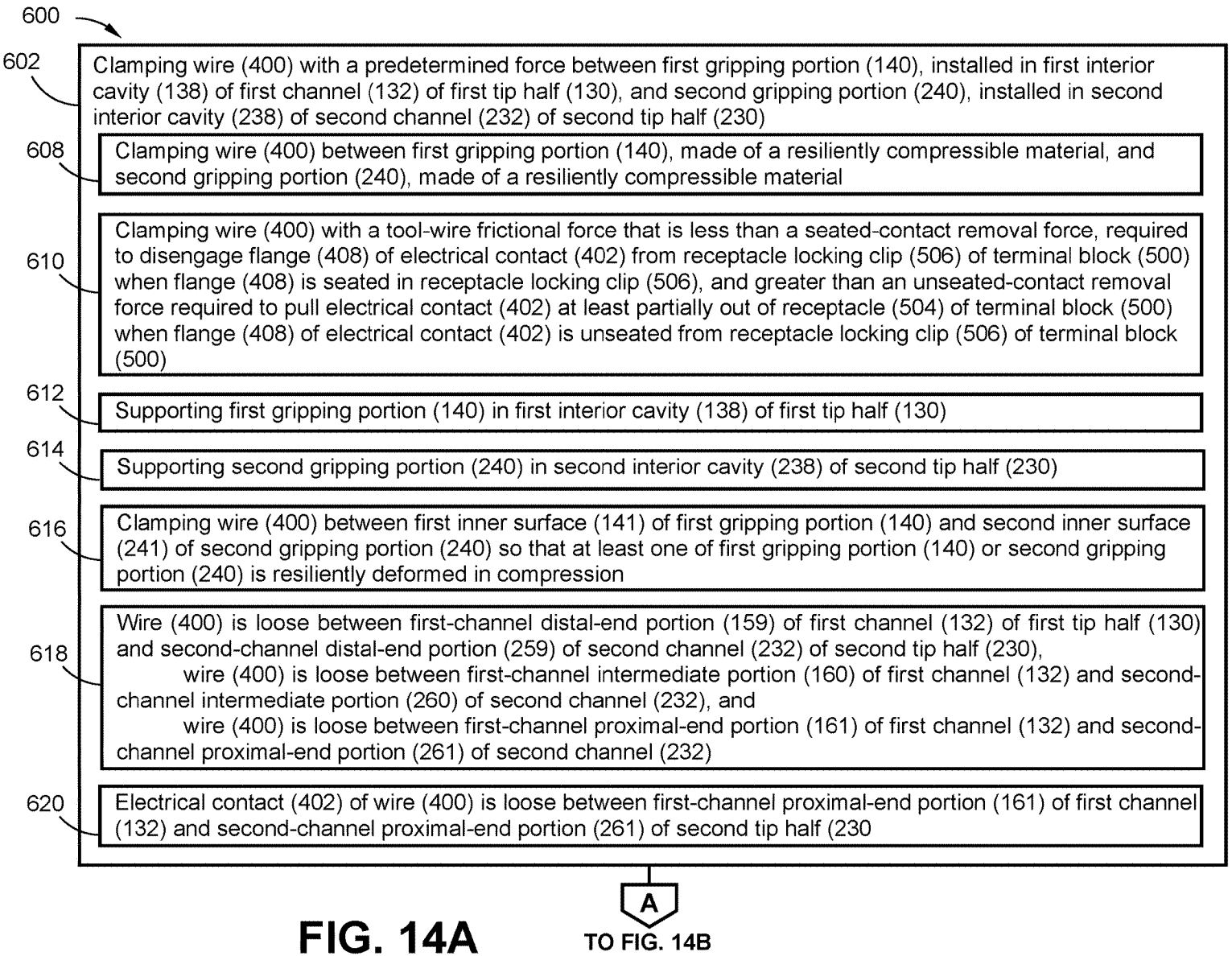
Figure 14B:
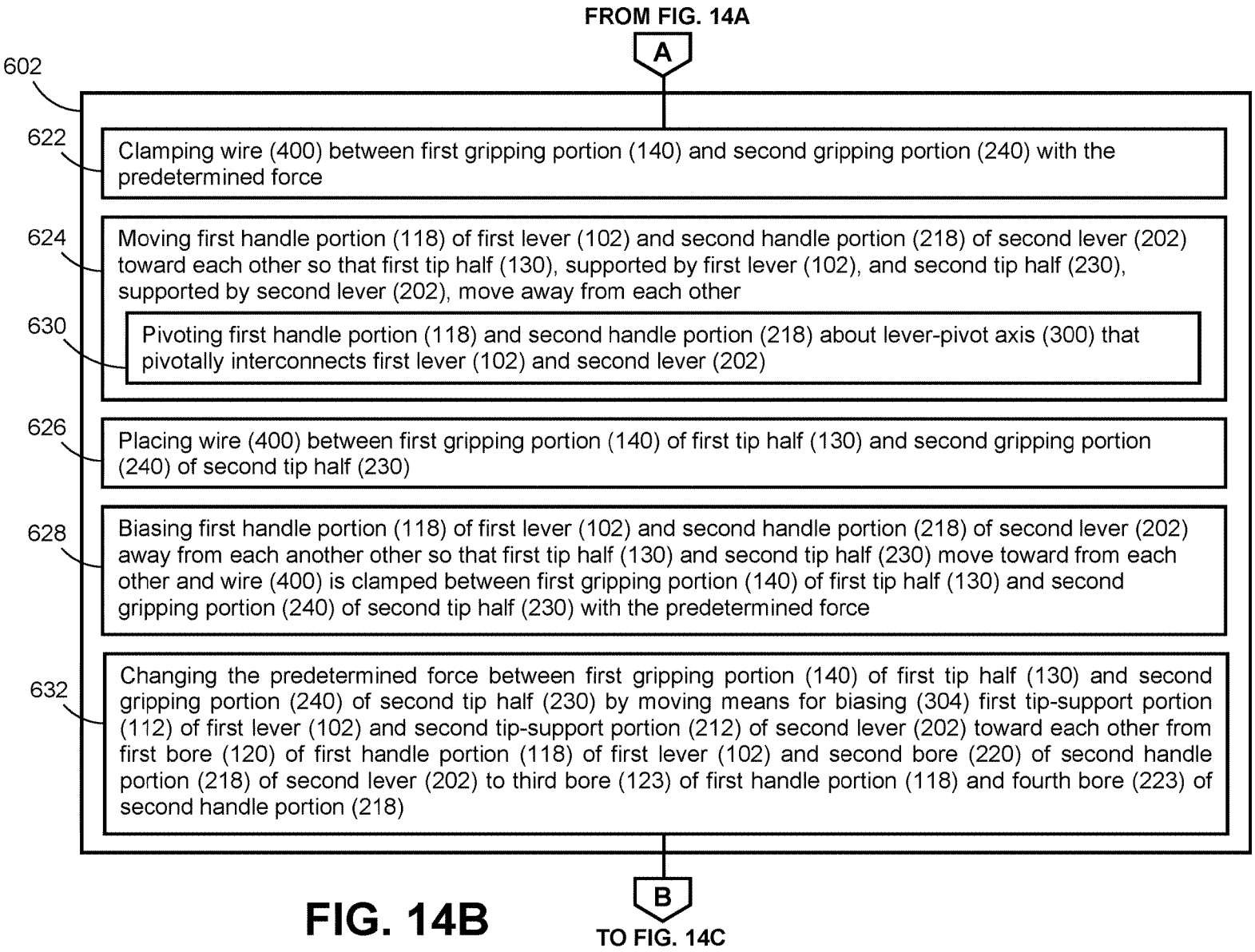
Figure 14C:
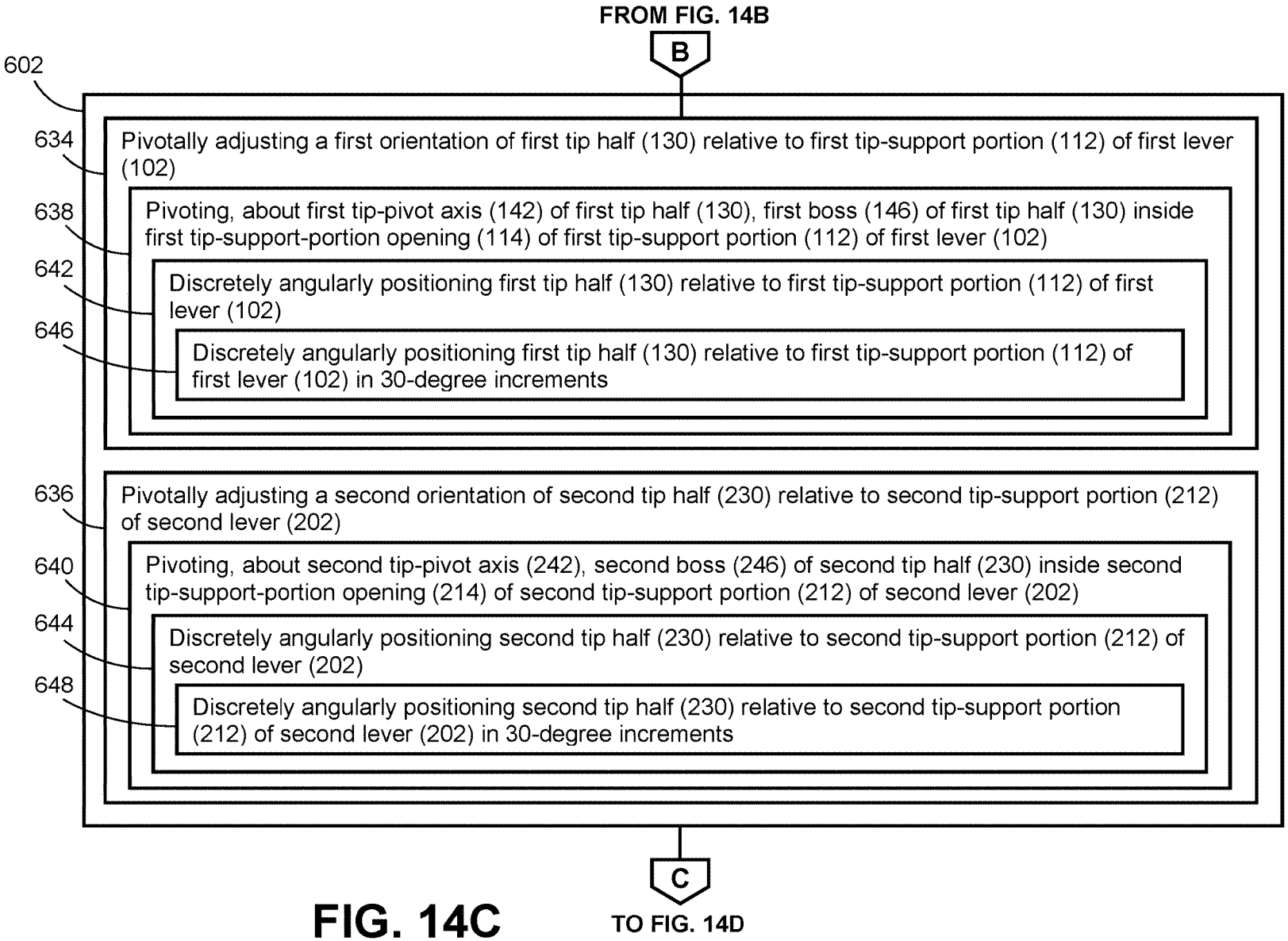
Figure 14D:
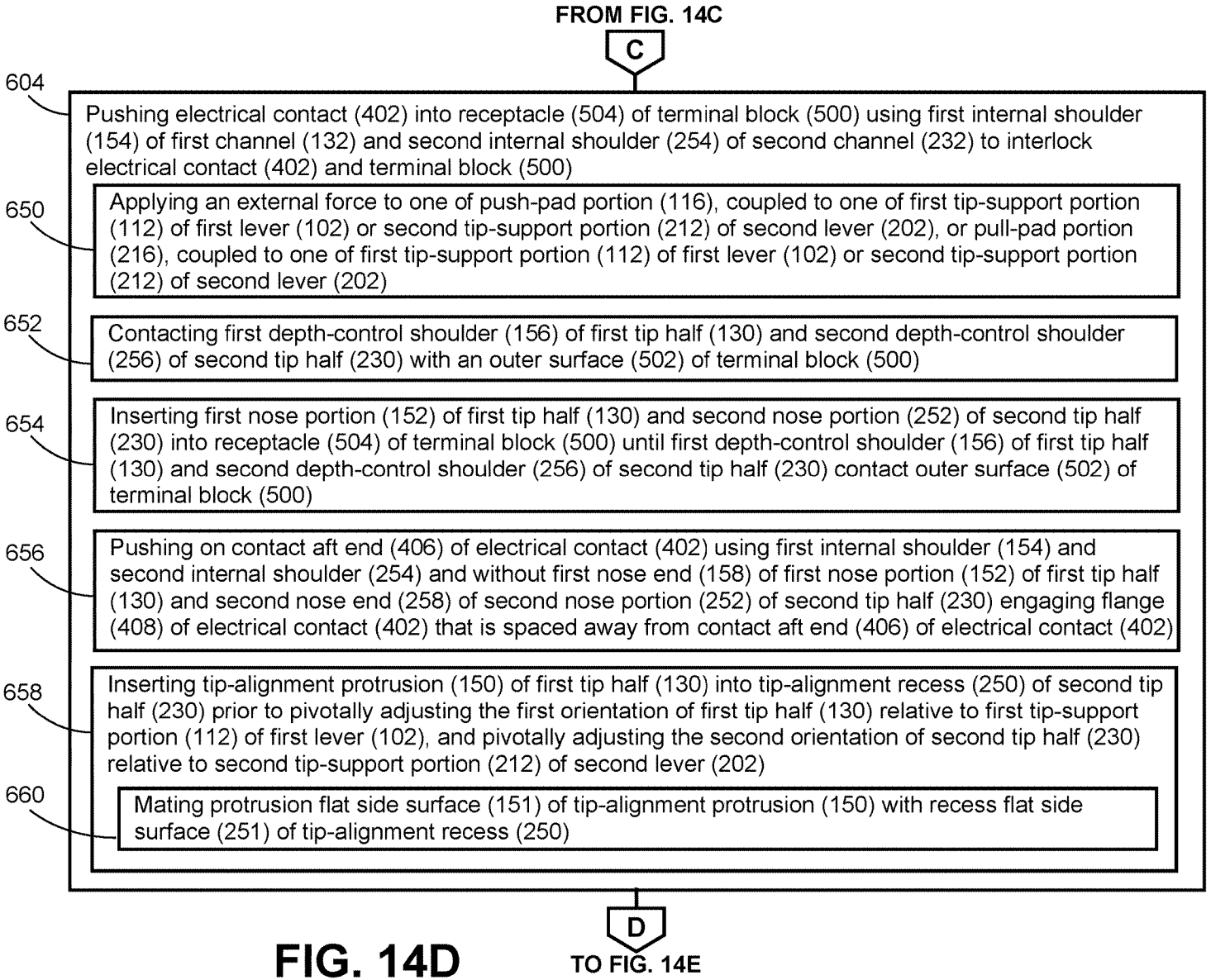
Figure 14E:
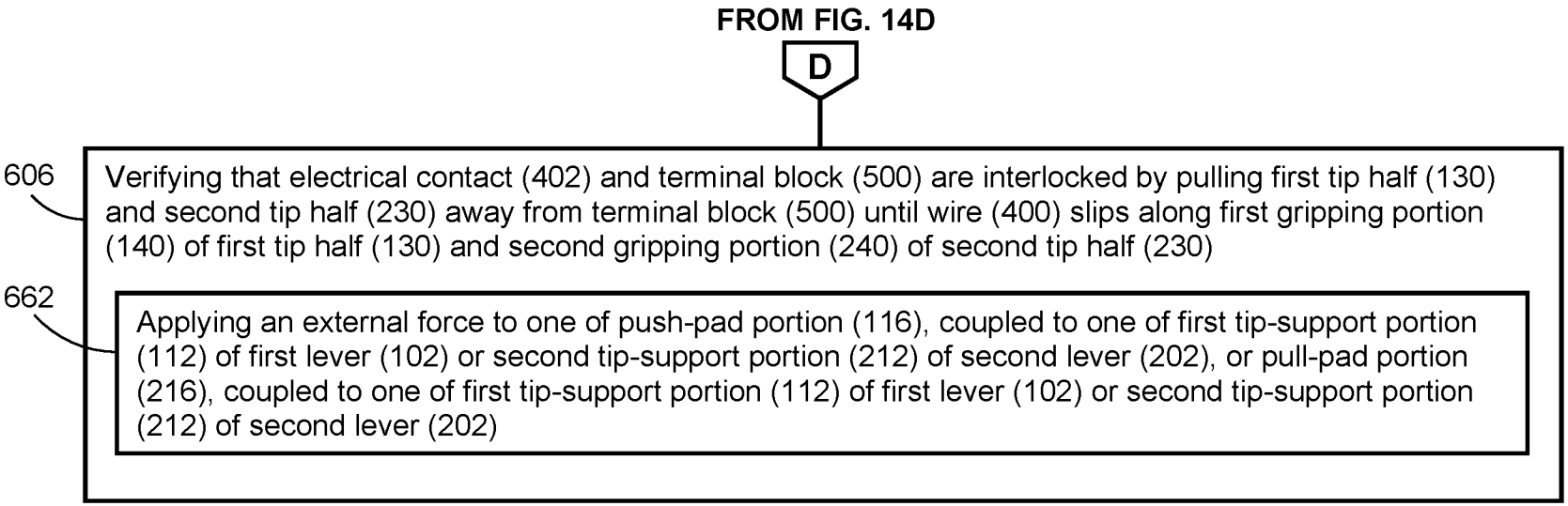
Figure 15:
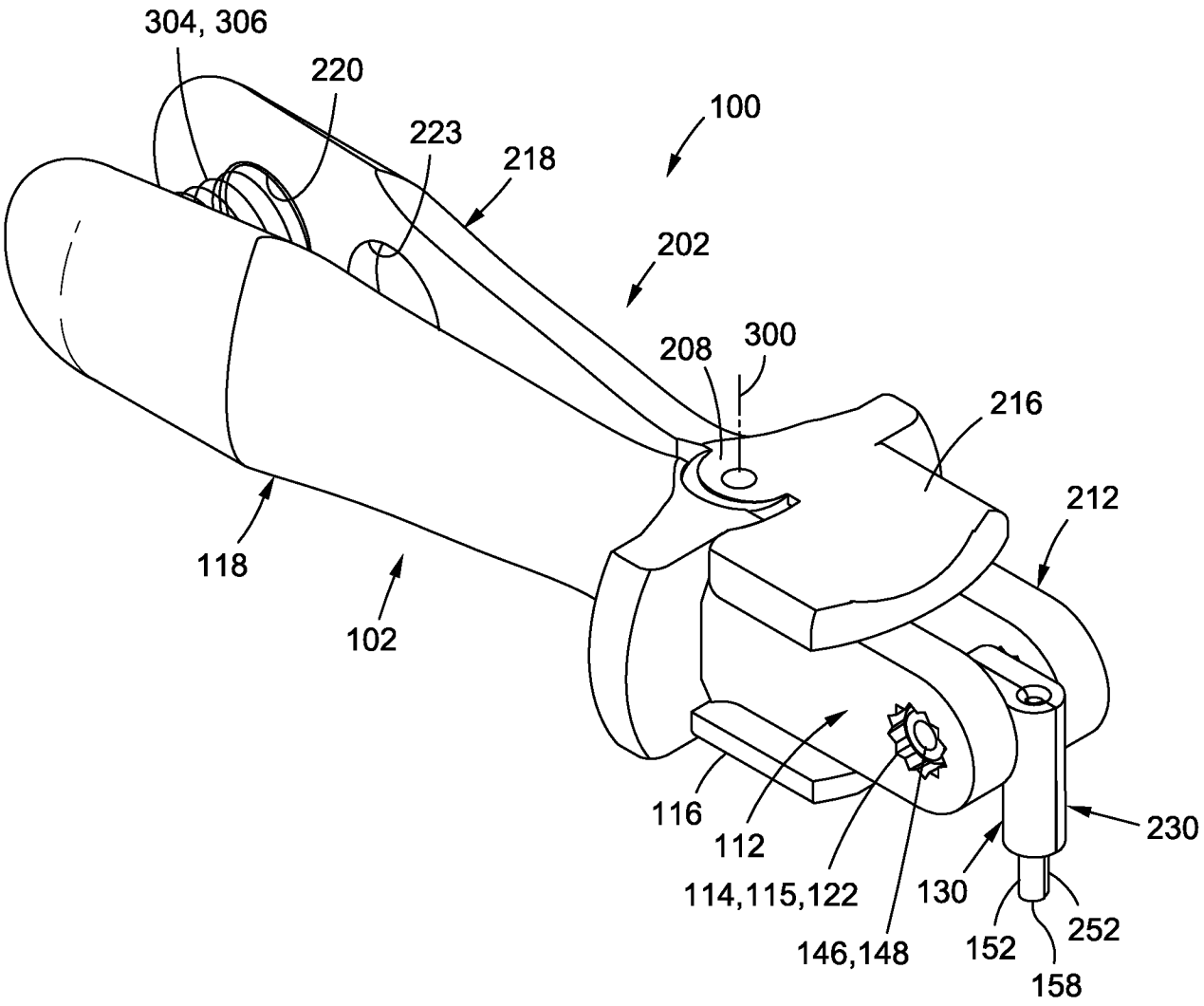
Figure 16:
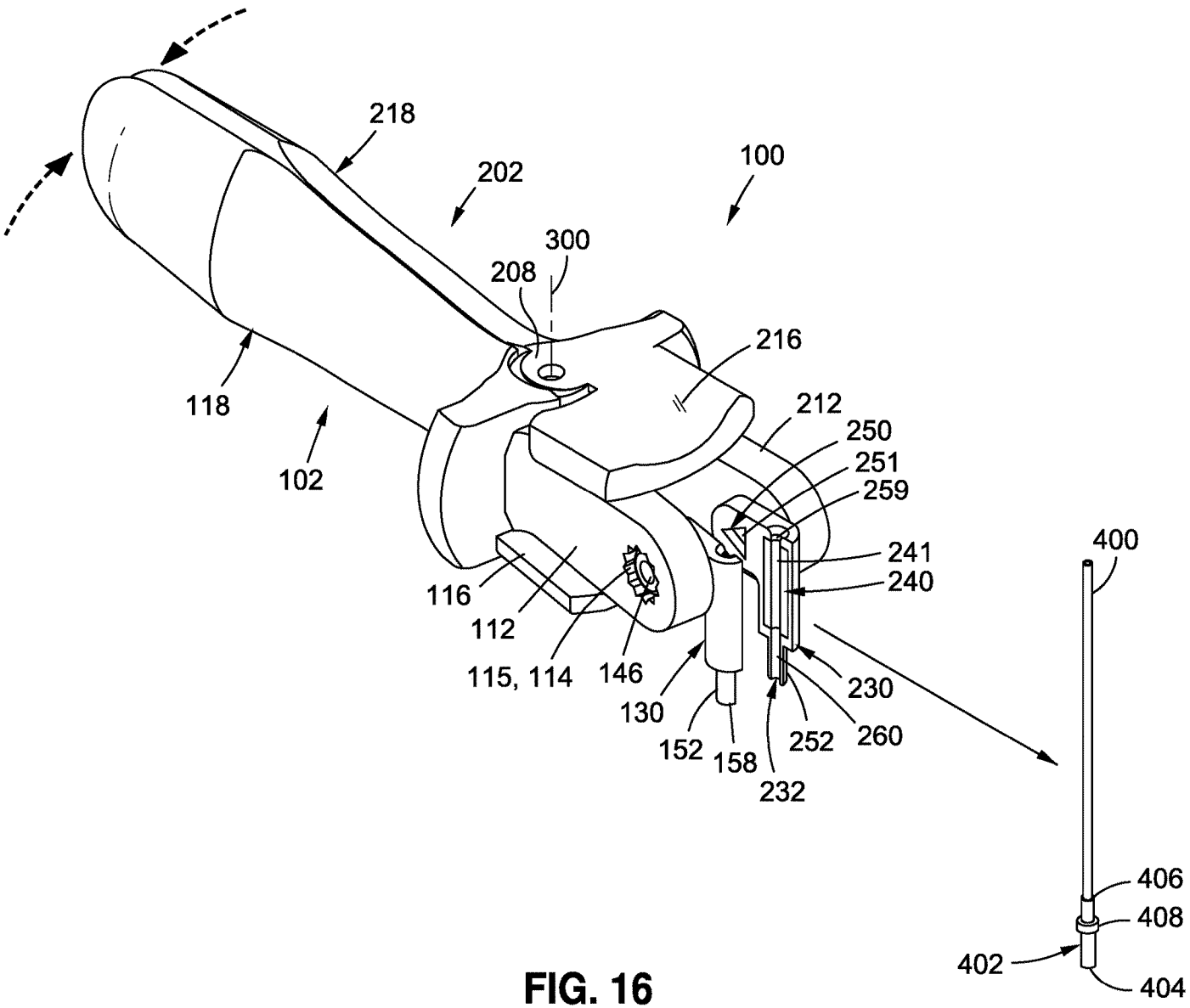
Figure 17:
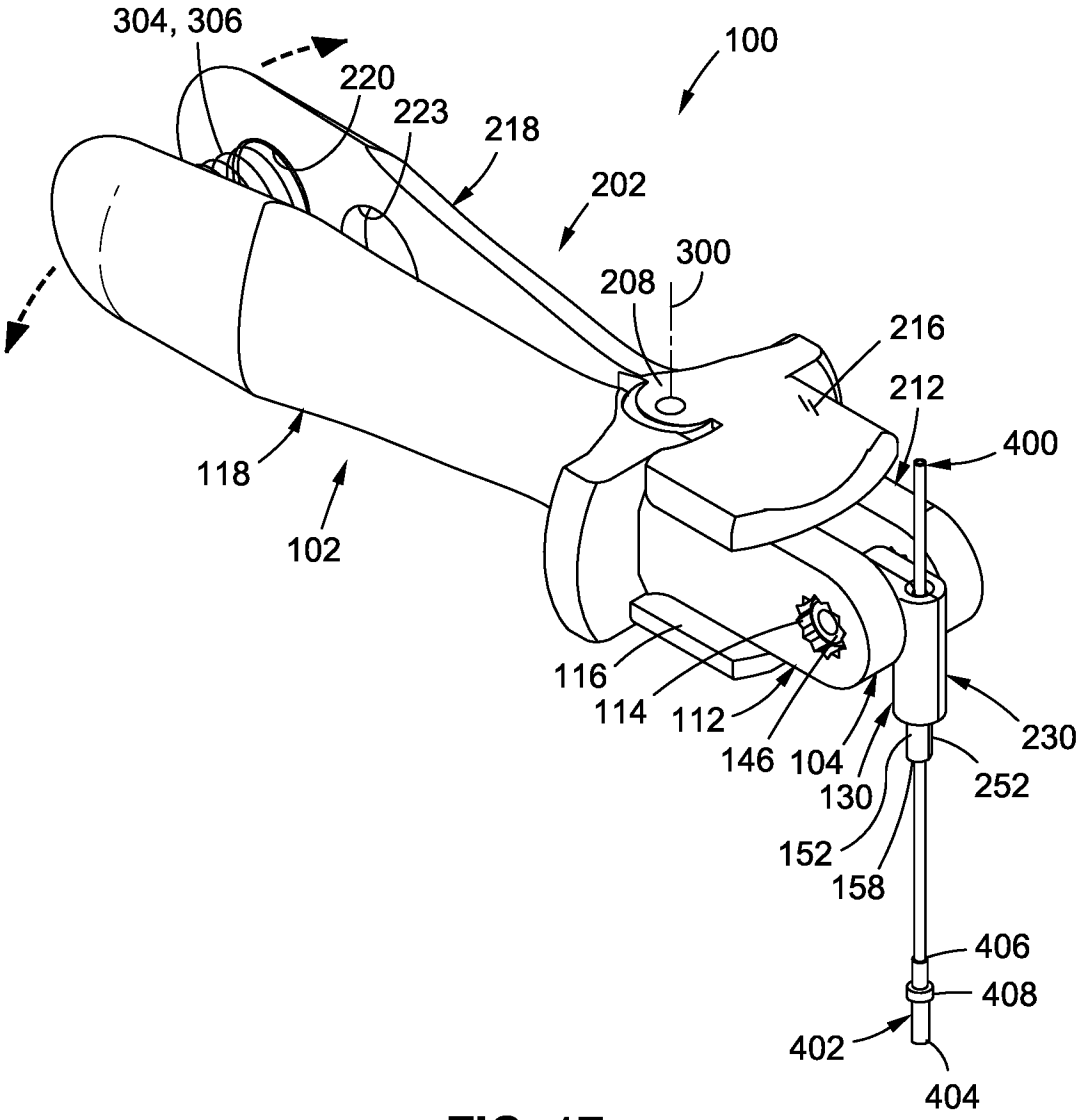
Figure 18:
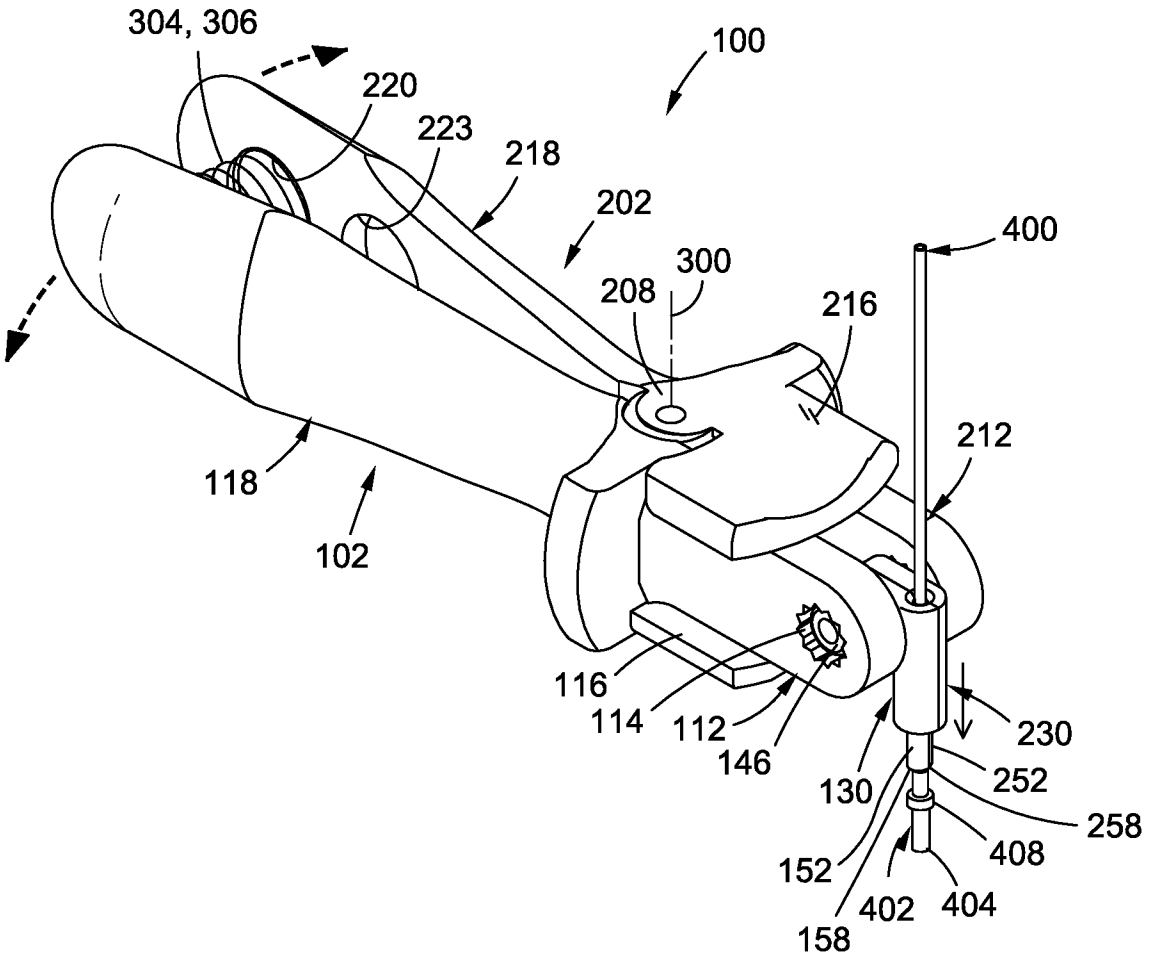
Figure 19:
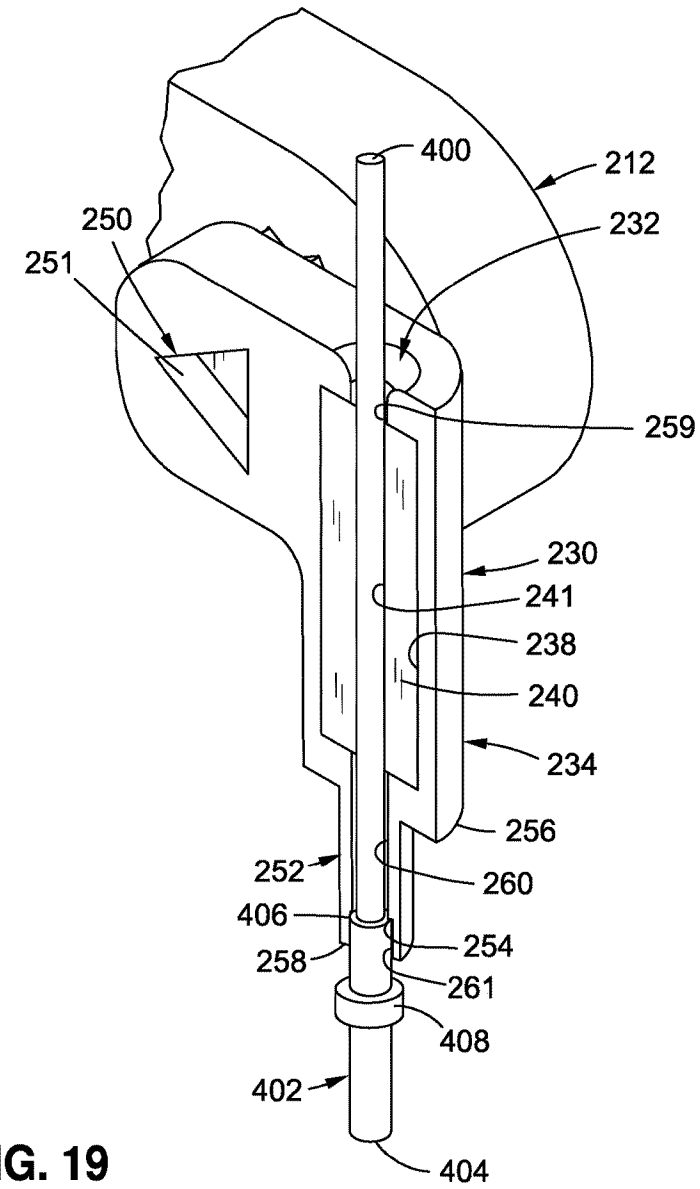
Figure 20:
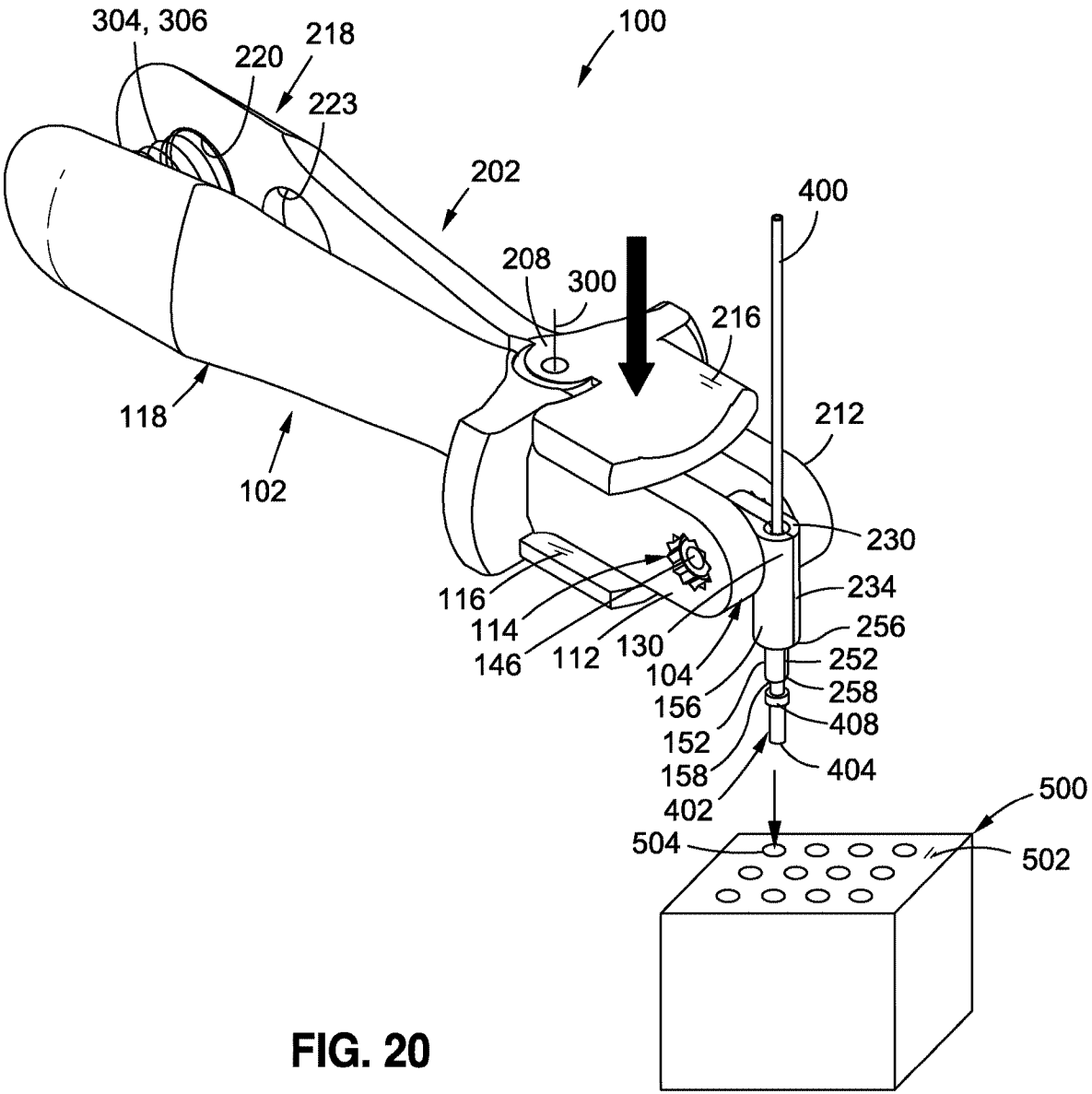
Figure 21:
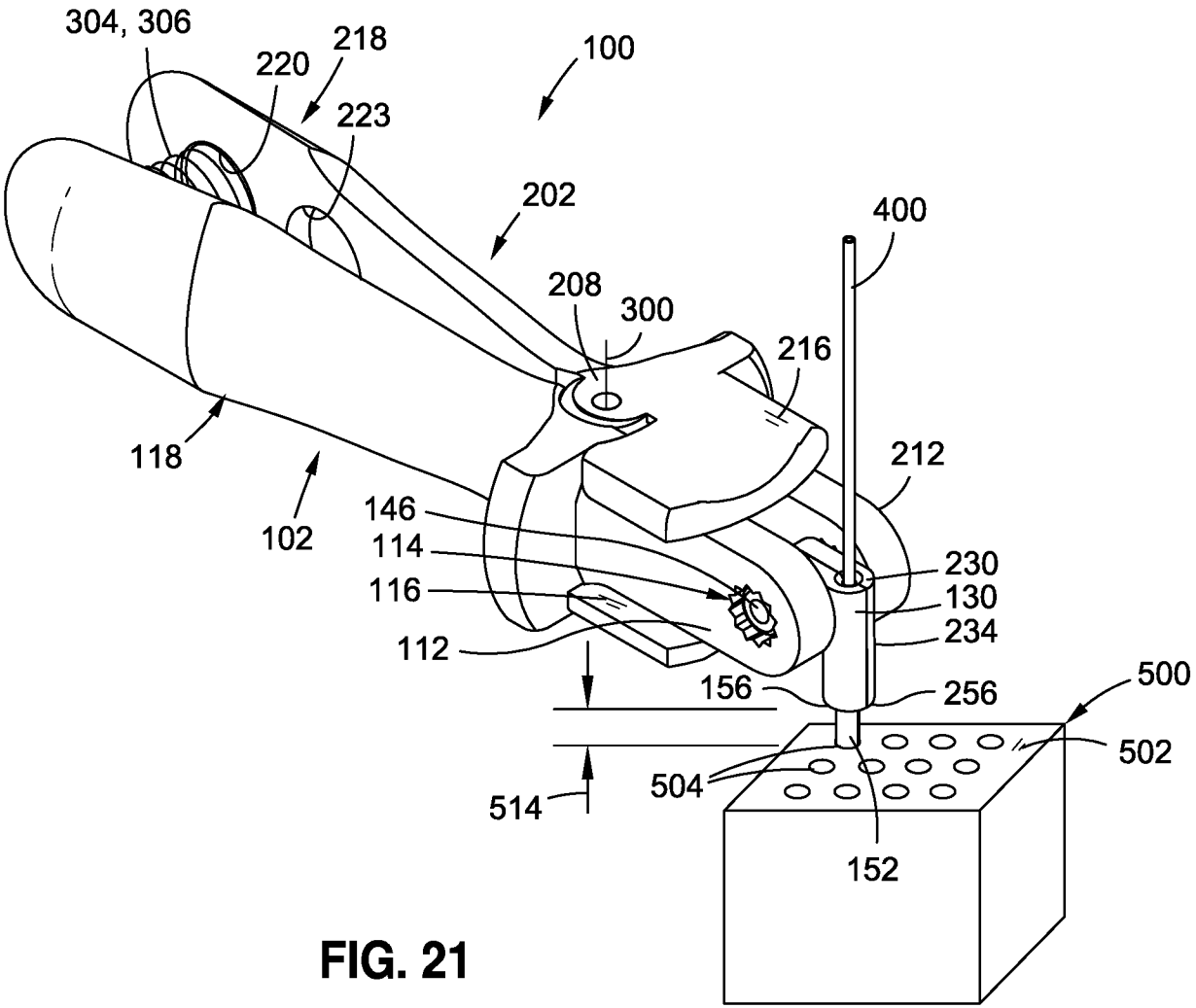
Figure 22:
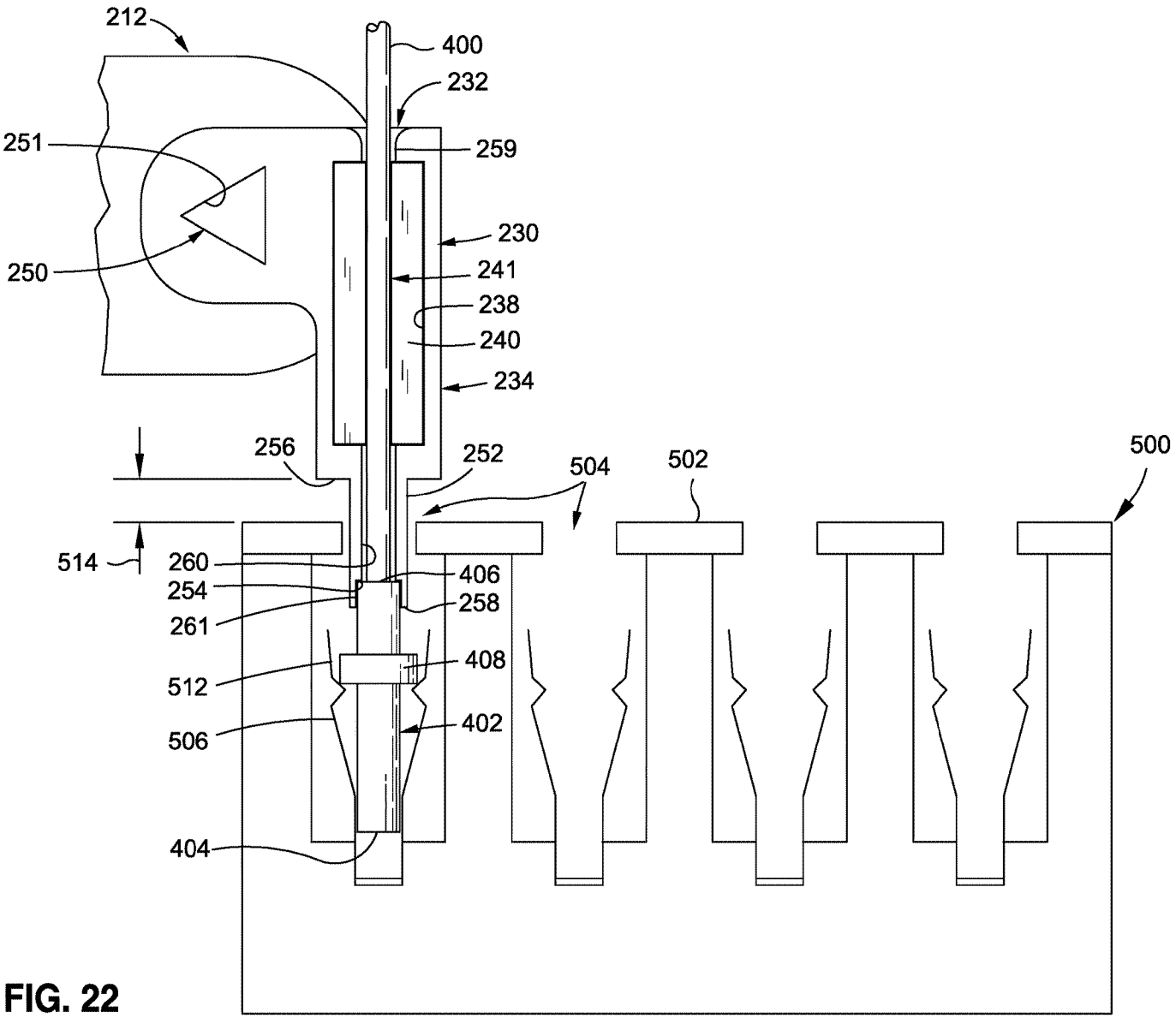
Figure 23:
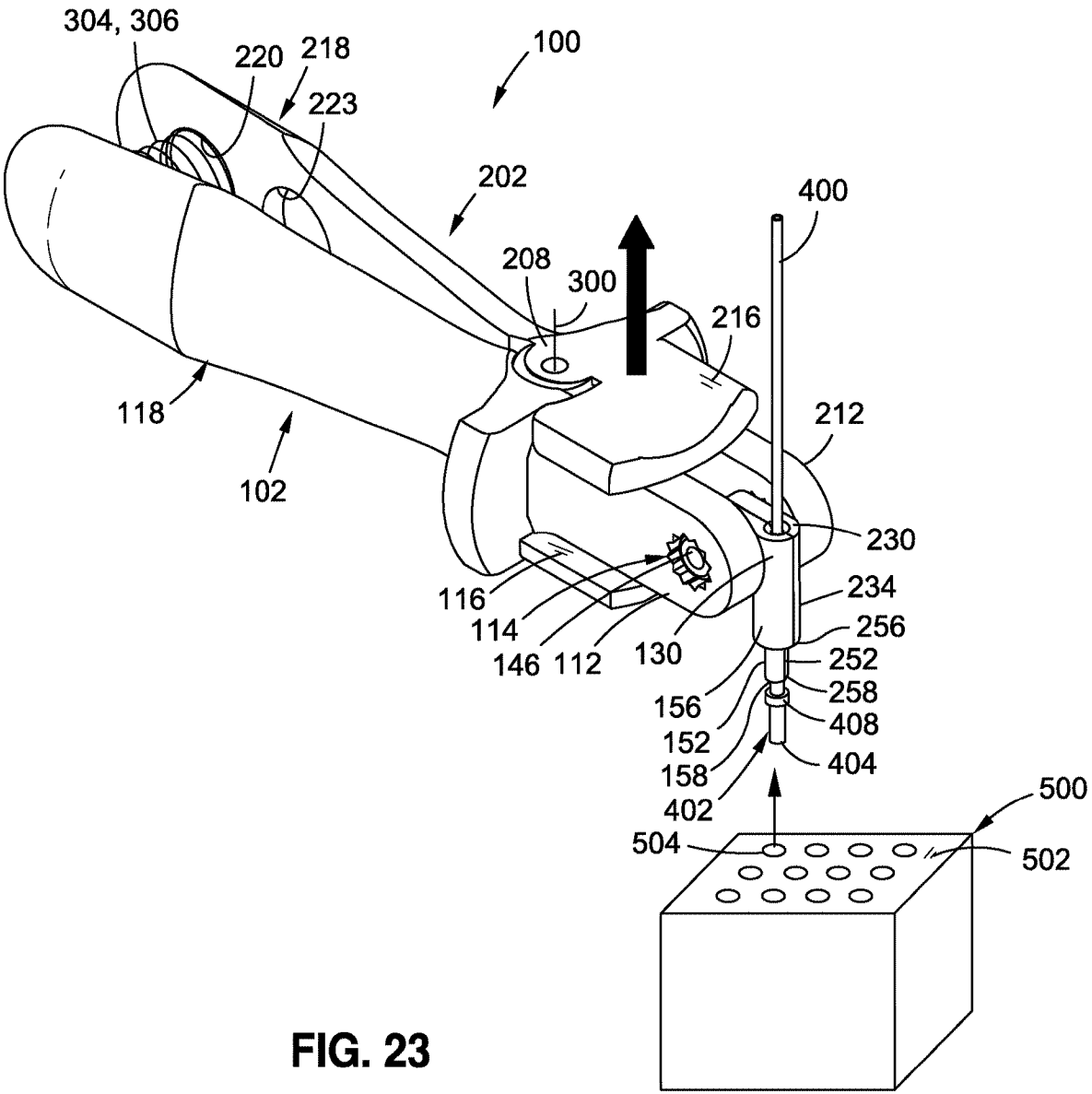
Figure 24:
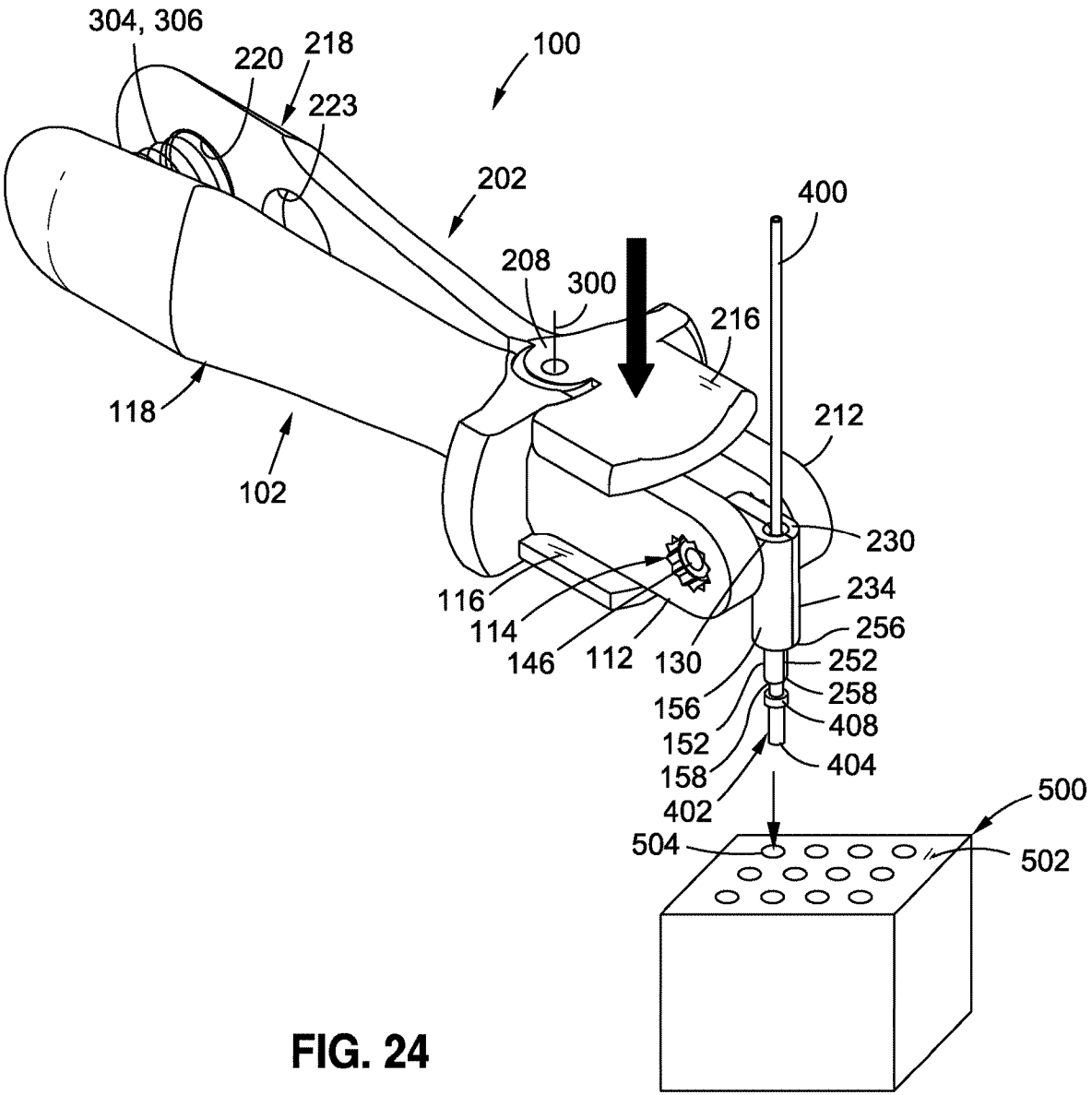
Figure 25:
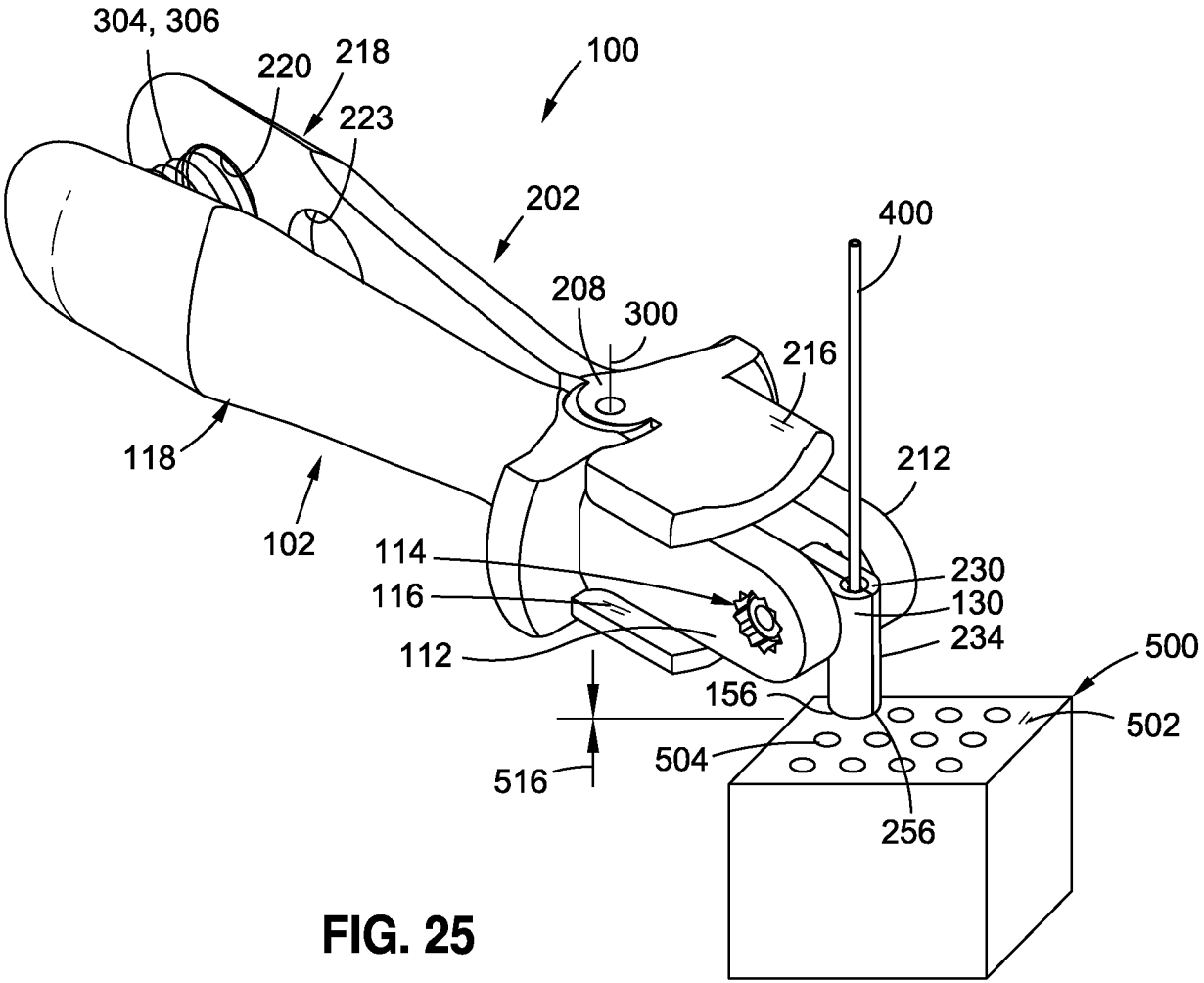
Figure 26:
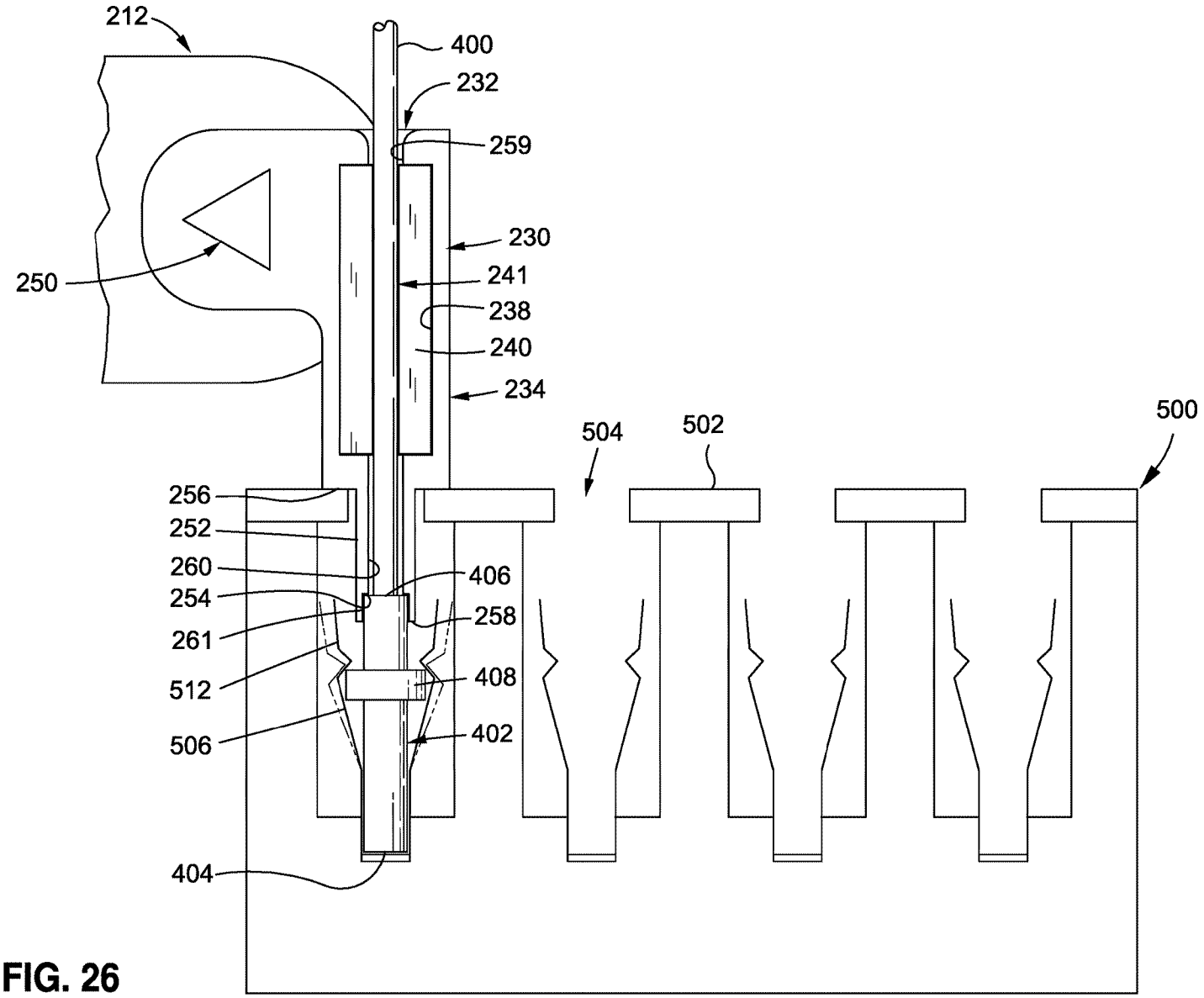
Figure 27:
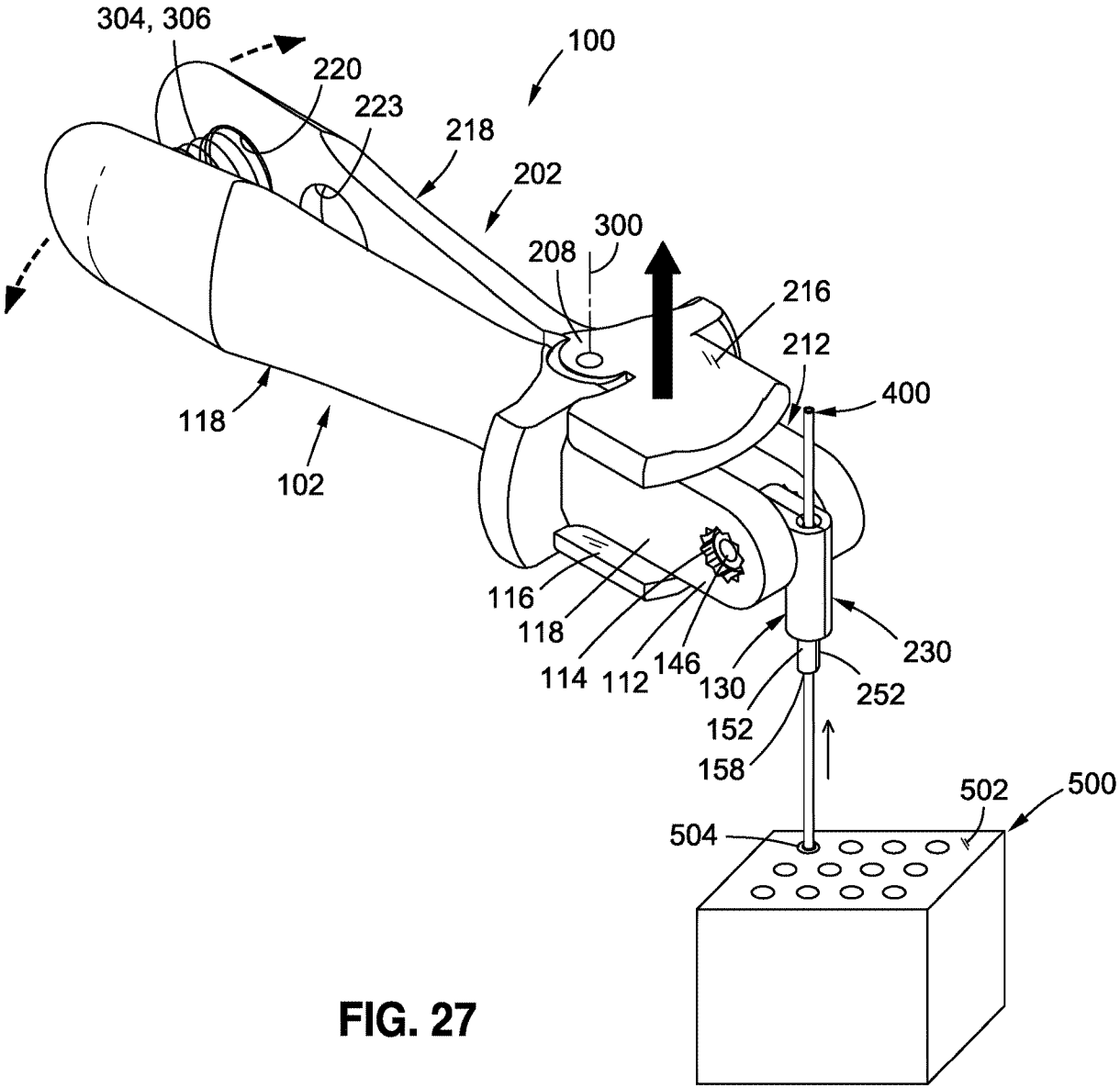
Figure 28:
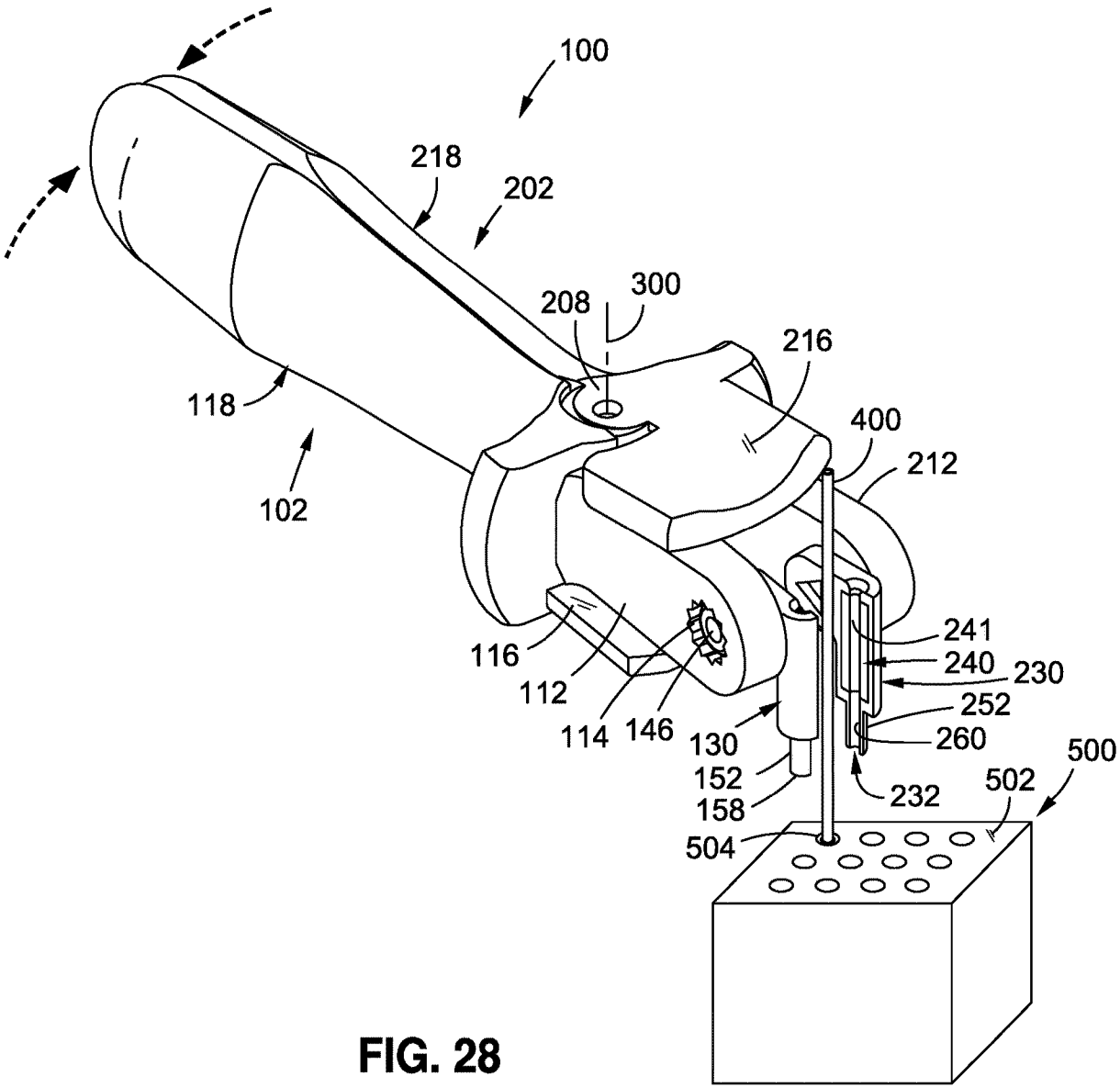
Figure 29:
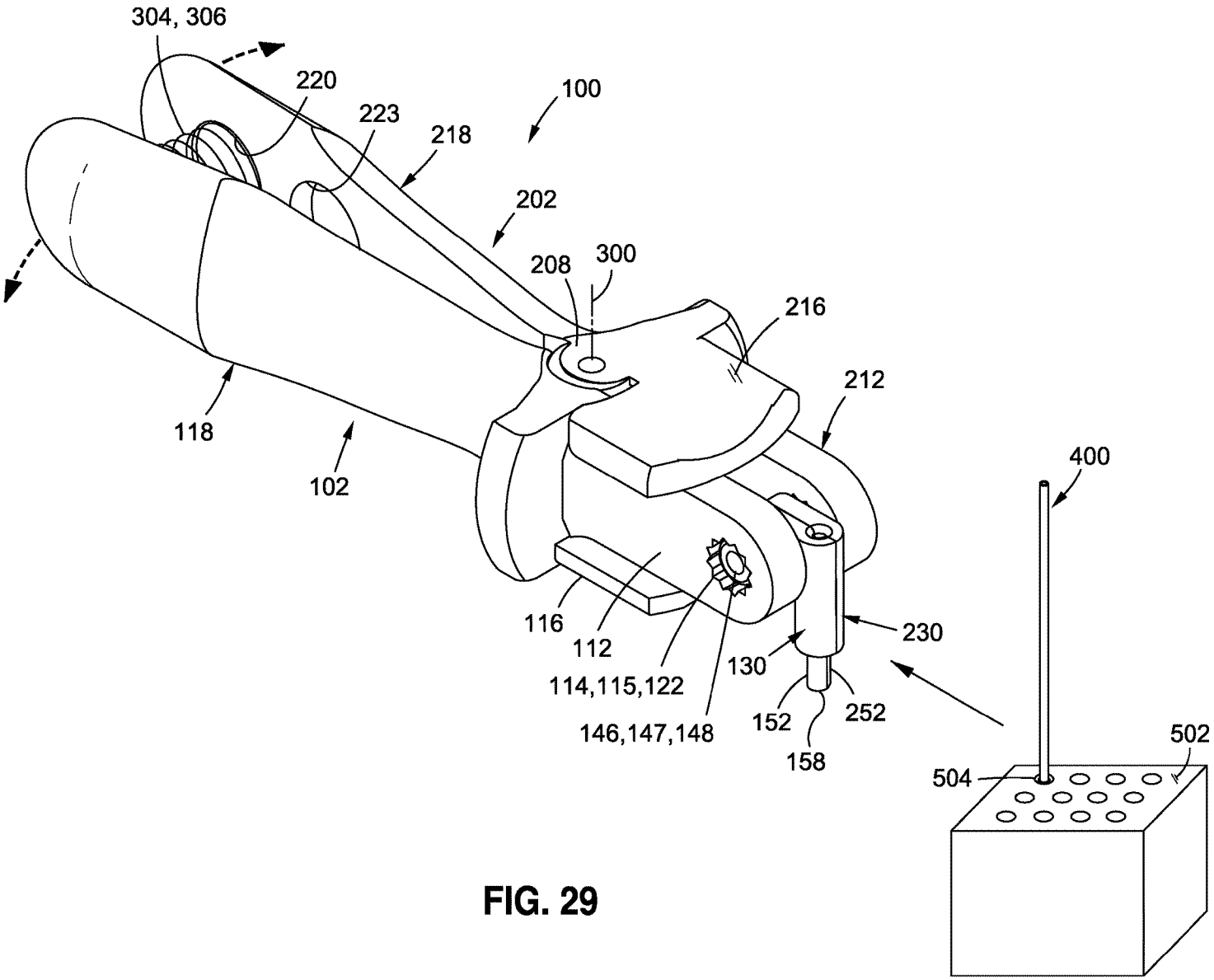

FIG. 10 is a schematic exploded top perspective view of the first tip half of FIG. 8, according to one or more examples of the present disclosure;

FIG. 11 is a schematic side view of the first tip half and the second tip half of FIG. 8, according to one or more examples of the present disclosure;

FIG. 11A is a schematic sectional view of the first tip half in contact with the second tip half of FIG. 8, showing a channel-distal-end-portion cylindrical space, according to one or more examples of the present disclosure;

FIG. 11B is a schematic sectional view of the first tip half in contact with the second tip half of FIG. 8, showing an interior-cavity cylindrical space, according to one or more examples of the present disclosure;

FIG. 11C is a schematic sectional view of the first tip half in contact with the second tip half of FIG. 8, showing a channel-intermediate-portion cylindrical space, according to one or more examples of the present disclosure;

FIG. 11D is a schematic sectional view of the first tip half in contact with the second tip half of FIG. 8, showing a channel-proximal-end-portion cylindrical space, according to one or more examples of the present disclosure;

FIG. 12 is a schematic sectional view of the first tip half in contact with the second tip half of FIG. 8, showing a gripping-portion cylindrical space formed between the first gripping portion and a second gripping portion, according to one or more examples of the present disclosure;

FIG. 13 is a schematic exploded top perspective view of the second tip half of FIG. 8, according to one or more examples of the present disclosure;

FIGS. 14A-14E are collectively a block diagram of a method of manipulating a wire relative to a terminal block using the apparatus of FIG. 1A, according to one or more examples of the present disclosure;

FIG. 15 is a schematic top perspective view of the apparatus of FIG. 1A when the first tip half and the second tip half are in contact with each other, according to one or more examples of the present disclosure;

FIG. 16 is a schematic top perspective view of the apparatus of FIG. 1A when the first tip half and the second tip half are not in contact with each other prior to clamping a wire between the first tip half and the second tip half, according to one or more examples of the present disclosure;

FIG. 17 is a schematic top perspective view of the apparatus of FIG. 1A, showing the wire clamped between the first tip half and the second tip half, according to one or more examples of the present disclosure;

FIG. 18 is a schematic top perspective view of the apparatus of FIG. 1A, showing the first tip half and the second tip half after being slid along the wire toward the electrical contact, according to one or more examples of the present disclosure;

FIG. 19 is a schematic top perspective view of the second tip half of the apparatus of FIG. 1A, showing the wire extending through the second tip half, according to one or more examples of the present disclosure;

FIG. 20 is a schematic top perspective view of the apparatus of FIG. 1A, showing the wire clamped between the first tip half and the second tip half prior to insertion of the electrical contact into a terminal block, according to one or more examples of the present disclosure;

FIG. 21 is a schematic top perspective view of the apparatus of FIG. 1A, showing a first nose end of the first tip half and a second nose end of the second tip half inserted into the terminal block, according to one or more examples of the present disclosure;

FIG. 22 is a schematic side sectional view of the first nose end of the first tip half and the second nose end of the second tip half of the apparatus of FIG. 1A, inserted into the terminal block, and illustrating a flange of the electrical contact positioned above and non-engaged with a receptacle locking clip of the terminal block, according to one or more examples of the present disclosure;

FIG. 23 is a schematic top perspective view of the apparatus of FIG. 1A pulling the electrical contact out of the terminal block due to non-engagement of the flange of the electrical contact with the receptacle locking clip of the terminal block, according to one or more examples of the present disclosure;

FIG. 24 is a schematic top perspective view of the apparatus of FIG. 1A showing re-insertion of the electrical contact into the terminal block, according to one or more examples of the present disclosure;

FIG. 25 is a schematic top perspective view of the apparatus of FIG. 1A showing the first nose end of the first tip half and the second nose end of the second tip half re-inserting the electrical contact into the terminal block, according to one or more examples of the present disclosure;

FIG. 26 is a schematic side sectional view of the electrical contact interlocked with the receptacle locking clip of the terminal block, according to one or more examples of the present disclosure;

FIG. 27 is a schematic top perspective view of the apparatus of FIG. 1A verifying that the electrical contact and the terminal block are interlocked by pulling the first tip half and the second tip half away from the terminal block, according to one or more examples of the present disclosure;

FIG. 28 is a schematic top perspective view of the apparatus of FIG. 1A showing the first tip half and the second tip half moved away from each other to unclamp the wire from between the first tip half and the second tip half, according to one or more examples of the present disclosure;

FIG. 29 is a schematic top perspective view of the apparatus of FIG. 1A showing the first tip half and the second tip half in contact with each other after the release of the wire from between the first tip half and the second tip half, according to one or more examples of the present disclosure.

DETAILED DESCRIPTION

Figure 1B:
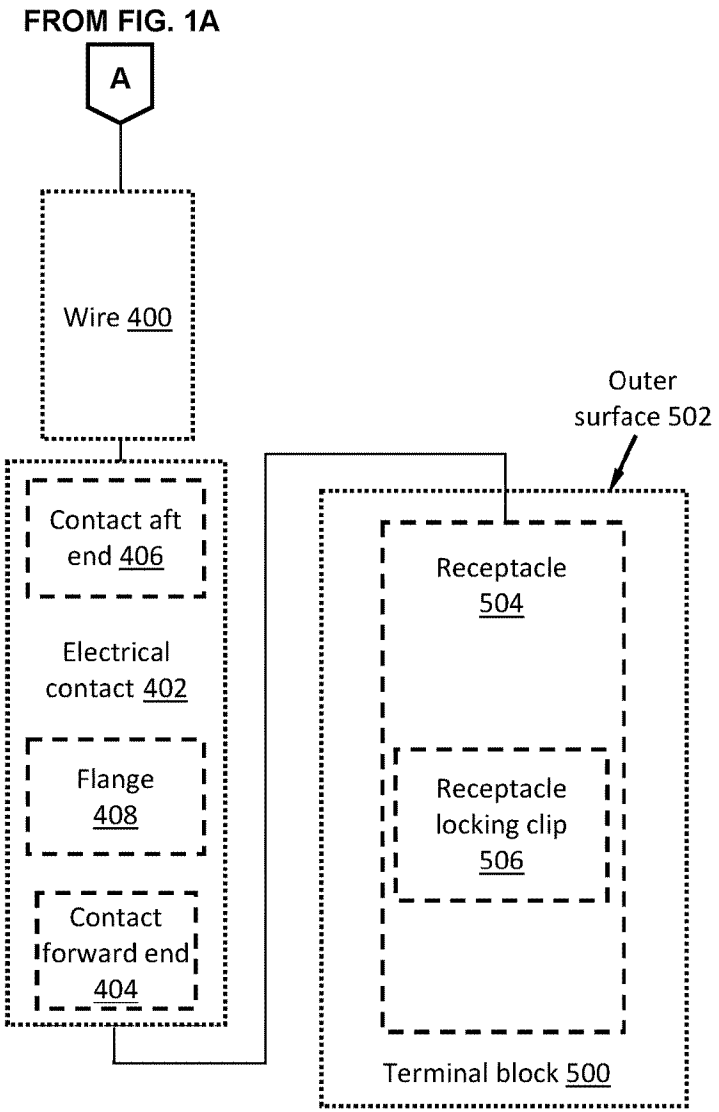

In FIGS. 1A-1B, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual imaginary elements may also be shown for clarity. Those skilled in the art will appreciate that some of the features illustrated in FIG. 1A may be combined in various ways without the need to include other features described in FIG. 1A, other drawing figures, and/or the accompanying disclosure, even though such combination or combinations are not explicitly illustrated herein. Similarly, additional features not limited to the examples presented, may be combined with some or all of the features shown and described herein.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIGS. 1A-1B and particularly to, e.g., FIGS. 2-7, apparatus 100 for manipulating wire 400 relative to terminal block 500 is disclosed. Wire 400 has an electrical contact 402. Apparatus 100 comprises first lever 102 and second lever 202. First lever 102 comprises first tip-support portion 112, first handle portion 118, and first hinge portion 108 between first tip-support portion 112 and first handle portion 118. Second lever 202 comprises second tip-support portion 212, second handle portion 218, and second hinge portion 208 between second tip-support portion 212 and second handle portion 218. First hinge portion 108 of first lever 102 and second hinge portion 208 of second lever 202 are pivotally interconnected about lever-pivot axis 300. Apparatus 100 also comprises means for biasing 304 first tip-support portion 112 of first lever 102 and second tip-support portion 212 of second lever 202 toward each other. Apparatus 100 additionally comprises first tip half 130 and second tip half 230. First tip half 130 is pivotally coupled to first tip-support portion 112 of first lever 102 about first tip-pivot axis 142. First tip half 130 comprises first channel 132. Second tip half 230 is pivotally coupled to second tip-support portion 212 of second lever 202 about second tip-pivot axis 242. Second tip half 230 comprises second channel 232. The preceding subject matter of this paragraph characterizes example 1 of the present disclosure.

Apparatus 100 allows for the installation and locked-seating verification of electrical contact 402 into terminal block 500 in a single operation. First handle portion 118 and second handle portion 218 provide a comfortable means for one to grasp apparatus 100. In addition, first handle portion 118 and second handle portion 218 provide a means for one to pivot first lever 102 and second lever 202 toward each other to cause first tip half 130 and second tip half 230 to move apart from each other so that wire 400 can be positioned between first tip half 130 and second tip half 230 (e.g., FIG. 16). First hinge portion 108 and second hinge portion 208 provide a means for pivotally interconnecting first lever 102 and second lever 202. First tip-support portion 112 and second tip-support portion 212 provide a means for respectively supporting first tip half 130 and second tip half 230. Means for biasing 304 provides a predetermined force for clamping wire 400 between first tip half 130 and second tip half 230 (e.g., FIGS. 17-19) when inserting electrical contact 402 into terminal block 500 (e.g., FIGS. 20 and 25), and for verifying that electrical contact 402 and terminal block 500 are interlocked (e.g., FIGS. 26-27), as described below. The predetermined force provided by means for biasing 304 is consistently applied when installing a series of wires 400 into a corresponding plurality of receptacles 504. First channel 132 and second channel 232 collectively form a cylindrical space sized complementary to wire 400 (e.g., FIG. 19) for securely gripping wire 400 when clamped between first tip half 130 and second tip half 230. Pivotally coupling first tip half 130 to first tip-support portion 112 and pivotally coupling second tip half 230 to second tip-support portion 212 enables first tip half 130 and second tip half 230 to be pivoted into a desired orientation relative to first lever 102 and second lever 202 to enable the installation of electrical contact 402 into terminal block 500 that may be located in a confined area or in an area with limited accessibility.

For example, when wire 400 is clamped between first tip half 130 and second tip half 230 (e.g., FIGS. 17-18), apparatus 100 allows one to push electrical contact 402 into receptacle 504 of terminal block 500 (e.g., FIGS. 20 and 25). With wire 400 clamped between first tip half 130 and second tip half 230 with the predetermined force provided by means for biasing 304, apparatus 100 also allows one to verify that electrical contact 402 and terminal block 500 are interlocked (e.g., FIG. 26) by pulling first tip half 130 and second tip half 230 away from terminal block 500 until wire 400 slips between first tip half 130 and second tip half 230 (e.g., FIG. 27). The predetermined force provided by means for biasing 304 is such that if electrical contact 402 and terminal block 500 are not interlocked (e.g., FIG. 22), wire 400 will not slip between first tip half 130 and second tip half 230 when pulling first tip half 130 and second tip half 230 away from terminal block 500 and, instead, apparatus 100 will pull electrical contact 402 out of receptacle 504 (e.g., FIG. 23). In this manner, apparatus 100 provides immediate feedback as to whether or not electrical contact 402 is interlocked with terminal block 500.

The pivotal interconnection of first hinge portion 108 to second hinge portion 208 about lever-pivot axis 300 may be facilitated by pivot pin 302. Pivot pin 302 may extend through first hinge tabs 110 and second hinge tabs 210 which may be interleaved with each other (e.g., FIG. 4). However, first hinge portion 108 and second hinge portion 208 may be provided in any one of a variety of alternative configurations for pivotal interconnection of first lever 102 to second lever 202.

Although first tip half 130 and second tip half 230 are illustrated as being mirror images of one another (minus tip-alignment protrusion 150 and tip-alignment recess 250), first tip half 130 and second tip half 230 need not necessarily be formed as mirror images of one another. For example, first tip half 130 may have a different external geometry than second tip half 230. Likewise, although first lever 102 and second lever 202 are illustrated as being geometrically identical to one another, first lever 102 and second lever 202 may have different geometries.

First lever 102, second lever 202, first tip half 130, second tip half 230, and pivot pin 302 may be made of metallic material, non-metallic material, or any combination of metallic material and non-metallic material. For example, first lever 102, second lever 202, first tip half 130, second tip half 230, and pivot pin 302 may be formed of plastic material such as acrylonitrile-butadiene-styrene (ABS), acrylic, polycarbonate, polyethylene, or any one of a variety of other plastic materials. Alternatively or additionally, first lever 102, second lever 202, first tip half 130, second tip half 230, and pivot pin 302 may be formed of metallic material such as aluminum or magnesium. First lever 102, second lever 202, first tip half 130, second tip half 230, and pivot pin 302 may be manufactured by injection molding, compression molding, casting, or other manufacturing methods including, but not limited to, additive manufacturing such as three-dimensional printing, or subtractive manufacturing such as by machining first lever 102, second lever 202, first tip half 130, second tip half 230, and pivot pin 302 from one or more blocks of material.

Referring generally to FIG. 1A and particularly to, e.g., FIGS. 2-7, first lever 102 and second lever 202 are class-one levers. The preceding subject matter of this paragraph characterizes example 2 of the present disclosure, wherein example 2 also includes the subject matter according to example 1, above.

Providing first lever 102 and second lever 202 as class-one levers in combination with a means for biasing 304 first lever 102 and second lever 202 away from one another provides a means for generating a predetermined force of a desired magnitude for gripping wire 400.

A class-one lever has a fulcrum at a location somewhere between opposing ends of the lever, such as within a lengthwise middle section of the lever. A force is applied to the lever on one side of the fulcrum for resisting or generating a load applied by the lever on the other side of the fulcrum. The location of the fulcrum relative to the opposing ends of the lever may determine the mechanical advantage provided by the lever, which may be greater than, less than, or equal to 1. For example, if the distance from the fulcrum to the location on the lever where a force is applied is greater than the distance from the fulcrum to the location on the lever where a load is resisted, then the lever provides a mechanical advantage of greater than 1, and vice versa. In apparatus 100, lever-pivot axis 300 is the fulcrum and means for biasing 304 provides a force on one side of lever-pivot axis 300 for generating a clamping predetermined force for gripping wire 400 between first tip half 130 and second tip half 230 on an opposite side of lever-pivot axis 300.

Referring generally to FIG. 1A and particularly to, e.g., FIGS. 2-5 and 8-10 and 13, first tip-support portion 112 comprises first tip-support-portion opening 114. First tip half 130 comprises first boss 146, pivotable inside first tip-support-portion opening 114 about first tip-pivot axis 142. Second tip-support portion 212 comprises second tip-support-portion opening 214. Second tip half 230 comprises second boss 246, pivotable inside second tip-support-portion opening 214 about second tip-pivot axis 242. The preceding subject matter of this paragraph characterizes example 3 of the present disclosure, wherein example 3 also includes the subject matter according to any one of examples 1 and 2, above.

First boss 146 inserted into first tip-support portion opening 114 and second boss 246 inserted into second tip-support portion opening 214 enable the removable attachment of respective first tip half 130 and second tip half 230 to respective first tip-support portion 112 and second tip-support portion 212 so that first tip half 130 and second tip half 230 can be easily replaced with tip halves of the same or different size and/or configuration.

Figure 6:
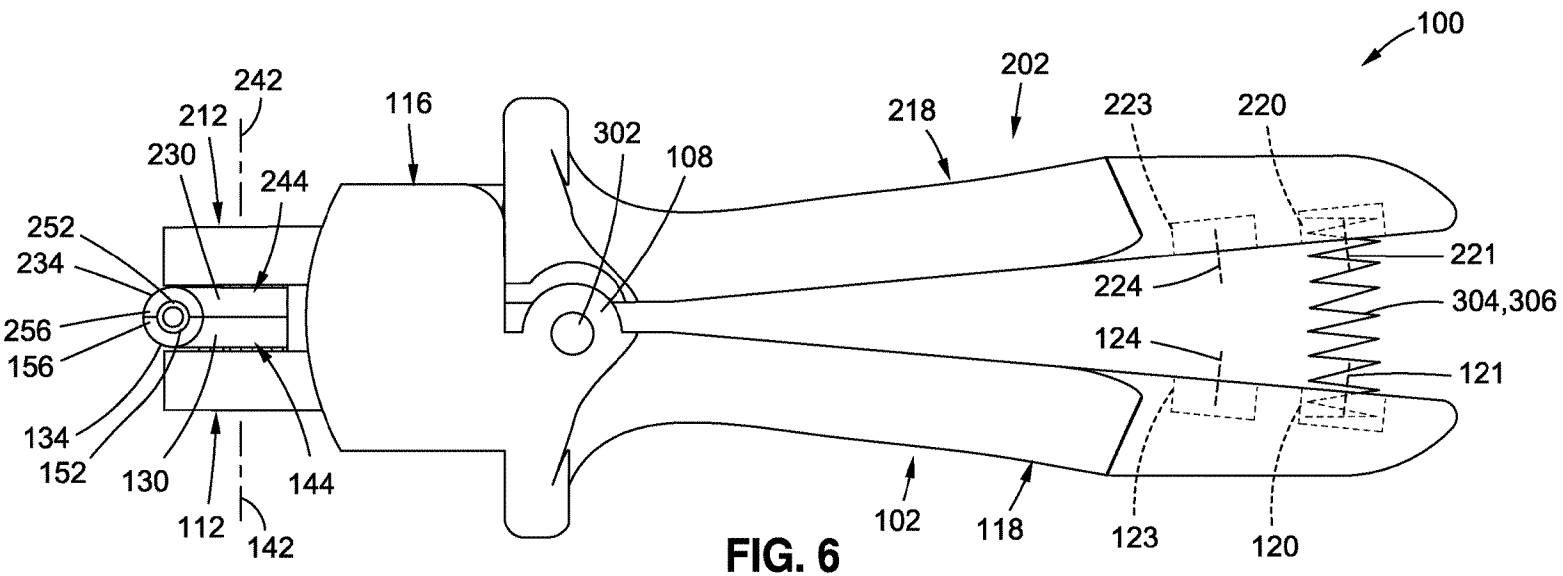

For example, squeezing first handle portion 118 and second handle portion 218 together causes first tip-support portion 112 and second tip-support portion 212 to be spread apart, providing space for the removal of first tip half 130 by pulling first boss 146 out of first tip-support-portion opening 114 and the removal of second tip half 230 by pulling second boss 246 out of second tip-support-portion opening 214. However, when first tip half 130 and second tip half 230 are held in contact with each other while first handle portion 118 and second handle portion 218 are squeezed together (e.g., FIG. 7), space between first tip-support portion 112 and second tip-support portion 212 may be insufficient to completely remove first boss 146 and second boss 246 from respective first tip-support-portion opening 114 and second tip-support-portion opening 214, thereby preventing first tip half 130 and second tip half 230 from being separated from respective first tip-support portion 112 and second tip-support portion 212 and thereby avoiding first tip half 130 and second tip half 230 becoming lost and potentially becoming foreign object debris (FOD). First boss 146 may decrease or taper in size from tip half mounting portion 144 toward terminal end of first boss 146, and second boss 246 may decrease or taper in size from second half mounting portion 244 toward terminal end of second boss 246. Likewise, first tip-support-portion opening 114 may decrease or taper in size from inner side of first tip-support portion 112 to outer side of first tip-support portion 112, and second tip-support-portion opening 214 may decrease or taper in size from inner side of second tip-support portion 212 to outer side of second tip-support portion 212. In this regard, first boss 146 and second boss 246 may each have a taper angle (e.g., 0.5 degrees) than is smaller than a taper angle (e.g., 1 degree) of first tip-support-portion opening 114 and second tip-support-portion opening 214. When first handle portion 118 and second handle portion 218 are squeezed together to provide space for the separate insertion of first boss 146 and second boss 246 respectively into first tip-support-portion opening 114 and second tip-support-portion opening 214 when attaching first tip half 130 and second tip half 230 respectively to first handle portion 118 and second handle portion 218, the difference in taper angle between first boss 146 and first tip-support-portion opening 114 and between second boss 246 and second tip-support-portion opening 214 may be such that first boss 146 snugly engages first tip-support-portion opening 114 and second boss 246 snugly engages second tip-support-portion opening 214 when first handle portion 118 and second handle portion 218 are released and the predetermined force generated by 304 causes first tip half 130 and second tip half 230 to be clamped together (FIG. 6). Although apparatus 100 is illustrated with first tip-support portion 112 and second tip-support portion 212 having respective first tip-support-portion opening 114 and second tip-support-portion opening 214 for respectively receiving first boss 146 and second boss 246 of respective first tip half 130 and second tip half 230, first tip-support portion 112 and/or second tip-support portion 212 may be provided with boss to be received in a respective opening in first tip half 130 and second tip half 230. Furthermore, although first tip-support-portion opening 114 and second tip-support-portion opening 214 are shown extending completely through respective first tip-support portion 112 and second tip-support portion 212, first tip-support-portion opening 114 and second tip-support-portion opening 214 may be formed as a closed-end bore extending only partially into first tip-support portion 112 and second tip-support portion 212. The removable attachment of first tip half 130 and second tip half 230 respectively to first tip-support portion 112 and second tip-support portion 212 allows for easy replacement of worn first tip half 130 and second tip half 230 with new first tip half 130 and second tip half 230 of the same geometry. In addition, the removable attachment of first tip half 130 and second tip half 230 respectively to first tip-support portion 112 and second tip-support portion 212 allows for easy replacement of first tip half 130 and second tip half 230 with first tip half 130 and second tip half 230 of a different geometry. For example, original first tip half 130 and second tip half 230 sized and configured to grip wire 400 of a relatively small geometry may be replaced with first tip half 130 and second tip half 230 sized and configured to grip wire 400 having a relatively large geometry. Alternatively or additionally, original first tip half 130 and second tip half 230 configured for one terminal block 500 may be replaced with first tip half 130 and second tip half 230 configured for terminal block 500 having a different geometry such as a different depth of receptacle locking clip 506 from outer surface 502 of terminal block 500.

Figure 4:
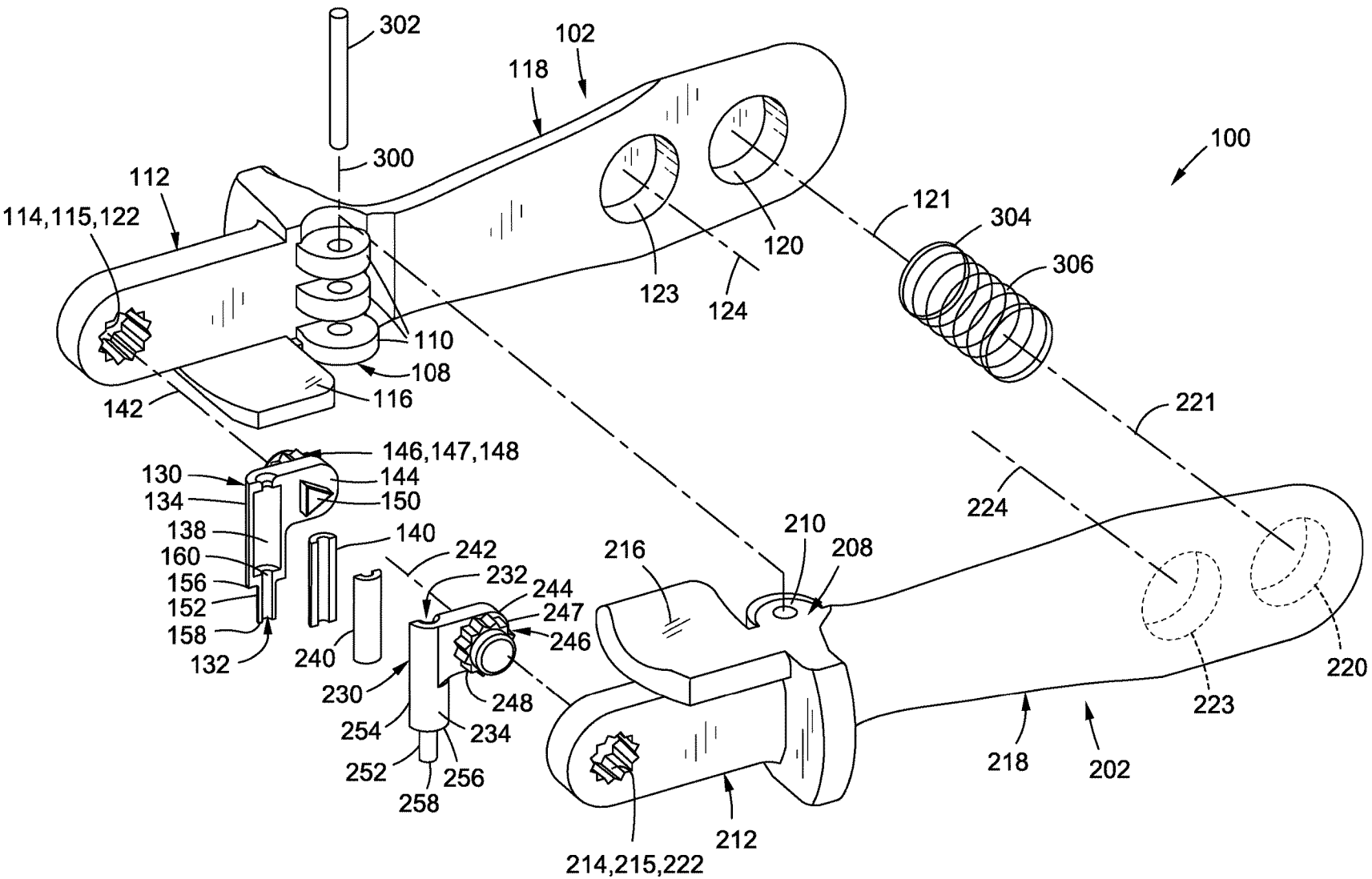

Referring generally to FIG. 1A and particularly to, e.g., FIGS. 4 and 6, first tip-pivot axis 142 of first boss 146 of first tip half 130 is collinear with second tip-pivot axis 242 of second boss 246 of second tip half 230 when first tip half 130 is in contact with second tip half 230. The preceding subject matter of this paragraph characterizes example 4 of the present disclosure, wherein example 4 also includes the subject matter according to example 3, above.

Collinearity of first tip-pivot axis 142 with second tip-pivot axis 242 (e.g., FIG. 6) when first tip half 130 is in contact with second tip half 230 facilitates rotation of first tip half 130 and second tip half 230 together as a set. In this regard, collinearity of first tip-pivot axis 142 with second tip-pivot axis 242 when first tip half 130 is in contact with second tip half 230 ensures that first channel 132 and second channel 232 are aligned with one another when first tip half 130 and second tip half 230 are rotated to the same orientation respectively relative to first lever 102 and second lever 202.

Figure 7:
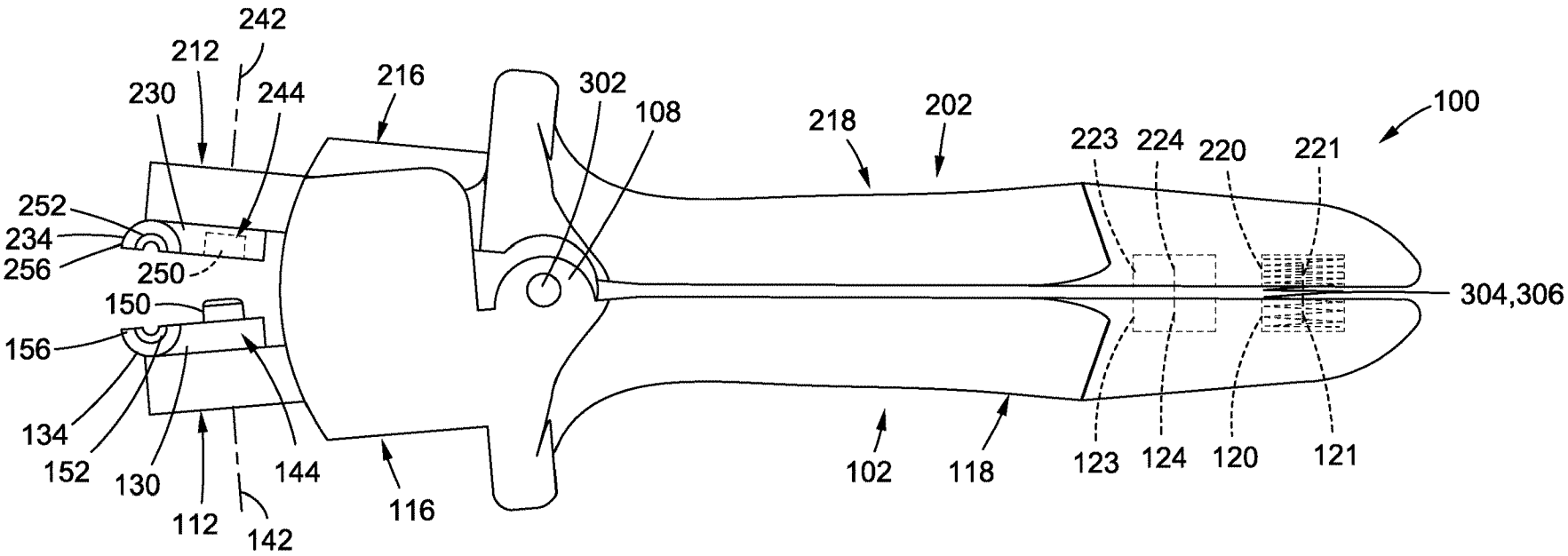
Figure 9:
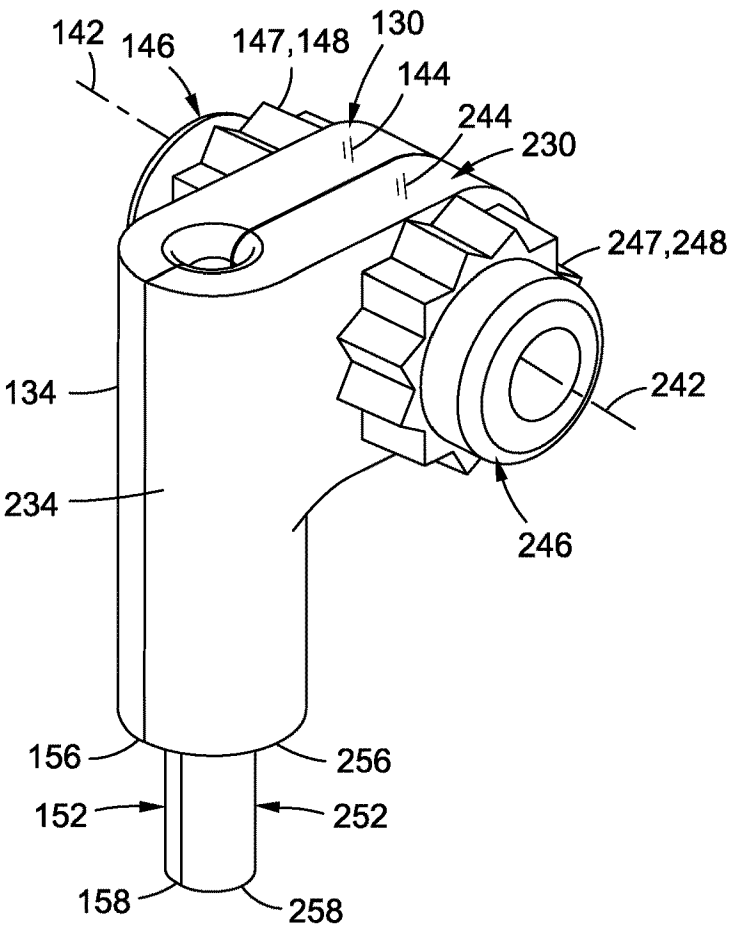

Referring generally to FIG. 1A and particularly to, e.g., FIGS. 4 and 7, first tip-pivot axis 142 of first boss 146 of first tip half 130 is oblique relative to second tip-pivot axis 242 of second boss 246 of second tip half 230 when first tip half 130 is not in contact with second tip half 230. The preceding subject matter of this paragraph characterizes example 5 of the present disclosure, wherein example 5 also includes the subject matter according to any one of examples 3 and 4, above.

First tip-pivot axis 142 being oblique relative to second tip-pivot axis 242 (e.g., FIG. 7) when first tip half 130 is not in contact with second tip half 230 limits the ability to rotate first tip half 130 and second tip half 230 as a set.

Referring generally to FIG. 1A and particularly to, e.g., FIGS. 2-5 and 8-10 and 13, first boss 146 comprises first multi-point star shank 147 and first tip-support-portion opening 114 comprises first multi-point star receiver 115, mated with first multi-point star shank 147 to enable first tip half 130 to be discretely angularly positioned relative to first tip-support portion 112. Second boss 246 comprises second multi-point star shank 247 and second tip-support-portion opening 214 comprises second multi-point star receiver 215, mated with second multi-point star shank 247 to enable second tip half 230 to be discretely angularly positioned relative to second tip-support portion 212. The preceding subject matter of this paragraph characterizes example 6 of the present disclosure, wherein example 6 also includes the subject matter according to any one of examples 3 to 5, above.

The discretely angularly positioning first tip half 130 and second tip half 230 relative to respective first tip-support portion 112 and second tip-support portion 212 enables first tip half 130 and second tip half 230 to be maintained at a desired orientation when manipulating electrical contact 402 relative to terminal block 500.

Figure 5:
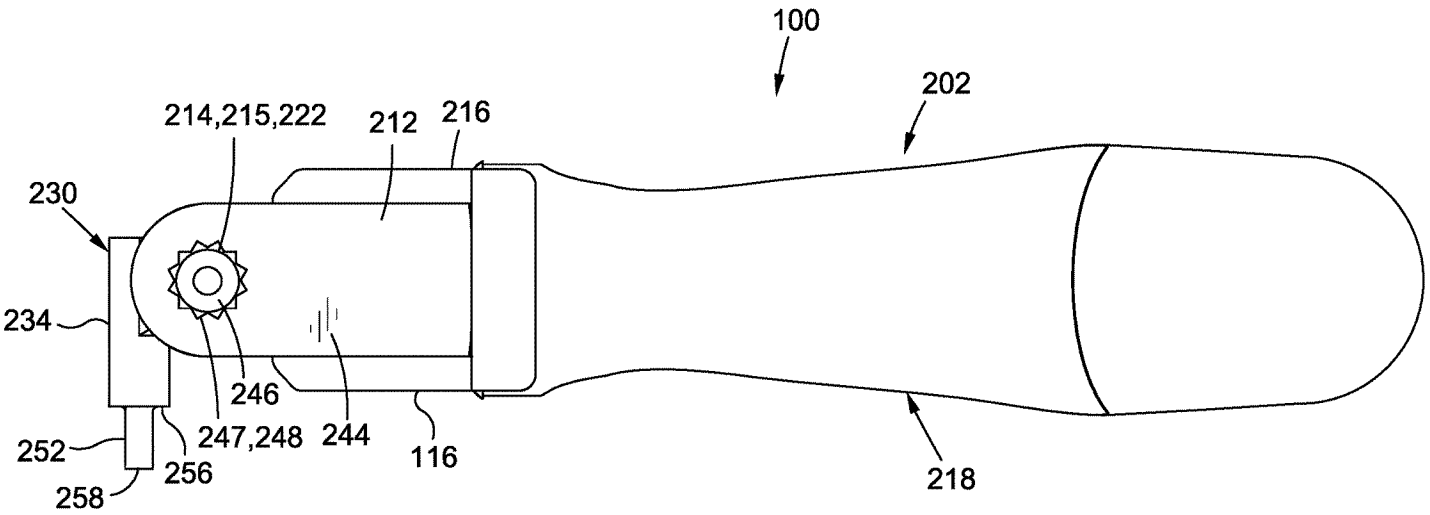

Discretely angularly positioning means that first tip half 130 and second tip half 230 may each be selectively positioned into and maintained at any one of a variety of distinct angular positions respectively relative to first tip-support portion 112 and second tip-support portion 212. For example, FIGS. 4-5 illustrated first tip half 130 and second tip half 230 oriented such that first channel 132 and second channel 232 are oriented generally 90 degrees relative to a lengthwise direction of first lever 102 and second lever 202. Once first tip half 130 and second tip half 230 are positioned at a desired orientation relative to respective first tip-support portion 112 and second tip-support portion 212, the engagement of first multi-point star shank 147 and second multi-point star shank 247 respectively with first multi-point star receiver 115 and second multi-point star receiver 215 may prevent rotation of first tip half 130 and second tip half 230 to a new orientation relative to respective first tip-support portion 112 and second tip-support portion 212. For example, first multi-point star shank 147 and second multi-point star shank 247 may be configured to respectively engage with first multi-point star receiver 115 and second multi-point star receiver 215 in a manner resisting rotation until a rotational force exceeding a threshold value is applied to first multi-point star shank 147 and second multi-point star shank 247. In this regard, first boss 146, second boss 246, first tip-support portion 112, and second tip-support portion 212 may be formed of a material that allow for temporary or non-permanent yielding of the points of first boss 146, second boss 246, first tip-support portion 112, and second tip-support portion 212 when a rotational force causes first multi-point star shank 147 and second multi-point star shank 247 to rotate respectively inside of first multi-point star receiver 115 and second multi-point star receiver 215 to a new orientation. Alternatively, first boss 146, second boss 246, first tip-support portion 112, and second tip-support portion 212 may be formed of a non-yielding material such that changing the orientation of first tip half 130 and second tip half 230 requires detaching first tip half 130 and second tip half 230 respectively from first tip-support portion 112 and second tip-support portion 212, and re-attaching first tip half 130 and second tip half 230 to first tip-support portion 112 and second tip-support portion 212 in a new orientation. First boss 146 and second boss 246 may be dimensioned such that when first tip half 130 and second tip half 230 are held in contact with each other while first handle portion 118 and second handle portion 218 are squeezed together to allow for adjusting the angular position of first tip half 130 and second tip half 230 relative to respective first tip-support portion 112 and second tip-support portion 212, first multi-point star shank 147 and second multi-point star shank 247 are disengaged from respective first multi-point star receiver 115 and second multi-point star receiver 215. In this regard, the terminal end of first multi-point star shank 147 and the terminal end of second multi-point star shank 247 may each have a smooth surface such as a cylindrical surface (FIGS. 8-9) to allow first boss 146 and second boss 246 to be rotated relative to first tip-support-portion opening 114 and second tip-support-portion opening 214 when adjusting angular position of first tip half 130 and second tip half 230 relative to respective first tip-support portion 112 and second tip-support portion 212.

Referring generally to FIG. 1A and particularly to, e.g., FIGS. 2-5 and 8-10 and 13, first multi-point star shank 147 is first 12-point star shank 148 and first multi-point star receiver 115 is first 12-point star receiver 122, mated with first 12-point star shank 148 to enable first tip half 130 to be discretely angularly positioned relative to first tip-support portion 112 in 30-degree increments. Second multi-point star shank 247 is second 12-point star shank 248 and second multi-point star receiver 215 is second 12-point star receiver 222, mated with second 12-point star shank 248 to enable second tip half 230 to be discretely angularly positioned relative to second tip-support portion 212 in 30-degree increments. The preceding subject matter of this paragraph characterizes example 7 of the present disclosure, wherein example 7 also includes the subject matter according to example 6, above.

The pivoting adjustment of first tip half 130 and second tip half 230 in 30-degree increments enables the repeatable orientation of first tip half 130 and second tip half 230 for terminal blocks 500 that have similar accessibility limitations. In this regard, first 12-point star shank 148, second 12-point star shank 248, and first 12-point star receiver 122, second 12-point star receiver 222, allows respective first tip half 130 and second tip half 230 to be oriented in 30 degree increments respectively relative to first tip-support portion 112 and second tip-support portion 212. For example, FIG. 5 illustrates first tip half 130 and second tip half 230 oriented such that first channel 132 and second channel 232 are oriented at 90 degrees relative to a lengthwise direction of first lever 102 and second lever 202. However, first 12-point star shank 148, second 12-point star shank 248, and first 12-point star receiver 122, second 12-point star receiver 222, allows first tip half 130 and second tip half 230 to be oriented at 90 degrees, 120 degrees, 150 degrees, or 180 degrees, relative to the lengthwise direction of first lever 102 and second lever 202. As may be appreciated, first multi-point star shank 147, second multi-point star shank 247, first multi-point star receiver 115, and second multi-point star receiver 215 may each be configured with any number of points, and are not limited to a 12-point star configuration. For example, first multi-point star shank 147, second multi-point star shank 247, first multi-point star receiver 115, and second multi-point star receiver 215 may each be configured with 3 points (e.g., a triangle shape), 4 points (e.g., a square shape), 5 points (e.g., a pentagon shape), or any other number of points to provide different levels of refinement at which to discretely angularly position first tip half 130 and second tip half 230.

Referring generally to FIG. 1A and particularly to, e.g., FIGS. 2-4 and 6-7, means for biasing 304 first tip-support portion 112 of first lever 102 and second tip-support portion 212 of second lever 202 toward each other is located between first handle portion 118 of first lever 102 and second handle portion 218 of second lever 202. The preceding subject matter of this paragraph characterizes example 8 of the present disclosure, wherein example 8 also includes the subject matter according to any one of examples 1 to 7, above.

Locating means for biasing 304 between first handle portion 118 and second handle portion 218 biases first tip half 130 and second tip half 230 toward one another and generates the predetermined force gripping wire 400 between first tip half 130 and second tip half 230. As mentioned above, first lever 102 and second lever 202 are each class-one levers wherein the force applied by means for biasing 304 biases first handle portion 118 and second handle portion 218 away from each other for gripping wire 400 between first tip half 130 and second tip half 230. For example, FIG. 4 illustrates means for biasing 304 located at a greater distance from lever-pivot axis 300 than the distance from lever-pivot axis 300 to first channel 132 and second channel 232, such that the force generated by means for biasing 304 first handle portion 118 and second handle portion 218 away from each other is magnified or leveraged into the predetermined force gripping wire 400 between first tip half 130 and second tip half 230. The amount by which the force generated by means for biasing 304 is magnified in the predetermined force is dependent upon the ratio of the distance from means for biasing 304 to lever-pivot axis 300 to the distance from lever-pivot axis 300 to first channel 132 and second channel 232.

Referring generally to FIG. 1A and particularly to, e.g., FIGS. 2-4 and 6-7, first handle portion 118 comprises first bore 120, having first-bore symmetry axis 121. Second handle portion 218 comprises second bore 220, having second-bore symmetry axis 221. First-bore symmetry axis 121 and second-bore symmetry axis 221 are parallel to a plane that is perpendicular to lever-pivot axis 300. First-bore symmetry axis 121 and second-bore symmetry axis 221 are collinear when first handle portion 118 of first lever 102 is in contact with second handle portion 218 of second lever 202. The preceding subject matter of this paragraph characterizes example 9 of the present disclosure, wherein example 9 also includes the subject matter according to example 8, above.

First bore 120 and second bore 220 hold compression spring 306 in position and allow for easy replacement of compression spring 306 with different compression spring 306 providing the same, higher, or lower amount of leverage for biasing first tip-support portion 112 and second tip-support portion 212 toward each other and generating the predetermined force for gripping wire 400 between first tip half 130 and second tip half 230.

In FIG. 4, first bore 120 and second bore 220 are formed in the inner walls of first handle portion 118 and second handle portion 218, respectively. First bore 120 and second bore 220 are illustrated as cylindrical bores sized and configured for receiving and supporting the opposing ends of a cylindrically-shaped compression spring 306 as means for biasing 304. The collinearity of first-bore symmetry axis 121 and second-bore symmetry axis 221 when first handle portion 118 is in contact with second handle portion 218 results in compression spring 306 being straight and the opposing ends of compression spring 306 being aligned with each other as shown in FIG. 7. Although first handle portion 118 and second handle portion 218 include first bore 120 and second bore 220 for receiving compression spring 306, first handle portion 118 and second handle portion 218 may be devoid of first bore 120 and second bore 220, and instead may include annular ridges (not shown) or other mechanical structure for supporting the opposing ends of compression spring 306.

Compression spring 306 may be formed of a metallic material or a non-metallic material, and may be provided in a length and a spring constant such that when compression spring 306 is installed in first bore 120 and second bore 220, compression spring 306 provides the predetermined force of desired magnitude for gripping wire 400 between first tip half 130 and second tip half 230. Although means for biasing 304 is illustrated throughout the figures as compression spring 306, means for biasing 304 may be provided in any one of a variety of configurations capable of biasing first tip-support portion 112 of first lever 102 and second tip-support portion 212 of second lever 202 toward each other. For example, means for biasing 304 may be provided as a pneumatic cylinder, a hydraulic cylinder, a leaf spring, or any one of a variety of other configurations for biasing first tip-support portion 112 and second tip-support portion 212 toward each other.

Referring generally to FIG. 1A and particularly to, e.g., FIGS. 2-4 and 6-7, first handle portion 118 comprises third bore 123, having third-bore symmetry axis 124. Second handle portion 218 comprises fourth bore 223, having fourth-bore symmetry axis 224. Third bore 123 and fourth bore 223 are located closer or farther from lever-pivot axis 300 than first bore 120 and second bore 220. Third-bore symmetry axis 124 is parallel to first-bore symmetry axis 121 and fourth-bore symmetry axis 224 is parallel to second-bore symmetry axis 221. The preceding subject matter of this paragraph characterizes example 10 of the present disclosure, wherein example 10 also includes the subject matter according to example 9, above.

Third bore 123 and fourth bore 223 provide an alternative location for installing compression spring 306, resulting in an easy way to adjust the amount of leverage provided by compression spring 306 and thereby change the magnitude of the predetermined force gripping wire 400 between first tip half 130 and second tip half 230. As shown in FIG. 4, third bore 123 and fourth bore 223 are formed as cylindrical bores in the inner walls of first handle portion 118 and second handle portion 218, respectively, and are sized and configured for receiving and supporting the opposing ends of cylindrically-shaped compression spring 306. The collinearity of third-bore symmetry axis 124 and fourth-bore symmetry axis 224 when first handle portion 118 is in contact with second handle portion 218 results in compression spring 306 being straight and the opposing ends of compression spring 306 being aligned with each other similar to the installation of compression spring 306 in first bore 120 and second bore 220 as shown in FIG. 7

Referring generally to FIG. 1A and particularly to, e.g., FIGS. 2-4 and 6-7, means for biasing 304 first tip-support portion 112 of first lever 102 and second tip-support portion 212 of second lever 202 toward each other is selectively positionable either in first bore 120 of first handle portion 118 and simultaneously in second bore 220 of second handle portion 218 or in third bore 123 of first handle portion 118 and simultaneously in fourth bore 223 of second handle portion 128. The preceding subject matter of this paragraph characterizes example 11 of the present disclosure, wherein example 11 also includes the subject matter according to example 10, above.

Selectively positioning means for biasing either in first bore 120 and second bore 220 or in third bore 123 and fourth bore 223 provide an easy way to change the magnitude of the predetermined force exerted on wire 400 between first tip half 130 and second tip half 230. As mentioned above, the amount by which the biasing force of means for biasing 304 is magnified in the predetermined force is dependent upon the ratio of the distance from means for biasing 304 to lever-pivot axis 300 to the distance from lever-pivot axis 300 to first channel 132 and second channel 232. If third bore 123 and fourth bore 223 are located closer to lever-pivot axis 300 than first bore 120 and second bore 220 as shown in FIGS. 4, 6 and 7, then moving compression spring 306 from first bore 120 and second bore 220 to third bore 123 and fourth bore 223 will reduce the magnitude of the predetermined force gripping wire 400 between first tip half 130 and second tip half 230. Conversely, if third bore 123 and fourth bore 223 are located farther from lever-pivot axis 300 than first bore 120 and second bore 220, then moving compression spring 306 from first bore 120 and second bore 220 to third bore 123 and fourth bore 223 will increase the magnitude of the predetermined force gripping wire 400 between first tip half 130 and second tip half 230.

Referring generally to FIG. 1A and particularly to, e.g., FIGS. 4 and 10, 11, and 13, first channel 132 of first tip half 130 comprises first-channel distal-end portion 159, first interior cavity 138, first-channel intermediate portion 160, and first-channel proximal-end portion 161. First interior cavity 138 is located between first-channel distal-end portion 159 and first-channel intermediate portion 160. First-channel intermediate portion 160 is located between first interior cavity 138 and first-channel proximal-end portion 161. Second channel 232 of second tip half 230 comprises second-channel distal-end portion 259, second interior cavity 238, second-channel intermediate portion 260, and second-channel proximal-end portion 261. Second interior cavity 238 is located between second-channel distal-end portion 259 and second-channel intermediate portion 260. Second-channel intermediate portion 260 is located between second interior cavity 238 and second-channel proximal-end portion 261. The preceding subject matter of this paragraph characterizes example 12 of the present disclosure, wherein example 12 also includes the subject matter according to any one of examples 1 to 11, above.

First channel 132 and second channel 232 provide a location within first tip half 130 and second tip half 230 for securely gripping wire 400 when first tip half 130 and second tip half 230 are in contact with each other. Locating first interior cavity 138 between first-channel distal-end portion 159 and first-channel intermediate portion 160 and locating second interior cavity 238 between second-channel distal-end portion 259 and second-channel intermediate portion 260 prevents axial movement of first gripping portion 140 and second gripping portion 240 relative to respective first tip half 130 and second tip half 230 when inserting electrical contact 402 into receptacle of terminal block 500 and when pulling apparatus 100 away from terminal block 500 to verify that electrical contact 402 and terminal block 500 are interlocked. Locating first-channel intermediate portion 160 between first interior cavity 138 and first-channel proximal-end portion 161 and locating second-channel intermediate portion 260 between second interior cavity 238 and second-channel proximal-end portion 261 results in first internal shoulder 154 and second internal shoulder 254 which push on contact aft end 406 of electrical contact 402 during insertion of electrical contact 402 into terminal block 500 without pushing on flange 408, which would otherwise interfere with the interlocking of flange 408 with receptacle locking clip 506.

FIGS. 10 and 13 respectively illustrate first-channel distal-end portion 159, first interior cavity 138, first-channel intermediate portion 160, first-channel proximal-end portion 161 of first channel 132, and second-channel distal-end portion 259, second interior cavity 238, second-channel intermediate portion 260, second-channel proximal-end portion 261 of second channel 232 each having a semi-cylindrical shape. However, one or more of first-channel distal-end portion 159, first interior cavity 138, first-channel intermediate portion 160, first-channel proximal-end portion 161 and second-channel distal-end portion 259, second interior cavity 238, second-channel intermediate portion 260, second-channel proximal-end portion 261 may have a non-semi-cylindrical shape. The upper edges of first-channel distal-end portion 159 and second-channel distal-end portion 259 may be radiused to prevent damage to wire 400 when clamped between first tip half 130 and second tip half 230.

Referring generally to FIG. 1A and particularly to, e.g., FIGS. 4 and 10, 11-11C, and 13, when first tip half 130 and second tip half 230 are in contact with each other: first interior cavity 138 of first channel 132 of first tip half 130 and second interior cavity 238 of second channel 232 of second tip half 230 collectively form interior-cavity cylindrical space 272, having an interior-cavity cylindrical-space diameter; first-channel distal-end portion 159 of first channel 132 and second-channel distal-end portion 259 of second channel 232 collectively form channel-distal-end-portion cylindrical space 270, having a channel-distal-end-portion cylindrical-space diameter; first-channel intermediate portion 160 of first channel 132 and second-channel intermediate portion 260 of second channel 232 collectively form channel-intermediate-portion cylindrical space 274, having a channel-intermediate-portion cylindrical-space diameter; and the interior-cavity cylindrical-space diameter of interior-cavity cylindrical space 272 is larger than each of channel-distal-end-portion cylindrical-space diameter of channel-distal-end-portion cylindrical space 270 and channel-intermediate-portion cylindrical-space diameter of channel-intermediate-portion cylindrical space 274. The preceding subject matter of this paragraph characterizes example 13 of the present disclosure, wherein example 13 also includes the subject matter according to example 12, above.

The interior-cavity cylindrical-space diameter being larger than each of channel-distal-end-portion cylindrical-space diameter and channel-intermediate-portion cylindrical-space diameter provides an area for respectively securely supporting first gripping portion 140 and second gripping portion 240.

First gripping portion 140 and second gripping portion 240 may each have an axial length complementary to the axial length of first interior cavity 138 and second interior cavity 238, such that when first gripping portion 140 and second gripping portion 240 are installed in first interior cavity 138 and second interior cavity 238, the opposing ends of first gripping portion 140 and second gripping portion 240 are in physical contact with the opposing ends of first interior cavity 138 and second interior cavity 238, and which prevents axial movement of first gripping portion 140 and second gripping portion 240 when pushing 403 into receptacle 504 of terminal block 500, and when pulling first tip half 130 and second tip half 230 out of terminal block 500 to verify that electrical contact 402 and terminal block 500 are interlocked.

Referring generally to FIG. 1A and particularly to, e.g., FIGS. 4 and 10, 11, 11A, 11C, and 13, channel-distal-end-portion cylindrical-space diameter of channel-distal-end-portion cylindrical space 270 and channel-intermediate-portion cylindrical-space diameter of channel-intermediate-portion cylindrical space 274 are equal. The preceding subject matter of this paragraph characterizes example 14 of the present disclosure, wherein example 14 also includes the subject matter according to example 13, above.

The equal size of channel-distal-end-portion cylindrical-space diameter and channel-intermediate-portion cylindrical-space diameter simplifies manufacturing. For example, if first tip half 130 and second tip half 230 are manufactured by plastic injection molding, the mold tooling for first tip half 130 may be simplified due to commonality of the radius of first-channel distal-end portion 159 and first-channel intermediate portion 160. Likewise, the mold tooling for second tip half 230 may be simplified due to commonality of the radius of second-channel distal-end portion 259 and second-channel intermediate portion 260. However, first-channel distal-end portion 159 and first-channel intermediate portion 160 may be provided in different sizes as may second-channel distal-end portion 259 and second-channel intermediate portion 260, as long as channel-distal-end-portion cylindrical space 270 and channel-intermediate-portion cylindrical space 274 are smaller than gripping portion cylindrical space 278.

Referring generally to FIG. 1A and particularly to, e.g., FIGS. 2-6 and 8-11, 11C, and 11D, first tip half 130 comprises first nose portion 152, having first nose end 158. First channel 132 of first tip half 130 comprises first internal shoulder 154, located in first nose portion 152 between first-channel intermediate portion 160 and first-channel proximal-end portion 161. Second tip half 230 comprises second nose portion 252, having second nose end 258. Second channel 232 of second tip half 230 comprises second internal shoulder 254, located in second nose portion 252 between second-channel intermediate portion 260 and second-channel proximal-end portion 261. When first tip half 130 and second tip half 230 are in contact with each other: first-channel proximal-end portion 161 of first channel 132 of first tip half 130 and second-channel proximal-end portion 261 of second channel 232 of second tip half 230 collectively form channel-proximal-end-portion cylindrical space 276, having a channel-proximal-end-portion cylindrical-space diameter; and channel-intermediate-portion cylindrical-space diameter of channel-intermediate-portion cylindrical space 274 is smaller than channel-proximal-end-portion cylindrical-space diameter of channel-proximal-end-portion cylindrical space 276. The preceding subject matter of this paragraph characterizes example 15 of the present disclosure, wherein example 15 also includes the subject matter according to any one of examples 13 and 14, above.

When wire 400 is clamped between first tip half 130 and second tip half 230, first nose portion 152 and second nose portion 252 stabilize wire 400 and electrical contact 402 against lateral movement during insertion of electrical contact 402 into receptacle 504 of terminal block 500. In addition, when wire 400 is clamped between first tip half 130 and second tip half 230, first internal shoulder and second internal shoulder pushing on contact aft end 406 of electrical contact 402 (e.g., FIG. 19) facilitates the insertion of electrical contact 402 into receptacle 504 of terminal block 500 without pushing on flange 408 of electrical contact 402 which would undesirably interfere with interlocking of flange 408 with receptacle locking clip 506 (e.g., FIG. 126). In this regard, the axial length of channel-proximal-end-portion cylindrical space 276 is less than the distance from contact aft end 406 to flange 408 to prevent first nose end 158 and second nose end 258 from contacting flange 408. Channel-intermediate-portion cylindrical-space diameter being smaller than channel-proximal-end-portion cylindrical-space diameter allows first-channel intermediate portion 160 and second-channel intermediate portion 260 to stabilize wire 400 against lateral movement when inserting electrical contact 402 into receptacle 504 without first-channel intermediate portion 160 and second-channel intermediate portion 260 clamping down on wire 400 which would undesirably affect (i.e., reduce) the magnitude of the predetermined force exerted by first gripping portion 140 and second gripping portion 240 on wire 400.

In this regard, first-channel intermediate portion 160 and second-channel intermediate portion 260 are sized such that when wire 400 is clamped between first tip half 130 and second tip half 230 (e.g. FIG. 22), first-channel intermediate portion 160 and second-channel intermediate portion 260 do not clamp wire 400. Likewise, channel-proximal-end-portion cylindrical space 276 is larger than the diameter of electrical contact 402 to prevent first-channel proximal-end portion 161 and second-channel proximal-end portion 261 from clamping down on electrical contact 402 which would prevent first internal shoulder 154 and second internal shoulder 254 from pushing down on contact aft end 406 when first tip half 130 and second tip half 230 are slid down along wire 400 (e.g., FIG. 18). In addition, channel-proximal-end-portion cylindrical space 276 is larger than the diameter of electrical contact 402 to prevent first-channel proximal-end portion 161 and second-channel proximal-end portion 261 from clamping electrical contact 402 which would also undesirably affect (i.e., reduce) the magnitude of the predetermined force exerted by first gripping portion 140 and second gripping portion 240 on wire 400. First nose end 158 and second nose end 258 may respectively include first chamfer 162 and second chamfer 262 (e.g., FIG. 8A) to facilitate the guiding of first nose portion 152 and second nose portion 252 into the opening of receptacle 504 in outer surface 502 of terminal block 500 when pushing electrical contact 402 into receptacle 504.

Referring generally to FIG. 1A and particularly to, e.g., FIGS. 2-6 and 8-10, and 13, first tip half 130 further comprises first body portion 134 and first nose portion 152. First body portion 134 comprises first depth-control shoulder 156. First nose portion 152 extends from first depth-control shoulder 156 of first body portion 134 in a direction perpendicular to a plane that is parallel to first depth-control shoulder 156. Second tip half 230 further comprises second body portion 234 and second nose portion 252. Second body portion 234 comprises second depth-control shoulder 256. Second nose portion 252 extends from second depth-control shoulder 256 of second body portion 234 in a direction perpendicular to a plane that is parallel to second depth-control shoulder 256. When first tip half 130 and second tip half 230 are in contact with each other, first depth-control shoulder 156 of first body portion 134 and second depth-control shoulder 256 of second body portion 234 are coplanar. The preceding subject matter of this paragraph characterizes example 16 of the present disclosure, wherein example 16 also includes the subject matter according to example 15, above.

First depth-control shoulder 156 and second depth-control shoulder 256 provide a means for immediate tactile and visual indication (e.g., FIGS. 25-26) that electrical contact 402 has been inserted into receptacle 504 of terminal block 500 at the depth required for interlocking of flange 408 of electrical contact 402 to receptacle locking clip 506 of terminal block 500 (e.g., FIG. 26). For example, FIGS. 21-22 illustrate first depth-control shoulder 156 and second depth-control shoulder 256 in gapped relation 514 to outer surface 502 of terminal block 500, and which corresponds to flange 408 in unseated position 512 with receptacle locking clip 506. However, FIGS. 25-26 illustrate first depth-control shoulder 156 and second depth-control shoulder 256 in non-gapped relation 516 with outer surface 502 of terminal block 500, and which corresponds to flange 408 in seated position 510 with receptacle locking clip 506.

Referring generally to FIG. 1A and particularly to, e.g., FIGS. 10, 11B, 12, and 13, apparatus 100 further comprises first gripping portion 140, installed in first interior cavity 138 (FIG. 12) of first channel 132 of first tip half 130, and second gripping portion 240, installed in second interior cavity 238 (FIG. 12) of second channel 232 of second tip half 230. The preceding subject matter of this paragraph characterizes example 17 of the present disclosure, wherein example 17 also includes the subject matter according to any one of examples 15 and 16, above.

First gripping portion 140 in first interior cavity 138 and second gripping portion 240 in second interior cavity 238 provide a means for gripping wire 400 with the predetermined force generated by means for biasing 304. First gripping portion 140 and second gripping portion 240 may be fixedly mounted to first interior cavity 138 and second interior cavity 238 such as by adhesive bonding. However, first gripping portion 140 and second gripping portion 240 are preferably removably installed in first interior cavity 138 and second interior cavity 238 to enable replacement of first gripping portion 140 and second gripping portion 240 when worn, or to enable substitution of existing first gripping portion 140 and existing second gripping portion 240 with new first gripping portion 140 and new second gripping portion 240 having a different first inner surface 141 and different second inner surface 241, and/or formed of a different material providing a different coefficient of friction relative to wire 400, and/or providing a different level of compressibility when wire 400 is clamped between first gripping portion 140 and second gripping portion 240.

Referring generally to FIGS. 1A-1B and particularly to, e.g., FIGS. 4, 6, 8-11C, 12, and 13, first gripping portion 140 of first tip half 130 has first inner surface 141. Second gripping portion 240 of second tip half 230 has second inner surface 241. Wire 400 has a wire diameter. When first tip half 130 and second tip half 230 are in contact with each other, first inner surface 141 of first gripping portion 140 and second inner surface 241 of second gripping portion 240 collectively form gripping-portion cylindrical space 278, having a gripping-portion cylindrical-space diameter; the gripping-portion cylindrical-space diameter of gripping-portion cylindrical space 278 is smaller than each of channel-distal-end-portion cylindrical-space diameter of channel-distal-end-portion cylindrical space 270, channel-intermediate-portion cylindrical-space diameter of channel-intermediate-portion cylindrical space 274, and wire diameter of wire 400; and channel-distal-end-portion cylindrical-space diameter of channel-distal-end-portion cylindrical space 270, channel-intermediate-portion cylindrical-space diameter of channel-intermediate-portion cylindrical space 274, and channel-proximal-end-portion cylindrical-space diameter of channel-proximal-end-portion cylindrical space 276 are each larger than wire 400 diameter of wire 400. When first tip half 130 and second tip half 230 are in contact with each other and wire 400 is clamped between first gripping portion 140 of first tip half 130 and second gripping portion 240 of second tip half 230, wire 400 has an interference fit with first inner surface 141 of first gripping portion 140 and second inner surface 241 of second gripping portion 240; and wire 400 has a clearance fit with first-channel distal-end portion 159 of first channel 132, second-channel distal-end portion 259 of second channel 232, first-channel intermediate portion 160 of first channel 132 and second-channel intermediate portion 260 of second channel 232. The preceding subject matter of this paragraph characterizes example 18 of the present disclosure, wherein example 18 also includes the subject matter according to example 17, above.

The interference fit of the gripping-portion cylindrical-space diameter of gripping-portion cylindrical space 278 (FIG. 12) with wire 400, and the clearance fit of channel-distal-end-portion cylindrical-space diameter of channel-distal-end-portion cylindrical space 270 (FIG. 11A), channel-intermediate-portion cylindrical-space diameter of channel-intermediate-portion cylindrical space 274 (FIG. 11C), and channel-proximal-end-portion cylindrical-space diameter of channel-proximal-end-portion cylindrical space 276 (FIG. 11D) with wire 400 ensures that only first gripping portion 140 and second gripping portion 240 are gripping wire 400 (e.g., FIG. 22) with the predetermined force when clamped between first tip half 130 and second tip half 230, allowing the predetermined force gripping wire 400 to be applied in a repeatable manner when confirming the locked seating of flange 408 of electrical contact 402 with receptacle locking clip 506 during insertion of electrical contact 402 into terminal block 500.

FIG. 22 shows second tip half 230 and wire 400, with second tip half 230 omitted for clarity. In FIG. 22, only second gripping portion 240 is in clamping contact with wire 400, while second-channel distal-end portion 259, second-channel intermediate portion 260, and second-channel proximal-end portion 261 are not in clamping contact with wire 400. Although first tip half 130 is not shown in FIG. 22, only first gripping portion 140 would also be in clamping contact with wire 400, while first-channel distal-end portion 159, first-channel intermediate portion 160, and first-channel proximal-end portion 161 are not in clamping contact with wire 400. As described in greater detail below, the predetermined force with which wire 400 is clamped between first gripping portion 140 and second gripping portion 240 is such that the tool-wire frictional force between wire 400 and first gripping portion 140 and second gripping portion 240 is less than the seated-contact removal force, and greater than the unseated-contact removal force. The tool-wire frictional force between wire 400 and first gripping portion 140 and second gripping portion 240 is dependent upon the magnitude of the predetermined force and the coefficient of friction between wire 400 and first gripping portion 140 and second gripping portion 240. As described below, the seated-contact removal force is the force required to disengage flange 408 of electrical contact 402 from receptacle locking clip of terminal block 500 when flange 408 is seated in receptacle locking clip 506 and contact aft end 406 make is electrically connected to terminal block 500. The unseated-contact removal force is the force required to pull electrical contact 402 out of receptacle 504 when flange 408 is unseated from receptacle locking clip 506.

Referring generally to FIGS. 1A-1B and particularly to, e.g., FIGS. 11, 11C-11D, and 16, electrical contact 402 has contact aft end 406, having a contact-aft-end diameter. Channel-proximal-end-portion cylindrical-space diameter of channel-proximal-end-portion cylindrical space 276 is larger than the contact-aft-end diameter of contact aft end 406. Channel-intermediate-portion cylindrical-space diameter of channel-intermediate-portion cylindrical space 274 is smaller than the contact-aft-end diameter of contact aft end 406. The preceding subject matter of this paragraph characterizes example 19 of the present disclosure, wherein example 19 also includes the subject matter according to any one of examples 17 and 18, above.

Providing channel-proximal-end-portion cylindrical space 276 larger than the contact-aft-end diameter of contact aft end 406 prevents first-channel proximal-end portion 161 and second-channel proximal-end portion 261 from clamping against electrical contact 402, which would undesirably affect (i.e., reduce) the magnitude of the predetermined force exerted by first gripping portion 140 and second gripping portion 240 on wire 400. Providing channel-intermediate-portion cylindrical-space diameter smaller than the contact-aft-end diameter of contact aft end 406 ensures that first internal shoulder 154 and second internal shoulder 254 will contact and push against contact aft end 406 when electrical contact 402 is pushed into receptacle 504 of terminal block 500. FIG. 11 illustrates first tip half 130 and second tip half 230 and shows channel-intermediate-portion cylindrical space 274 smaller than channel-proximal-end-portion cylindrical space 276.

Referring generally to FIG. 1A and particularly to, e.g., FIGS. 10 and 13, at least one of first gripping portion 140 of first tip half 130 or second gripping portion 240 of second tip half 230 comprises a resiliently compressible material. The preceding subject matter of this paragraph characterizes example 20 of the present disclosure, wherein example 20 also includes the subject matter according to any one of examples 17 to 19, above.

Forming first gripping portion 140 or second gripping portion 240 of resiliently compressible material ensures that at least one of first gripping portion 140 and second gripping portion 240 conforms to wire 400 without damaging wire 400 when clamped between first tip half 130 and second tip half 230. FIG. 10 illustrates first gripping portion 140 and FIG. 13 illustrates second gripping portion 240. The resiliently compressible material of first gripping portion 140 and second gripping portion 240 may be a resiliently compressible foam material, such as foam rubber. The resiliently compressible material of first gripping portion 140 and second gripping portion 240 may be selected such that when wire 400 is gripped between first gripping portion 140 and second gripping portion 240 at the predetermined force, first gripping portion 140 and second gripping portion 240 provide a coefficient of friction with wire 400 that results in the tool-wire frictional force being less than the seated-contact removal force, and greater than the unseated-contact removal force, as described above.

Referring generally to FIG. 1A and particularly to, e.g., FIGS. 4, 7, 10, and 13, first tip half 130 comprises tip-alignment protrusion 150, comprising protrusion flat side surface 151. Second tip half 230 comprises tip-alignment recess 250, comprising recess flat side surface 251. Tip-alignment protrusion 150 and tip-alignment recess 250 have geometrically complementary shapes. When first tip half 130 and second tip half 230 are in contact with each other and first channel 132 of first tip half 130 is parallel to second channel 232 of second tip half 230, tip-alignment protrusion 150 is received by tip-alignment recess 250 and protrusion flat side surface 151 mates with recess flat side surface 251. The preceding subject matter of this paragraph characterizes example 21 of the present disclosure, wherein example 21 also includes the subject matter according to any one of examples 1 to 20, above.

The geometrically complementary shapes of tip-alignment protrusion 150 and tip-alignment recess 250 enable first tip half 130 and second tip half 230 to be interlocked with one another enabling first tip half 130 and second tip half 230 to be rotated together as a set when adjusting the orientation of first tip half 130 and second tip half 230 relative to first tip-support portion 112 and second tip-support portion 212. Rotating first tip half 130 and second tip half 230 as a set ensures that first channel 132 and second channel 232 remain aligned with each other when rotating first tip half 130 and second tip half 230 to a new orientation relative to first lever 102 and second lever 202. Maintaining alignment of first channel 132 and second channel 232 during rotation ensures that wire 400 will fit within first channel 132 and second channel 232 when first tip half 130 and second tip half 230 are clamped together (e.g., FIGS. 2, 3, and 6), regardless of the orientation of first tip half 130 and second tip half 230 relative to first lever 102 and second lever 202. Geometrically complementary shapes of tip-alignment protrusion 150 and tip-alignment recess 250 may be described as shapes that geometrically match one another, such that tip-alignment protrusion 150 fits within tip-alignment recess 250 in a manner preventing tip-alignment protrusion 150 and tip-alignment recess 250 from rotating relative to each other.

Referring generally to FIG. 1A and particularly to, e.g., FIGS. 2 and 4-7, apparatus 100 further comprises push-pad portion 116 and pull-pad portion 216. Push-pad portion 116 is coupled to one of first tip-support portion 112 of first lever 102 or second tip-support portion 212 of second lever 202. Pull-pad portion 216 is coupled to one of first tip-support portion 112 of first lever 102 or second tip-support portion 212 of second lever 202. Push-pad portion 116 is oriented opposite pull-pad portion 216 such that first tip-pivot axis 142 of first tip half 130 and second tip-pivot axis 242 of second tip half 230 lie in a plane located between push-pad portion 116 and pull-pad portion 216. The preceding subject matter of this paragraph characterizes example 22 of the present disclosure, wherein example 22 also includes the subject matter according to any one of examples 1 to 21, above.

Push-pad portion 116 and pull-pad portion 216 each provide a surface against which one may manually apply a force to insert electrical contact 402 into receptacle 504 of terminal block 500 and to verify that electrical contact 402 and terminal block 500 are interlocked without unintentionally squeezing together first handle portion 118 and second handle portion 218, which would undesirably reduce the magnitude of the predetermined force gripping wire 400. For example, the downward-pointing arrow of FIG. 20 illustrates the application of a downward force that one may apply to push electrical contact 402 into receptacle 504 while first handle portion 118 and second handle portion 218 are biased away from each other by means for biasing 304. When pulling first tip half 130 and second tip half 230 out of receptacle 504, one may apply an upwardly-directed force while first handle portion 118 and second handle portion 218 are biased away from each other by means for biasing 304.

Referring generally to FIG. 1A and particularly to, e.g., FIGS. 2 and 4-7, push-pad portion 116 is perpendicular to lever-pivot axis 300 and at least a part of push-pad portion 116 is between lever-pivot axis 300 and one of first tip-pivot axis 142 of first tip half 130 or second tip-pivot axis 242 of second tip half 230. Pull-pad portion 216 is perpendicular to lever-pivot axis 300 and at least a part of pull-pad portion 216 is between lever-pivot axis 300 and one of first tip-pivot axis 142 of first tip half 130 or second tip-pivot axis 242 of second tip half 230. The preceding subject matter of this paragraph characterizes example 23 of the present disclosure, wherein example 23 also includes the subject matter according to example 22, above.

The orientation of push-pad portion 116 and pull-pad portion 216 perpendicular to the lever-pivot axis 300 allows one to grasp apparatus 100 and apply an external force to push-pad portion 116 or pull-pad portion 216 along a direction parallel to wire 400 when pushing electrical contact 402 into receptacle of terminal block 500 and when pulling apparatus 100 away from terminal block 500 to verify locked seating of electrical contact 402 to terminal block 500.

Figures 2, 3:
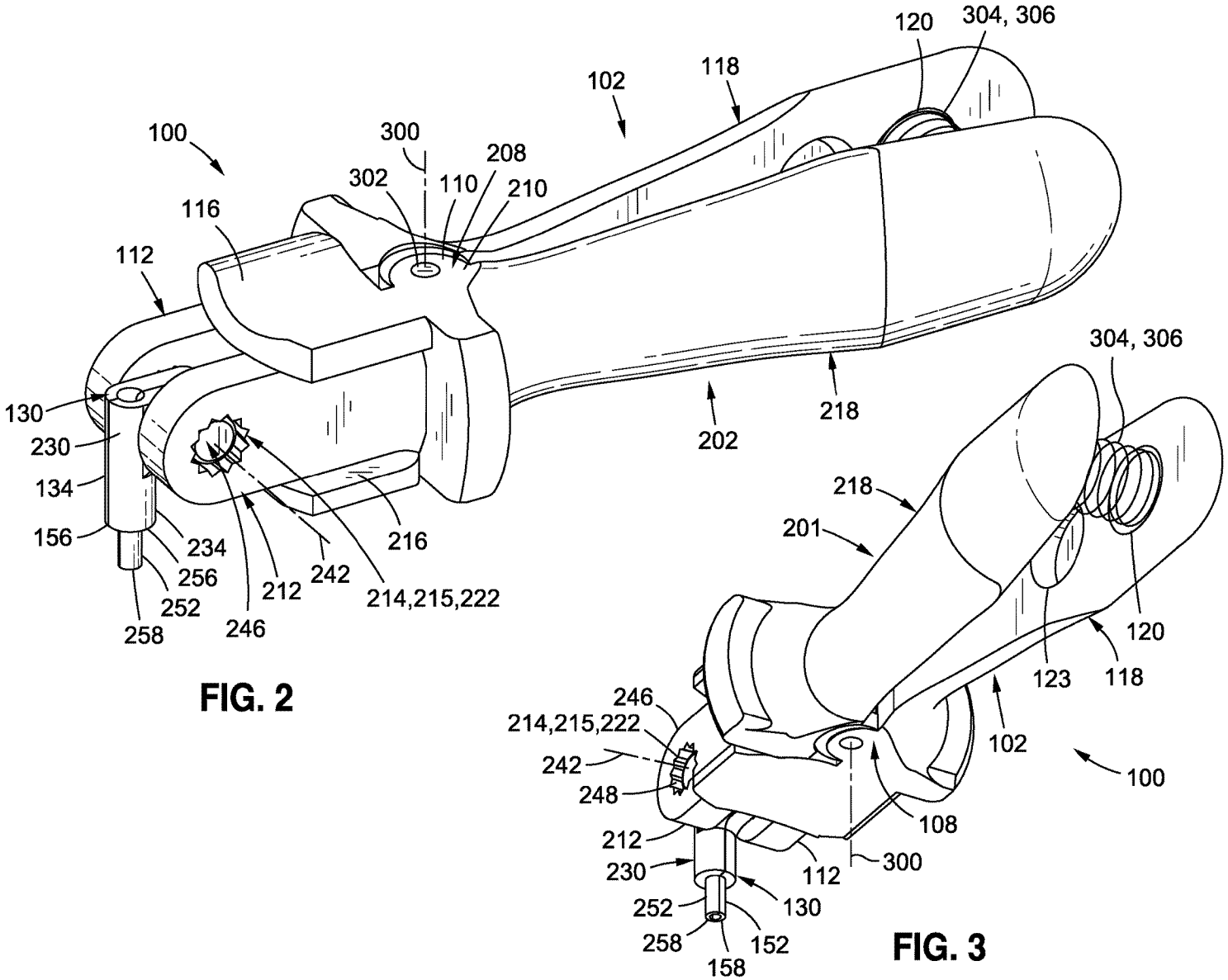

In the present disclosure, the term "perpendicular" means "generally perpendicular." In addition, the term "parallel" means "generally parallel." FIG. 2 illustrates push-pad portion 116 which may include a slightly concave shape with the bottom of the shape being generally centered relative to the width of push-pad portion 116, and which may allow one to center a finger or thumb on push-pad portion 116 when manually applying force to push electrical contact 402 into receptacle 504. pull-pad portion 216 may also include a slightly concave shape to allow one to center a finger or thumb on pull-pad portion 216 when manually applying force to pull first tip half 130 and second tip half 230 out of receptacle 504 when verifying that electrical contact 402 and terminal block 500 are interlocked. As shown in FIG. 4, push-pad portion 116 may be integral with first lever 102, and pull-pad portion 216 may be integral with second lever 202.

Referring generally to FIG. 1A and particularly to, e.g., FIGS. 2 and 4-7, first lever 102 and second lever 202 are geometrically identical to one another. The preceding subject matter of this paragraph characterizes example 24 of the present disclosure, wherein example 24 also includes the subject matter according to any one of examples 1 to 23, above.

First lever 102 and second lever 202 being geometrically identical to one another reduces the number of unique components of apparatus 100 and thereby simplifies manufacturing and assembly of apparatus 100. For example, a geometrically identical first lever 102 and second lever 202 may require a single plastic injection mold. In contrast, if first lever 102 is geometrically different than second lever 202, a unique plastic injection mold would be required for each of first lever 102 and second lever 202. Although first lever 102 and second lever 202 are shown as being geometrically identical to one another, first lever 102 and second lever 202 may be geometrically different from one another.

Referring generally to FIGS. 2, 4-7, and 15-29, and particularly to, e.g., FIGS. 14A-14E, method 600 of manipulating wire 400 relative to terminal block 500 is disclosed. Wire 400 has an electrical contact 402. Method 600 comprises (block 602) clamping wire 400 with a predetermined force between first gripping portion 140, installed in first interior cavity 138 of first channel 132 of first tip half 130, and second gripping portion 240, installed in second interior cavity 238 of second channel 232 of second tip half 230. Method 600 also comprises (block 604) pushing electrical contact 402 into receptacle 504 of terminal block 500 using first internal shoulder 154 of first channel 132 and second internal shoulder 254 of second channel 232 to interlock electrical contact 402 and terminal block 500. With wire 400 clamped with the predetermined force between first gripping portion 140 and second gripping portion 240, method 600 additionally comprises (block 606) verifying that electrical contact 402 and terminal block 500 are interlocked by pulling first tip half 130 and second tip half 230 away from terminal block 500 until wire 400 slips along first gripping portion 140 of first tip half 130 and second gripping portion 240 of second tip half 230. The preceding subject matter of this paragraph characterizes example 25 of the present disclosure.

In method 600, clamping wire 400 with the predetermined force between first gripping portion 140 and second gripping portion 240, pushing electrical contact 402 into receptacle 504, and verifying that electrical contact 402 and terminal block 500 are interlocked by pulling first tip half 130 and second tip half 230 away from terminal block 500 until wire 400 slips provides a quick and efficient process for installing and confirming the locked seating of electrical contact 402 in terminal block 500 in a single operation using a single tool (e.g., apparatus 100). Clamping wire 400 between first tip half 130 and second tip half 230 with the predetermined force provided by means for biasing 304 allows one to verify that electrical contact 402 and terminal block 500 are interlocked (e.g., FIG. 26) by pulling first tip half 130 and second tip half 230 away from terminal block 500 until 400 slips between first tip half 130 and second tip half 230 (e.g., FIG. 27). If electrical contact 402 and terminal block 500 are not interlocked (e.g., FIG. 22), wire 400 will not slip between first tip half 130 and second tip half 230 when pulling first tip half 130 and second tip half 230 away from terminal block 500 and, instead, apparatus 100 will pull electrical contact 402 out of receptacle 504 (e.g., FIG. 23).

FIG. 15 illustrates apparatus 100 with first tip half 130 and second tip half 230 in contact with one another due to means for biasing 304 biasing first handle portion 118 and second handle portion 218 away from each other. FIG. 16 illustrates first handle portion 118 and second handle portion 218 moved toward each other, as may be performed by squeezing together first handle portion 118 and second handle portion 218 (e.g., using one's thumb and forefinger), in order to move first tip half 130 and second tip half 230 away from each other in preparation for clamping wire 400 between first tip half 130 and second tip half 230. FIG. 17 illustrates first tip half 130 and second tip half 230 clamped onto wire 400. In FIG. 17, first handle portion 118 and second handle portion 218 are released to allow means for biasing 304 to bias first handle portion 118 and second handle portion 218 away from each other such that first tip half 130 and second tip half 230 clamp onto wire 400.

FIG. 18 illustrates first tip half 130 and second tip half 230 being slid along wire 400 toward electrical contact 402 until first internal shoulder 154 and second internal shoulder 254 physically abutting contact aft end 406, as shown in FIG. 19. FIG. 19 illustrates second channel 232 of second tip half 230 and the interference fit between wire 400 and second gripping portion 240, the clearance fit between wire 400 and second-channel distal-end portion 259, the clearance fit between wire 400 and second-channel intermediate portion 260, and the clearance fit between electrical contact 402 and second-channel proximal-end portion 261. Although not shown, first channel 132 of first tip half 130 provides an interference fit between wire 400 and first gripping portion 140, the clearance fit between wire 400 and first-channel distal-end portion 159, the clearance fit between wire 400 and first-channel intermediate portion 160, and the clearance fit between electrical contact 402 and first-channel proximal-end portion 161.

FIG. 20 illustrates wire 400 clamped between first tip half 130 and second tip half 230 prior to insertion of electrical contact 402 into terminal block 500 using apparatus 100. FIG. 21 illustrates first nose end 158 of first tip half 130 and second nose end 258 of second tip half 230 inserted into terminal block 500 to push electrical contact 402 into receptacle 504. FIG. 22 illustrates first nose end 158 and second nose end 258 inserted into terminal block 500 such that first depth-control shoulder 156 and second depth-control shoulder 256 are in gapped relation 514 to outer surface 502 of terminal block 500, and which results in flange 408 in unseated position 512 with receptacle locking clip 506.

FIG. 23 illustrates verifying whether electrical contact 402 and terminal block 500 are interlocked by pulling first tip half 130 and second tip half 230 away from terminal block 500 while wire 400 is clamped between first tip half 130 and second tip half 230. Due to non-engagement of flange 408 of electrical contact 402 with receptacle locking clip 506 of terminal block 500 (e.g., FIG. 22), electrical contact 402 is pulled out of receptacle 504.

FIG. 24 illustrates the re-insertion of electrical contact 402 into terminal block 500 after first tip half 130 and second tip half 230 have been slid along wire 400 until first internal shoulder 154 and second internal shoulder 254 physically abut contact aft end 406, as shown in FIG. 19. FIG. 25 illustrates first nose portion 152 and second nose portion 252 inserted into receptacle 504 of terminal block 500 until first depth-control shoulder 156 and second depth-control shoulder 256 are in non-gapped relation 516 to outer surface 502 of terminal block 500, and which results in flange 408 of electrical contact 402 in seated position 510 with receptacle locking clip 506. FIG. 26 illustrates flange 408 of electrical contact 402 interlocked with receptacle locking clip 506 of terminal block 500.

FIG. 27 illustrates verifying whether electrical contact 402 and terminal block 500 are interlocked by pulling first tip half 130 and second tip half 230 away from terminal block 500 while wire 400 is clamped between first tip half 130 and second tip half 230. Due to engagement of flange 408 of electrical contact 402 with receptacle locking clip 506 of terminal block 500 (e.g., FIG. 26), first tip half 130 and second tip half 230 slide along wire 400. FIG. 28 illustrates first handle portion 118 and second handle portion 218 moved toward each other by squeezing together first handle portion 118 and second handle portion 218 (e.g., using one's thumb and forefinger) in order to move first tip half 130 and second tip half 230 away from each other to unclamp wire 400 from between first tip half 130 and second tip half 230. With apparatus 100 removed from wire 400, FIG. 29 illustrates first handle portion 118 and second handle portion 218 released to allow means for biasing 304 to bias first handle portion 118 and second handle portion 218 away from each, resulting in first tip half and second tip half being in contact with each other.

Referring generally to FIGS. 2-4, 6, 10, 13, 17, 23, 26, and 27, and particularly to, e.g., FIGS. 14A-14E, according to method 600, clamping wire 400 with the predetermined force between first gripping portion 140 of first tip half 130 and second gripping portion 240 of second tip half 230 comprises (block 608) clamping wire 400 between first gripping portion 140, made of a resiliently compressible material, and second gripping portion 240, made of the resiliently compressible material. The preceding subject matter of this paragraph characterizes example 26 of the present disclosure, wherein example 26 also includes the subject matter according to example 25, above.

Clamping wire 400 between first gripping portion 140 and second gripping portion 240 formed of a resiliently compressible material enables wire 400 to be gripped without damaging wire 400. As mentioned above, the resiliently compressible material may be a foam rubber material or any other material that is resiliently compressible.

According to method 600, clamping wire 400 with the predetermined force between first gripping portion 140 of first tip half 130 and second gripping portion 240 of second tip half 230 comprises (block 610) clamping wire 400 with a tool-wire frictional force that is less than a seated-contact removal force, required to disengage flange 408 of electrical contact 402 from receptacle locking clip 506 of terminal block 500 when flange 408 is seated in receptacle locking clip 506, and greater than an unseated-contact removal force required to pull electrical contact 402 at least partially out of receptacle 504 of terminal block 500 when flange 408 of electrical contact 402 is unseated from receptacle locking clip 506 of terminal block 500. The preceding subject matter of this paragraph characterizes example 27 of the present disclosure, wherein example 27 also includes the subject matter according to any one of examples 25 and 26, above.

Clamping wire 400 with a tool-wire frictional force that is less than a seated-contact removal force, and greater than an unseated-contact removal force enables the ability to confirm that electrical contact 402 is seated in terminal block 500 without unintentionally unseating electrical contact 402.

As mentioned above, the tool-wire frictional force between wire 400 and the combination of first gripping portion 140 and second gripping portion 240 is dependent upon the magnitude of the predetermined force, gripping wire 400, and the coefficient of friction between wire 400 and the combination of first gripping portion 140 and second gripping portion 240. The seated-contact removal force is the force required to disengage flange 408 of electrical contact 402 from a receptacle locking clip of terminal block 500 when flange 408 is engaged to receptacle locking clip 506. The unseated-contact removal force is the force required to pull electrical contact 402 out of receptacle 504 when flange 408 is not engaged to receptacle locking clip 506. In a non-limiting example where electrical contact 402 requires a seated-contact removal force of at least 11 pounds to disengage seated electrical contact 402 (e.g., FIG. 26) from receptacle locking clip 506, and an unseated-contact removal force of at least 5 pounds to pull unseated electrical contact 402 (e.g., FIG. 22) at least partially out of receptacle 504, apparatus 100 may be configured such that the predetermined force generated by means for biasing 304 causes first bore 120 and second tip half 230 to grip wire 400 with a tool-wire frictional force in the range of 5-10 pounds. As may be appreciated, the required range of the magnitude of the tool-wire frictional force is dependent upon the magnitude of the seated-contact removal force and the magnitude of the unseated-contact removal force which, in turn, is dependent upon the geometry electrical contact 402 and receptacle locking clip 506, among other factors.

Referring generally to FIGS. 4, 10, 11B, 12, 13, 16, and 19, and particularly to, e.g., FIGS. 14A-14E, method 600 further comprises (block 612) supporting first gripping portion 140 in first interior cavity 138 of first tip half 130 and (block 614) supporting second gripping portion 240 in second interior cavity 238 of second tip half 230. The preceding subject matter of this paragraph characterizes example 28 of the present disclosure, wherein example 28 also includes the subject matter according to any one of examples 25 to 27, above.

Supporting first gripping portion 140 and second gripping portion 240 in respective first interior cavity 138 and second interior cavity 238 prevents axial movement of first gripping portion 140 and second gripping portion 240 within respective first tip half 130 and second tip half 230 when applying an external axial force to apparatus 100 when pushing electrical contact 402 into receptacle of terminal block 500, and when pulling apparatus 100 away from terminal block 500 to verify that electrical contact 402 and terminal block 500 are interlocked.

As mentioned above, first gripping portion 140 and second gripping portion 240 may be fixedly mounted to first interior cavity 138 and second interior cavity 238 such as by adhesive bonding. Alternatively, first gripping portion 140 and second gripping portion 240 may be removably installed in first interior cavity 138 and second interior cavity 238 such as by press fit to enable replacement of first gripping portion 140 and second gripping portion 240 when worn, or to enable substitution of existing first gripping portion 140 and second gripping portion 240 with new first gripping portion 140 and second gripping portion 240. For example, existing first gripping portion 140 and existing second gripping portion 240 may be replaced with new first gripping portion 140 and new second gripping portion 240 having different diameter first inner surface 141 and different diameter second inner surface 241 to accommodate a different diameter of wire 400, or new first gripping portion 140 and new second gripping portion 240 may be formed of a different material to provide a different coefficient of friction relative to wire 400 to generate the required predetermined force based on new values of the seated-contact removal force and unseated-contact removal force, as may occur when new wire 400 has a different size of electrical contact 402 than previous electrical contact 402.

Referring generally to FIGS. 10, 12, 13, 16, and 19, and particularly to, e.g., FIGS. 14A-14E, according to method 600, clamping wire 400 with the predetermined force between first gripping portion 140 of first tip half 130 and second gripping portion 240 of second tip half 230 comprises (block 616) clamping wire 400 between first inner surface 141 of first gripping portion 140 and second inner surface 241 of second gripping portion 240 so that at least one of first gripping portion 140 or second gripping portion 240 is resiliently deformed in compression. The preceding subject matter of this paragraph characterizes example 29 of the present disclosure, wherein example 29 also includes the subject matter according to example 28, above.

Clamping wire 400 between first inner surface 141 and second inner surface 241 so that first gripping portion 140 and second gripping portion 240 are resiliently deformed in compression ensures that wire 400 is not damaged when gripped by first gripping portion 140 and second gripping portion 240. In addition, clamping wire 400 between first inner surface 141 and second inner surface 241 so that first gripping portion 140 and second gripping portion 240 are resiliently deformed in compression ensures that a substantial portion (e.g., an entirety) of the surface area of first inner surface 141 and second inner surface 241 will be in direct physical contact with the outer surface of wire 400, which ensures that the tool-wire frictional force can be repeatably generated on different wires 400 regardless of minor variations in wire 400 diameter of the same wire gauge, and regardless of minor variations in the gripping-portion cylindrical-space diameter collectively defined by first inner surface 141 and second inner surface 241.

First gripping portion 140 and second gripping portion 240 may be formed of resiliently compressible foam material as mentioned above, allowing first gripping portion 140 and second gripping portion 240 to be resiliently deformed in compression when clamping wire 400 between first inner surface 141 and second inner surface 241.

Referring generally to FIGS. 19, 22, and 26, and particularly to, e.g., FIGS. 14A-14E, according to method 600, when wire 400 is clamped between first gripping portion 140 of first tip half 130 and second gripping portion 240 of second tip half 230, (block 618) wire 400 is loose between first-channel distal-end portion 159 of first channel 132 of first tip half 130 and second-channel distal-end portion 259 of second channel 232 of second tip half 230, wire 400 is loose between first-channel intermediate portion 160 of first channel 132 and second-channel intermediate portion 260 of second channel 232, and wire 400 is loose between first-channel proximal-end portion 161 of first channel 132 and second-channel proximal-end portion 261 of second channel 232. The preceding subject matter of this paragraph characterizes example 30 of the present disclosure, wherein example 30 also includes the subject matter according to example 29, above.

Wire 400 being loose between first-channel distal-end portion 159 and second-channel distal-end portion 259, between first-channel intermediate portion 160 and second-channel intermediate portion 260, and between first-channel proximal-end portion 161 and second-channel proximal-end portion 261 when wire 400 is clamped between first tip half 130 and second tip half 230 ensures that the predetermined force on wire 400 is applied only by first gripping portion 140 and second gripping portion 240, which ensures the repeatability of the tool-wire frictional force on different wires 400.

FIG. 22 illustrates second gripping portion 240 in clamping contact with wire 400, while second-channel distal-end portion 259, second-channel intermediate portion 260, and second-channel proximal-end portion 261 are not in clamping contact with wire 400. Although first tip half 130 is not shown in FIG. 22, only first gripping portion 140 is in clamping contact with wire 400, while first-channel distal-end portion 159, first-channel intermediate portion 160, and first-channel proximal-end portion 161 are not in clamping contact with wire 400. In this regard, first tip half 130 and second tip half 230 are configured to provide an interference fit between wire 400 and the combination of first inner surface 141 and second inner surface 241, a clearance fit between wire 400 and the combination of first-channel distal-end portion 159 and second-channel distal-end portion 259, a clearance fit between wire 400 and the combination of first-channel intermediate portion 160 and second-channel intermediate portion 260, and a clearance fit between wire 400 and the combination of first-channel proximal-end portion 161 and second-channel proximal-end portion 261.

Referring generally to FIGS. 19, 22, and 26, and particularly to, e.g., FIGS. 14A-14E, according to method 600, when wire 400 is clamped between first gripping portion 140 of first tip half 130 and second gripping portion 240 of second tip half 230, (block 620) electrical contact 402 of wire 400 is loose between first-channel proximal-end portion 161 of first channel 132 and second-channel proximal-end portion 261 of second tip half 230. The preceding subject matter of this paragraph characterizes example 31 of the present disclosure, wherein example 31 also includes the subject matter according to example 30, above.

Electrical contact 402 being loose between first-channel proximal-end portion 161 and second-channel proximal-end portion 261 when wire 400 is clamped between first gripping portion 140 and second gripping portion 240 ensures that the predetermined force on wire 400 is applied only by first gripping portion 140 and second gripping portion 240, which ensures the repeatability of the tool-wire frictional force on different wires 400.

Referring generally to FIGS. 22-27, and particularly to, e.g., FIGS. 14A-14E, according to method 600, verifying that electrical contact 402 and terminal block 500 are interlocked by pulling first tip half 130 and second tip half 230 away from terminal block 500 until wire 400 slips along first gripping portion 140 of first tip half 130 and second gripping portion 240 of second tip half 230 is performed while (block 622) clamping wire 400 between first gripping portion 140 and second gripping portion 240 with the predetermined force. The preceding subject matter of this paragraph characterizes example 32 of the present disclosure, wherein example 32 also includes the subject matter according to any one of examples 25 to 31, above.

Verifying that electrical contact 402 and terminal block 500 are interlocked by pulling first tip half 130 and second tip half 230 away from terminal block 500 until wire 400 slips along first gripping portion 140 and second gripping portion 240 while wire 400 is clamped with the predetermined force between first gripping portion 140 and second gripping portion 240 (e.g., FIG. 27) enables one to maintain the tool-wire frictional force at a level that is less than the seated-contact removal force, and greater than the unseated-contact removal force.

Referring generally to FIGS. 15-17, and particularly to, e.g., FIGS. 14A-14E, according to method 600, clamping wire 400 with the predetermined force between first gripping portion 140 of first tip half 130 and second gripping portion 240 of second tip half 230 further comprises: (block 624) moving first handle portion 118 of first lever 102 and second handle portion 218 of second lever 202 toward each other so that first tip half 130, supported by first lever 102, and second tip half 230, supported by second lever 202, move away from each other; (block 626) placing wire 400 between first gripping portion 140 of first tip half 130 and second gripping portion 240 of second tip half 230; and (block 628) biasing first handle portion 118 of first lever 102 and second handle portion 218 of second lever 202 away from each another other so that first tip half 130 and second tip half 230 move toward from each other and wire 400 is clamped between first gripping portion 140 of first tip half 130 and second gripping portion 240 of second tip half 230 with the predetermined force. The preceding subject matter of this paragraph characterizes example 33 of the present disclosure, wherein example 33 also includes the subject matter according to any one of examples 25 to 32, above.

Moving first handle portion 118 and second handle portion 218 toward each other (e.g., FIG. 16), placing wire 400 between first gripping portion 140 and second gripping portion 240 (e.g., FIG. 16), and biasing first handle portion 118 and second handle portion 218 away from each other (e.g., FIG. 17) allows one to easily and quickly clamp wire 400 between first tip half 130 and second tip half 230. For example, squeezing first handle portion 118 and second handle portion 218 together (e.g., using one's thumb and forefinger) as shown in FIG. 16 against the biasing force generated by means for biasing 304 causes first tip half 130 and second tip half 230 to spread apart, providing space for wire 400. FIG. 17 illustrates first tip half and second tip half clamped onto wire 400, and first handle portion 118 and second handle portion 218 biased away from each other such that first gripping portion 140 and second gripping portion 240 are clamped onto wire 400.

Referring generally to FIGS. 2-7 and 15-17, and particularly to, e.g., FIGS. 14A-14E, according to method 600, moving first handle portion 118 of first lever 102 and second handle portion 218 of second lever 202 toward each other so that first tip half 130, supported by first lever 102, and second tip half 230, supported by second lever 202, move away from each other comprises (block 630) pivoting first handle portion 118 and second handle portion 218 about lever-pivot axis 300 that pivotally interconnects first lever 102 and second lever 202. The preceding subject matter of this paragraph characterizes example 34 of the present disclosure, wherein example 34 also includes the subject matter according to example 33, above.

Moving first handle portion 118 and second handle portion 218 toward each other by pivoting first handle portion 118 and second handle portion 218 about lever-pivot axis 300 provides an easy way to move first tip half 130 and second tip half 230 away from each other. For example, first handle portion 118 and second handle portion 218 may be squeezed together using one hand (e.g., using one's thumb pressing on first handle portion 118 and one or fingers pressing on second handle portion 218). Pivoting first handle portion 118 and second handle portion 218 about lever-pivot axis 300 provides mechanical advantage for moving first tip half 130 and second tip half 230 away from each other.

Referring generally to FIGS. 2-4, 6-7 and 15-17, and particularly to, e.g., FIGS. 14A-14E, method 600 further comprises (block 632) changing the predetermined force between first gripping portion 140 of first tip half 130 and second gripping portion 240 of second tip half 230 by moving means for biasing 304 first tip-support portion 112 of first lever 102 and second tip-support portion 212 of second lever 202 toward each other from first bore 120 of first handle portion 118 of first lever 102 and second bore 220 of second handle portion 218 of second lever 202 to third bore 123 of first handle portion 118 and fourth bore 223 of second handle portion 218. The preceding subject matter of this paragraph characterizes example 35 of the present disclosure, wherein example 35 also includes the subject matter according to any one of examples 33 and 34, above.

Moving means for biasing 304 (e.g., compression spring 306) from first bore 120 and second bore 220 to third bore 123 and fourth bore 223 provides an easy way to adjust the amount of leverage provided by means for biasing 304. As mentioned above, moving means for biasing 304 closer to or farther from lever-pivot axis 300 changes the mechanical advantage provided by first lever 102 and second lever 202 in generating the predetermined force gripping wire 400 between first tip half 130 and second tip half 230. In FIG. 4, means for biasing 304 is installed in first bore 120 and second bore 220 which is located a greater distance from lever-pivot axis 300 than the distance from lever-pivot axis 300 to first channel 132 and second channel 232. Therefore, installing means for biasing 304 in first channel 132 and second channel 232 may reduce the magnitude of the predetermined force gripping wire 400 between first tip half 130 and second tip half 230.

Referring generally to FIGS. 2-5, and particularly to, e.g., FIGS. 14A-14E, method 600 further comprises (block 634) pivotally adjusting a first orientation of first tip half 130 relative to first tip-support portion 112 of first lever 102 and (block 636) pivotally adjusting a second orientation of second tip half 230 relative to second tip-support portion 212 of second lever 202. The preceding subject matter of this paragraph characterizes example 36 of the present disclosure, wherein example 36 also includes the subject matter according to example 35, above.

Pivotally adjusting the orientation of first tip half 130 and second tip half 230 relative to respective first tip-support portion 112 and second tip-support portion 212 enables one to position first tip half 130 and second tip half 230 at the orientation that best allows one to successfully and comfortably grasp apparatus 100 when pushing electrical contact 402 into terminal block 500, and when pulling first tip half 130 and second tip half 230 out of terminal block 500 to verify locked seating of electrical contact 402 in terminal block 500.

Referring generally to FIGS. 2-6 and 8-9, and particularly to, e.g., FIGS. 14A-14E, according to method 600, pivotally adjusting the first orientation of first tip half 130 relative to first tip-support portion 112 of first lever 102 and pivotally adjusting the second orientation of second tip half 230 relative to second tip-support portion 212 of second lever 202 respectively further comprises (block 638) pivoting, about first tip-pivot axis 142 of first tip half 130, first boss 146 of first tip half 130 inside first tip-support-portion opening 114 of first tip-support portion 112 of first lever 102 and (block 640) pivoting, about second tip-pivot axis 242, second boss 246 of second tip half 230 inside second tip-support-portion opening 214 of second tip-support portion 212 of second lever 202. The preceding subject matter of this paragraph characterizes example 37 of the present disclosure, wherein example 37 also includes the subject matter according to example 36, above.

Pivoting first boss 146 and second boss 246 respectively inside first tip-support portion opening 114 and second tip-support portion opening 214 provides a means for maintaining respective first tip-pivot axis 142 and second tip-pivot axis 242 in fixed position while pivoting first tip half 130 and second tip half 230, thereby improving the ease with which the orientation of first tip half 130 and second tip half 230 are adjusted. In this regard, first tip half 130 and second tip half 230 may be pivoted respectively about first tip-pivot axis 142 and second tip-pivot axis 242 while first boss 146 and second boss 246 remain respectively centered within first tip-support-portion opening 114 and second tip-support-portion opening 214.

Referring generally to FIGS. 2-6 and 8-9, and particularly to, e.g., FIGS. 14A-14E, according to method 600, pivoting, about first tip-pivot axis 142 of first tip half 130, first boss 146 of first tip half 130 inside first tip-support-portion opening 114 of first tip-support portion 112 of first lever 102 and pivoting, about second tip-pivot axis 242 of second tip half 230, second boss 246 of second tip half 230 inside second tip-support-portion opening 214 of second tip-support portion 212 of second lever 202 respectively further comprises (block 642) discretely angularly positioning first tip half 130 relative to first tip-support portion 112 of first lever 102 and (block 644) discretely angularly positioning second tip half 230 relative to second tip-support portion 212 of second lever 202. The preceding subject matter of this paragraph characterizes example 38 of the present disclosure, wherein example 38 also includes the subject matter according to example 37, above.

Discretely angularly positioning first tip half 130 and second tip half 230 enables the ability to maintain first tip half 130 and second tip half 230 at a specific orientation during insertion of electrical contact 402 into terminal block 500. In addition, discretely angularly positioning first tip half 130 and second tip half 230 enables the repeatable orientation of first tip half and second tip half for terminal blocks that have the same accessibility limitations, and allow one to angularly position first tip half 130 and second tip half 230 at the orientation that is most preferable for the user of apparatus 100 in terms of the position of the user's arm and/or hands when pushing electrical contact 402 into terminal block 500 and pulling first tip half 130 and second tip half 230 away from terminal block 500 to verify the locked seating of electrical contact 402 with terminal block 500.

Referring generally to FIGS. 2-6 and 8-9, and particularly to, e.g., FIGS. 14A-14E, according to method 600, discretely angularly positioning first tip half 130 relative to first tip-support portion 112 of first lever 102 and discretely angularly positioning second tip half 230 relative to second tip-support portion 212 of second lever 202 respectively further comprises (block 646) discretely angularly positioning first tip half 130 relative to first tip-support portion 112 of first lever 102 in 30-degree increments and (block 648) discretely angularly positioning second tip half 230 relative to second tip-support portion 212 of second lever 202 in 30-degree increments. The preceding subject matter of this paragraph characterizes example 39 of the present disclosure, wherein example 39 also includes the subject matter according to example 38, above.

Discretely angularly positioning first tip half 130 and second tip half 230 in 30-degree increments provides up to 12 different angular orientations at which to position first tip half 130 and second tip half 230. For example, angularly positioning first tip half and second tip half in 30-degree increments allows first tip half 130 and second tip half 230 to be oriented at 0 degrees, 30 degrees, 60 degrees, 90 degrees, 120 degrees, 150 degrees, 180 degrees, 210 degrees, 240 degrees, 270 degrees, 300 degrees, and 330 degrees relative to the lengthwise direction of first lever 102 and second lever 202. However, as indicated above, first multi-point star shank 147, second multi-point star shank 247, first multi-point star receiver 115, and second multi-point star receiver 215 may be configured with any number of points providing a corresponding number of discrete angular positions at which to orient first tip half 130 and second tip half 230.

Referring generally to FIGS. 2, 4, 5, 20, 23-24, and 27, and particularly to, e.g., FIGS. 14A-14E, method 600 further comprises (block 650) or (block 662) applying an external force to one of push-pad portion 116, coupled to one of first tip-support portion 112 of first lever 102 or second tip-support portion 212 of second lever 202, or pull-pad portion 216, coupled to one of first tip-support portion 112 of first lever 102 or second tip-support portion 212 of second lever 202, when performing at least one of pushing electrical contact 402 into receptacle 504 of terminal block 500 using first internal shoulder 154 of first channel 132 of first tip half 130 and second internal shoulder 254 of second channel 232 of second tip half 230 to interlock electrical contact 402 and terminal block 500, or, with wire 400 clamped with the predetermined force between first gripping portion 140 and second gripping portion 240, verifying that electrical contact 402 and terminal block 500 are interlocked by pulling first tip half 130 and second tip half 230 away from terminal block 500 until wire 400 slips along first gripping portion 140, installed in first interior cavity 138 of first channel 132, and second gripping portion 240, installed in second interior cavity 238 of second channel 232. The preceding subject matter of this paragraph characterizes example 40 of the present disclosure, wherein example 40 also includes the subject matter according to any one of examples 35 to 39, above.

Applying an external force to push-pad portion 116 or pull-pad portion 216 when pushing electrical contact 402 into receptacle 504 of terminal block 500 and/or verifying that electrical contact 402 and terminal block 500 are interlocked avoids a user grabbing and squeezing together first handle portion 118 and second handle portion 218, which would undesirably reduce the magnitude of the predetermined force, gripping wire 400, and correspondingly reduce the magnitude of the tool-wire frictional force, required to verify the locked seating of electrical contact 402 with terminal block 500.

Referring generally to FIGS. 2, 4, 5, 8, 8A, 9, 10, 13, 25, and 26, and particularly to, e.g., FIGS. 14A-14E, according to method 600, pushing electrical contact 402 into receptacle 504 of terminal block 500 using first internal shoulder 154 of first tip half 130 and second internal shoulder 254 of second tip half 230 to interlock electrical contact 402 and terminal block 500 comprises (block 652) contacting first depth-control shoulder 156 of first tip half 130 and second depth-control shoulder 256 of second tip half 230 with outer surface 502 of terminal block 500. The preceding subject matter of this paragraph characterizes example 41 of the present disclosure, wherein example 41 also includes the subject matter according to any one of examples 33 to 40, above.

Contacting first depth-control shoulder 156 and second depth-control shoulder 256 in non-gapped relation 516 with an outer surface 502 of terminal block 500 provides an immediate visual and/or tactile indication that electrical contact 402 has been inserted into receptacle 504 at the depth required for engaging flange 408 in seated position 510 with receptacle locking clip 506. In contrast, FIGS. 21-22 illustrate first depth-control shoulder 156 and second depth-control shoulder 256 undesirably in gapped relation 514 to outer surface 502 of terminal block 500, and which corresponds to flange 408 undesirably located in unseated position 512 relative to receptacle locking clip 506.

Referring generally to FIGS. 8, 8A, 9, 10, 13, 21, 22, 25, and 26, and particularly to, e.g., FIGS. 14A-14E, according to method 600, pushing electrical contact 402 into receptacle 504 of terminal block 500 using first internal shoulder 154 of first tip half 130 and second internal shoulder 254 of second tip half 230 to interlock electrical contact 402 and terminal block 500 further comprises (block 654) inserting first nose portion 152 of first tip half 130 and second nose portion 252 of second tip half 230 into receptacle 504 of terminal block 500 until first depth-control shoulder 156 of first tip half 130 and second depth-control shoulder 256 of second tip half 230 contact outer surface 502 of terminal block 500. The preceding subject matter of this paragraph characterizes example 42 of the present disclosure, wherein example 42 also includes the subject matter according to example 41, above.

Inserting first nose portion 152 and second nose portion 252 into receptacle 504 until first depth-control shoulder 156 and second depth-control shoulder 256 contact the outer surface 502 of terminal block 500 (e.g., FIGS. 25-26) enables first nose portion 152 and second nose portion 252 to control the lateral position of electrical contact 402 during insertion into receptacle 504. In addition, first nose portion 152 and second nose portion 252 guide electrical contact 402 into interlocking engagement with receptacle locking clip 506.

Referring generally to FIGS. 10, 13, 19, and 26, and particularly to, e.g., FIGS. 14A-14E, according to method 600, pushing electrical contact 402 into receptacle 504 of terminal block 500 using first internal shoulder 154 of first tip half 130 and second internal shoulder 254 of second tip half 230 to interlock electrical contact 402 and terminal block 500 further comprises (block 656) pushing on contact aft end 406 of electrical contact 402 using first internal shoulder 154 and second internal shoulder 254 and without first nose end 158 of first nose portion 152 of first tip half 130 and second nose end 258 of second nose portion 252 of second tip half 230 engaging flange 408 of electrical contact 402 that is spaced away from contact aft end 406 of electrical contact 402. The preceding subject matter of this paragraph characterizes example 43 of the present disclosure, wherein example 43 also includes the subject matter according to example 42, above.

Pushing on contact aft end 406 of electrical contact 402 without first nose end 158 and second nose end 258 engaging flange 408 prevents first nose end 158 and second nose end 258 from interfering with the interlocking of flange 408 with receptacle locking clip 506. As shown in FIG. 26, first nose portion 152 and second nose portion 252 are preferably configured such that when electrical contact 402 is engaged with receptacle locking clip 506, first nose end 158 and second nose end 258 are in non-contacting relation to receptacle locking clip 506.

Referring generally to FIGS. 4, 7, 10, and 13, and particularly to, e.g., FIGS. 14A-14E, method 600 further comprises (block 658) inserting tip-alignment protrusion 150 of first tip half 130 into tip-alignment recess 250 of second tip half 230 prior to pivotally adjusting first orientation of first tip half 130 relative to first tip-support portion 112 of first lever 102 and pivotally adjusting second orientation of second tip half 230 relative to second tip-support portion 212 of second lever 202. The preceding subject matter of this paragraph characterizes example 44 of the present disclosure, wherein example 44 also includes the subject matter according to example 43, above.

Engaging tip-alignment protrusion 150 (e.g., FIG. 7) with tip-alignment recess 250 (e.g., FIG. 7) when pivotally adjusting the orientation of first tip half 130 and second tip half 230 enables first tip half 130 and second tip half 230 to be rotated as a set to the same orientation relative to respective first tip-support portion 112 and second tip-support portion 212. In addition, engagement of tip-alignment protrusion 150 with tip-alignment recess 250 maintains alignment of first channel 132 with second channel 232 during rotation of first tip half 130 and second tip half 230, which ensures that wire 400 will fit within first channel 132 and second channel 232 when first tip half 130 and second tip half 230 are clamped together (e.g., FIGS. 2, 3, and 6), regardless of the orientation of first tip half 130 and second tip half 230 relative to first tip-support portion 112 and second tip-support portion 212.

Referring generally to FIGS. 4, 7, 10, and 13, and particularly to, e.g., FIGS. 14A-14E, according to method 600, inserting tip-alignment protrusion 150 of first tip half 130 into tip-alignment recess 250 of second tip half 230 prior to pivotally adjusting first orientation of first tip half 130 relative to first tip-support portion 112 of first lever 102 and pivotally adjusting second orientation of second tip half 230 relative to second tip-support portion 212 of second lever 202 further comprises (block 660) mating protrusion flat side surface 151 of tip-alignment protrusion 150 with recess flat side surface 251 of tip-alignment recess 250. The preceding subject matter of this paragraph characterizes example 45 of the present disclosure, wherein example 45 also includes the subject matter according to example 44, above.

Mating protrusion flat side surface 151 of tip-alignment protrusion 150 with recess flat side surface 251 of tip-alignment recess 250 provides a simple way to engage tip-alignment protrusion 150 with tip-alignment recess 250 in a manner preventing rotation of tip-alignment protrusion 150 relative to tip-alignment recess 250. As may be appreciated, tip-alignment protrusion 150 and tip-alignment recess 250 may be provided in any one of a variety of geometrically complementary shapes that match one another such that first tip half 130 and second tip half 230 rotate as a set.

Different examples of the apparatuses and methods disclosed herein include a variety of components, features, and functionalities. It should be understood that the various examples of the apparatuses and methods disclosed herein may include any of the components, features, and functionalities of any of the other examples of the apparatuses and methods disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

The invention claimed is:

1. A method (600) of manipulating a wire (400), having an electrical contact (402), relative to a terminal block (500), the method (600) comprising steps of:

clamping the wire (400) with a predetermined force between a first gripping portion (140), installed in a first channel (132) of a first tip half (130), and a second gripping portion (240), installed in a second channel (232) of a second tip half (230);

pushing the electrical contact (402) into a receptacle (504) of the terminal block (500) using a first internal shoulder (154) of the first channel (132) and a second internal shoulder (254) of the second channel (232) to interlock the electrical contact (402) and the terminal block (500); and with the wire (400) clamped with the predetermined force between the first gripping portion (140) and the second gripping portion (240), verifying that the electrical contact (402) and the terminal block (500) are interlocked by pulling the first tip half (130) and the second tip half (230) away from the terminal block (500) until the wire (400) slips along the first gripping portion (140) of the first tip half (130) and the second gripping portion (240) of the second tip half (230).

2. The method (600) according to claim 1, wherein the step of clamping the wire (400) with the predetermined force between the first gripping portion (140) of the first tip half (130) and the second gripping portion (240) of the second tip half (230) comprises clamping the wire (400) between the first gripping portion (140), made of a resiliently compressible material, and the second gripping portion (240), made of the resiliently compressible material.

3. The method (600) according to claim 1, wherein the step of clamping the wire (400) with the predetermined force between the first gripping portion (140) of the first tip half (130) and the second gripping portion (240) of the second tip half (230) comprises clamping the wire (400) with a tool-wire frictional force between the wire (400) and the first gripping portion (140) and the second gripping portion (240), that is less than a seated-contact removal force, required to disengage a flange (408) of the electrical contact (402) from a receptacle locking clip (506) of the terminal block (500) when the flange (408) is seated in the receptacle locking clip (506), and greater than an unseated-contact removal force required to pull the electrical contact (402) at least partially out of the receptacle (504) of the terminal block (500) when the flange (408) of the electrical contact (402) is unseated from the receptacle locking clip (506) of the terminal block (500).

4. The method (600) according to claim 1, further comprising:

supporting the first gripping portion (140) in a first interior cavity (138) of the first channel (132) of the first tip half (130); and supporting the second gripping portion (240) in a second interior cavity (238) of the second channel (232) of the second tip half (230).

5. The method (600) according to claim 1, wherein the step of clamping the wire (400) with the predetermined force between the first gripping portion (140) of the first tip half (130) and the second gripping portion (240) of the second tip half (230) comprises clamping the wire (400) between a first inner surface (141) of the first gripping portion (140) and a second inner surface (241) of the second gripping portion (240) so that at least one of the first gripping portion (140) or the second gripping portion (240) is resiliently deformed in compression.

6. The method (600) according to claim 1, wherein, when the wire (400) is clamped between the first gripping portion (140) of the first tip half (130) and the second gripping portion (240) of the second tip half (230):

the wire (400) is loose between a first-channel distal-end portion (159) of the first channel (132) of the first tip half (130) and a second-channel distal-end portion (259) of the second channel (232) of the second tip half (230), the wire (400) is loose between a first-channel intermediate portion (160) of the first channel (132) and a second-channel intermediate portion (260) of the second channel (232), and the wire (400) is loose between a first-channel proximal-end portion (161) of the first channel (132) and a second-channel proximal-end portion (261) of the second channel (232).

7. The method (600) according to claim 6, wherein, when the wire (400) is clamped between the first gripping portion (140) of the first tip half (130) and the second gripping portion (240) of the second tip half (230), the electrical contact (402) of the wire (400) is loose between the first-channel proximal-end portion (161) of the first channel (132) and the second-channel proximal-end portion (261) of the second tip half (230).

8. The method (600) according to claim 1, wherein, the step of verifying that the electrical contact (402) and the terminal block (500) are interlocked by pulling the first tip half (130) and the second tip half (230) away from the terminal block (500) until the wire (400) slips along the first gripping portion (140) of the first tip half (130) and the second gripping portion (240) of the second tip half (230) is performed while clamping the wire (400) with the predetermined force between a first inner surface (141) of the first gripping portion (140) and a second inner surface (241) of the second gripping portion (240).

9. The method (600) according to claim 1, wherein the step of clamping the wire (400) with the predetermined force between the first gripping portion (140) of the first tip half (130) and the second gripping portion (240) of the second tip half (230) further comprises steps of:

moving a first handle portion (118) of a first lever (102) and a second handle portion (218) of a second lever (202) toward each other so that the first tip half (130), supported by the first lever (102), and the second tip half (230), supported by the second lever (202), move away from each other;

placing the wire (400) between the first gripping portion (140) of the first tip half (130) and the second gripping portion (240) of the second tip half (230); and biasing the first handle portion (118) of the first lever (102) and the second handle portion (218) of the second lever (202) away from each other so that the first tip half (130) and the second tip half (230) move toward each other and the wire (400) is clamped between the first gripping portion (140) of the first tip half (130) and the second gripping portion (240) of the second tip half (230) with the predetermined force.

10. The method (600) according to claim 9, wherein the step of moving the first handle portion (118) of the first lever (102) and the second handle portion (218) of the second lever (202) toward each other so that the first tip half (130), supported by the first lever (102), and the second tip half (230), supported by the second lever (202), move away from each other comprises pivoting the first handle portion (118) and the second handle portion (218) about a lever-pivot axis (300) that pivotally interconnects the first lever (102) and the second lever (202).

11. The method (600) according to claim 10, further comprising changing the predetermined force between the first gripping portion (140) of the first tip half (130) and the second gripping portion (240) of the second tip half (230) by moving means for biasing (304) a first tip-support portion (112) of the first lever (102) and a second tip-support portion (212) of the second lever (202) toward each other from a first bore (120) of the first handle portion (118) of the first lever (102) and a second bore (220) of the second handle portion (218) of the second lever (202) to a third bore (123) of the first handle portion (118) and a fourth bore (223) of the second handle portion (218).

12. The method (600) according to claim 11, further comprising steps of:

pivotally adjusting a first orientation of the first tip half (130) relative to the first tip-support portion (112) of the first lever (102); and pivotally adjusting a second orientation of the second tip half (230) relative to the second tip-support portion (212) of the second lever (202).

13. The method (600) according to claim 12, wherein the step of pivotally adjusting the first orientation of the first tip half (130) relative to the first tip-support portion (112) of the first lever (102) and pivotally adjusting the second orientation of the second tip half (230) relative to the second tip-support portion (212) of the second lever (202) respectively further comprises steps of:

pivoting, about a first tip-pivot axis (142) of the first tip half (130), a first boss (146) of the first tip half (130) inside a first tip-support-portion opening (114) of the first tip-support portion (112) of the first lever (102); and pivoting, about a second tip-pivot axis (242), a second boss (246) of the second tip half (230) inside a second tip-support-portion opening (214) of the second tip-support portion (212) of the second lever (202).

14. The method (600) according to claim 13, wherein the step of pivoting, about the first tip-pivot axis (142) of the first tip half (130), the first boss (146) of the first tip half (130) inside the first tip-support-portion opening (114) of the first tip-support portion (112) of the first lever (102) further comprises a step of discretely angularly positioning the first tip half (130) relative to the first tip-support portion (112) of the first lever (102), and the step of pivoting, about the second tip-pivot axis (242) of the second tip half (230), the second boss (246) of the second tip half (230) inside the second tip-support-portion opening (214) of the second tip-support portion (212) of the second lever (202) further comprises a step of discretely angularly positioning the second tip half (230) relative to the second tip-support portion (212) of the second lever (202).

15. The method (600) according to claim 14, wherein the step of discretely angularly positioning the first tip half (130) relative to the first tip-support portion (112) of the first lever (102) comprises discretely angularly positioning the first tip half (130) relative to the first tip-support portion (112) of the first lever (102) in 30-degree increments, and the step of discretely angularly positioning the second tip half (230) relative to the second tip-support portion (212) of the second lever (202) comprises the step of discretely angularly positioning the second tip half (230) relative to the second tip-support portion (212) of the second lever (202) in 30-degree increments.

16. The method (600) according to claim 15, further comprising applying an external force to one of a push-pad portion (116), coupled to one of the first tip-support portion (112) of the first lever (102) or the second tip-support portion (212) of the second lever (202), or a pull-pad portion (216), coupled to one of the first tip-support portion (112) of the first lever (102) or the second tip-support portion (212) of the second lever (202), when performing at least one of steps of:

pushing the electrical contact (402) into the receptacle (504) of the terminal block (500) using the first internal shoulder (154) of the first channel (132) of the first tip half (130) and the second internal shoulder (254) of the second channel (232) of the second tip half (230) to interlock the electrical contact (402) and the terminal block (500); or with the wire (400) clamped with the predetermined force between the first gripping portion (140) and the second gripping portion (240), verifying that the electrical contact (402) and the terminal block (500) are interlocked by pulling the first tip half (130) and the second tip half (230) away from the terminal block (500) until the wire (400) slips along the first gripping portion (140), installed in the first channel (132), and the second gripping portion (240), installed in the second channel (232).

17. The method (600) according to claim 16, wherein the step of pushing the electrical contact (402) into the receptacle (504) of the terminal block (500) using the first internal shoulder (154) of the first tip half (130) and the second internal shoulder (254) of the second tip half (230) to interlock the electrical contact (402) and the terminal block (500) comprises contacting a first depth-control shoulder (156) of the first tip half (130) and a second depth-control shoulder (256) of the second tip half (230) with an outer surface (502) of the terminal block (500).

18. The method (600) according to claim 17, wherein the step of pushing the electrical contact (402) into the receptacle (504) of the terminal block (500) using the first internal shoulder (154) of the first tip half (130) and the second internal shoulder (254) of the second tip half (230) to interlock the electrical contact (402) and the terminal block (500) further comprises inserting a first nose portion (152) of the first tip half (130) and a second nose portion (252) of the second tip half (230) into the receptacle (504) of the terminal block (500) until the first depth-control shoulder (156) of the first tip half (130) and the second depth-control shoulder (256) of the second tip half (230) contact the outer surface (502) of the terminal block (500).

19. The method (600) according to claim 18, wherein the step of pushing the electrical contact (402) into the receptacle (504) of the terminal block (500) using the first internal shoulder (154) of the first tip half (130) and the second internal shoulder (254) of the second tip half (230) to interlock the electrical contact (402) and the terminal block (500) further comprises pushing on a contact aft end (406) of the electrical contact (402) using the first internal shoulder (154) and the second internal shoulder (254) and without a first nose end (158) of the first nose portion (152) of the first tip half (130) and a second nose end (258) of the second nose portion (252) of the second tip half (230) engaging a flange (408) of the electrical contact (402) that is spaced away from the contact aft end (406) of the electrical contact (402).

20. The method (600) according to claim 19, further comprising inserting a tip-alignment protrusion (150) of the first tip half (130) into a tip-alignment recess (250) of the second tip half (230) prior to the step of pivotally adjusting the first orientation of the first tip half (130) relative to the first tip-support portion (112) of the first lever (102) and the step of pivotally adjusting the second orientation of the second tip half (230) relative to the second tip-support portion (212) of the second lever (202).

* * * * *